United States Patent [19]

Rowan

[11] Patent Number: 4,884,809

[45] Date of Patent: Dec. 5, 1989

[54] INTERACTIVE TRANSECTOR DEVICE

[76] Inventor: Larry Rowan, 3440 Caroline Ave., Culver City, Calif. 90230

[21] Appl. No.: 814,743

[22] Filed: Dec. 30, 1985

[51] Int. Cl.[4] ..... F41B 15/04

[52] U.S. Cl. ..... 273/84 ES; 42/1.08; 42/1.16; 361/232

[58] Field of Search ..... 273/84 R, 84 ES; 361/232; 42/1.16, 1.01, 1.08, 1.09, 1.15, 52

[56] References Cited

U.S. PATENT DOCUMENTS

| | | | |
|---|---|---|---|
| 2,195,711 | 4/1940 | Hutchison | 42/1.16 |
| 2,625,764 | 1/1953 | O'Brien et al. | 273/84 R |
| 2,634,535 | 4/1953 | Borders | 273/84 R |
| 3,241,259 | 3/1966 | McBride | 42/1.16 |
| 3,362,711 | 1/1968 | Larsen | 273/84 ES |
| 3,385,601 | 5/1968 | Black | 42/1.16 |
| 3,625,222 | 12/1971 | Shimizu | 273/84 ES |
| 3,998,459 | 12/1976 | Henderson et al. | 273/84 ES |
| 4,486,807 | 12/1984 | Yanez | 273/84 ES |

*Primary Examiner*—Leo P. Picard

*Attorney, Agent, or Firm*—Malke Leah Bas Meyer; Itzhak Ben Shlomo

[57] ABSTRACT

A non-lethal multivariant device utilized by one or more individuals at close range (1.0–100 plus meters) to disperse crowds which exhibit a propensity towards violence, disposed to creating a public danger by inflecting bodily injury, loss of life or extensive property damage. A variety of preprogrammed functions are choosen at the discretion of the user to neutralize potentially dangerous individuals which pose a threat to not only themselves but other members of society. The operative functions available to the user consists of but are not limited to the dispersal of non-lethal carrier mediated volitiles, short range high frequency electroshock, administration of thermal inductants and the ability to project disruptive acoustical transmission. It is believed that the basic embodiment of the device provides a viable alternative to the user of such devices as guns, tear gas projectiles, mase, a class of high voltage low amp devices and numerous other means deployed by law enforcement agencies to capture or subdue potentially dangerous individuals.

10 Claims, 40 Drawing Sheets

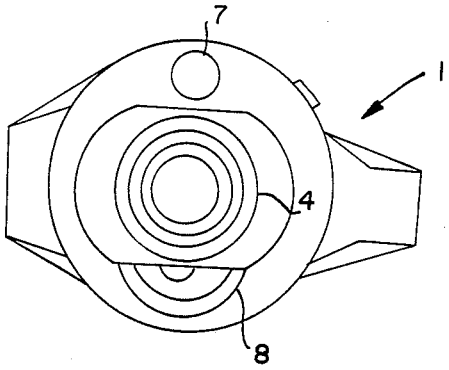
FIG. 1
FIG. 2
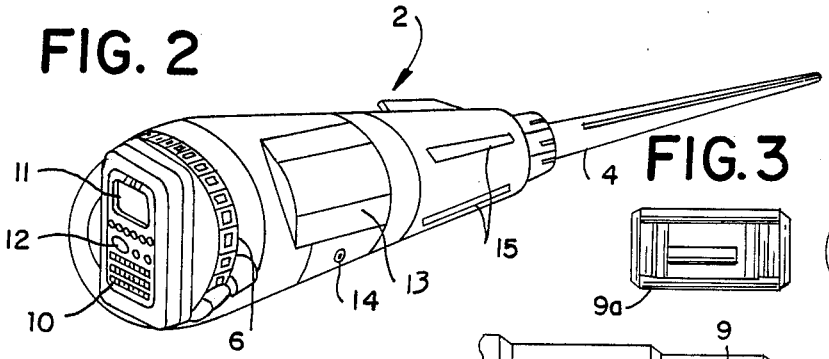
FIG. 3
FIG. 4
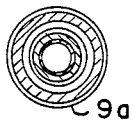
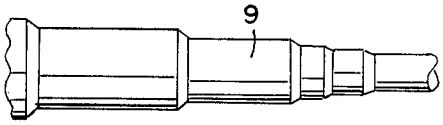
FIG. 5
FIG. 6
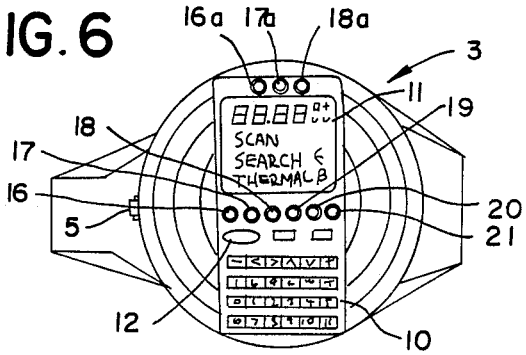

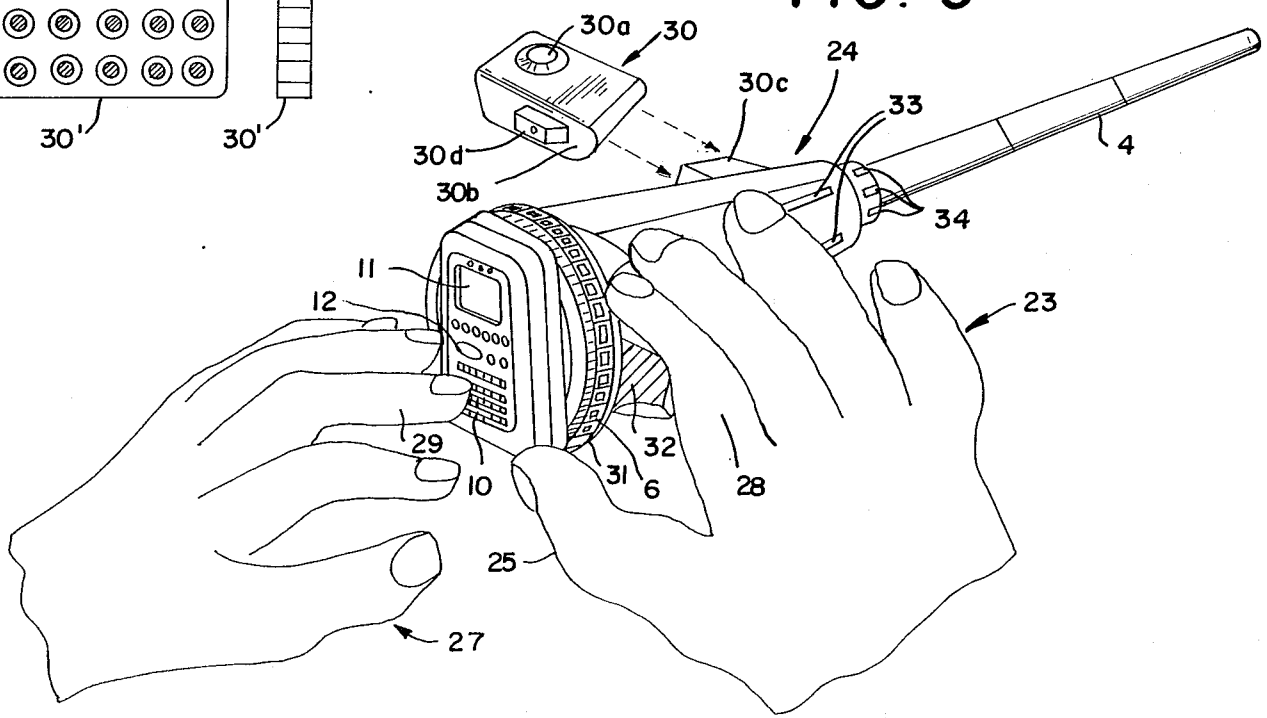
FIG. 9
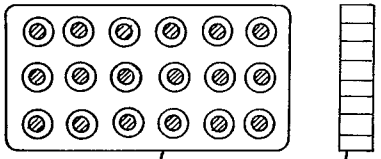
FIG. 10
FIG. 11

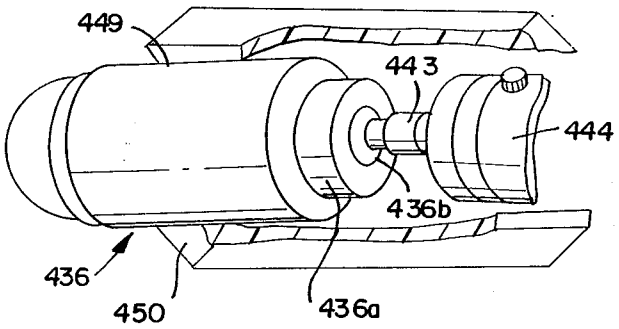
FIG. 46
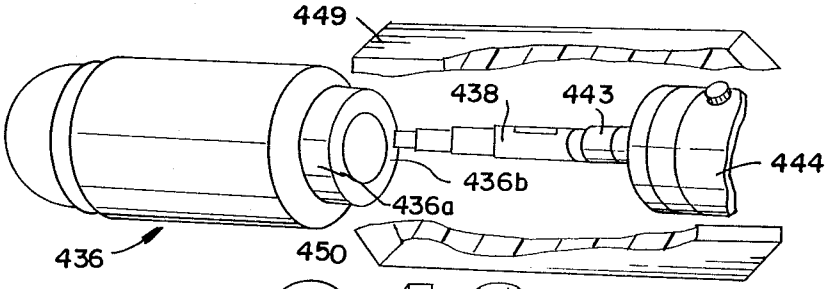
FIG. 45
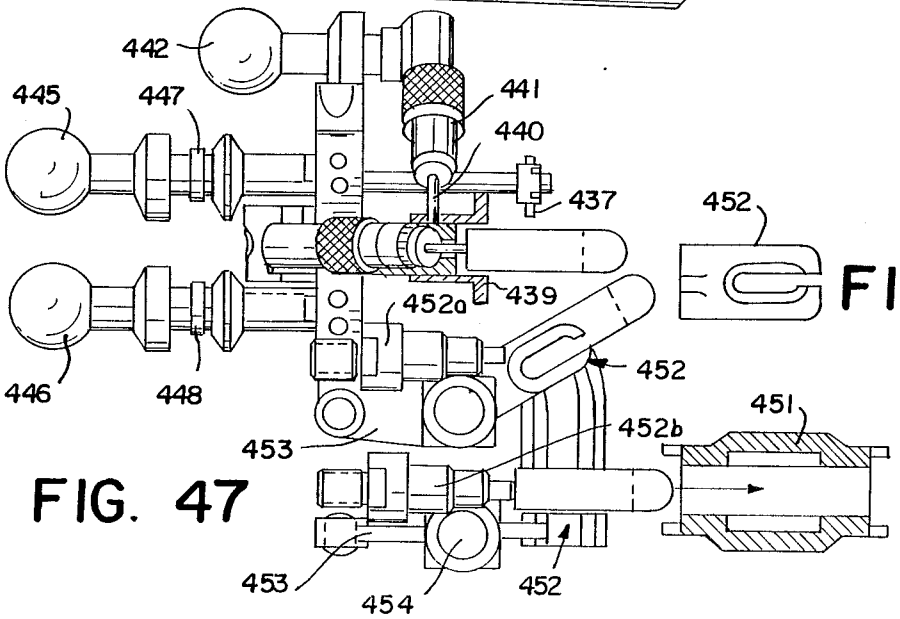
FIG. 48
FIG. 47

484
485
486
487
488
489
490
491
492
493
494
495
496
497
498
499
500
501
502
503
504
505
506
506a
507
507a
508
509
510
511
512
513
517

INTERACTIVE TRANSECTOR DEVICE

BACKGROUND OF THE INVENTION

1. Field Of The Invention

The invention pertains to short range non-lethal devices utilized to immediadtely subdue and neutralize potentially dangerous or violent individuals. The scope of the invention specifically resides in emissive devices which project non-lethal gases or means which administer disruptive acoustical, thermoconvective or electric shock waves.

2. Description Of The Prior Art

Examples set forth in the field of the invention essentially resides in the application of self propelled tear gas projectiles, the implementation of noxious chemical aerosols, such as mace and the introduction of various electric shock generators ranging from electric proding devices to those projecting high voltage electrodes on reels, as presently described by the taser or similar such means.

Not one of the present systems currently utilized by law enforcement agencies can be programmed by the user to provide a variety of functions as needed to readily adjust to the altering circumstances in which the law enforcement agent find themselves in. The properties of tear gas according to present data have a relatively uncontrollable dispersal rate, which varies in potency and there has been documented cases where tear gas canisters have detonated either prematurely or have acted as an incindrary, leveling buildings or entire neighborhoods. The application of such chemicals, such as mace have been known to vary in concentration, or potency, due to a limited shelf life and produce convulsive siezures in some individuals. Devices producing high voltage electric shocks have been known to produce uncontrollable convulsions, excruciating pain and have even killed some individuals by arresting their heart, due to prolong exposure to the current generated by the said devices. Typically, non-lethal devices have provided the user with limited or restricted operation due to a lack of precision which often involves more than one untargeted individual, or lacking the utility of selectively neutralizing more than one designated individuals either in rapid succession or simultaneously. A further difficulty with present means employed by law enforcement agencies is the inability to adopt to the wide variances and unpredictable nature of potentially explosive situations where the use of lethal force might be the only other viable alternative available to the enforcement agent. There has therefore been a long felt need to provide law enforcement agents with a viable deterrent to the enactment of crimes perpetrated by one or more individuals. The present invention is directed towards filling the existing need.

SUMMARY OF THE INVENTION

The present invention relates to the construction of a portable programmable non-lethal multifunction device which readily provides law enforcement agents with a means wherein potentially dangerous individuals can be efficiently subdued, apprehended and appropriately detained, minimizing the possibility of the said individuals either injuring themselves or others. In the preferred embodiment the device is incorporated into a cylindrical configuration which upon the appropriate keying distends or retracts a graduated telescoping delivery means. The delivery means in effect is a multipurposed structure serving as a directional unit for dispersing reactive carrier mediated volitiles, the delivery of electric charges, or the accurate projection of acoustical, chemical and/or kinetic/emissive fields. A rotating or radial selector means is preferentially located in the aft section of the devices body circumferentially disposed to be operated by holding or grasping the body with one hand and rotating the switch in a radial manner with either the palm or fingers of the other hand. The specific function, its duration and subsequent intensity is governed by the particular setting the rotating selector means engages. A release button or actuator means is preferably located midway between the front of the unit's body and its aft section. The release button is ideally actuated by depressing it with either the thumb or index finger. Several fail-safe mechanisms prevent unauthorized use of the device or its accidental discharge. The device will not be actuated when placed in firing mode; unless a keying code or key means releases the lock mechanism. The device will remain activated, but inoperative when the radial selector is placed in the standby position, until the selector is rotated into an operative mode.

The accurate targeting and tracking of mobile individuals, which are considered dangerous within a crowd, is accomplished by laser designation. Once a suspect is sighted the device is pointed towards one or more individuals and placed in the search mode. The tracking of designated targets will continue until the mode is switched off, or another designated target is choosen by the user, or when the target moves beyond the range of the device and in the event the target is engaged by a given selected operative mode. The device is equipted with a memory means in the event a designated target exceeds the operative range of the device momentarily then moves back into the aforesaid range where it is monitored by sensors and identified. Upon identification of a fluctuating target, the device immediately computes the targets position and distance locking automatically onto the aforesaid target with its laser designator system. The laser designator means has a tunable frequency and wavelength in order to operate almost ideally in a range of atmospheric conditions varying from 0%-98% humidity. Often in explosive situations the law enforcement agents are vastly outnumbered and a hostile crowd, which if sufficiently agitated by the use of tear gas or the discharge of fire arms will be provoked into proportionately greater acts of violence leading to a loss of life and property. Statistical analyses shows that mob violence is in most instances induced by a small number of agitators who provide the necessary coordination and logistics for the seemingly senseless aberrant behavior of the crowd. The aforesaid agitators utilize an effective means of communication to control others. Therefore, in order to defuse a potentially dangerous situation communications must either be disabled, denied, disrupted or destroyed by non-violent means and the transector unit neutralizes dangerous individuals by the deployment several concomitant systems. The dispersal of complex carrier mediated volatiles provides the first of the concomitant systems. The telescoping barrel means project from the body of the device is formed from a series of interlocking self sealing tubular structures. Each tubular structure forms a segment and each segment consists of three layers. The outer most layer forming the tubular structure is composed of a suitable hardened alloy material capable of conducting a charge. The metallic structural material is immediately preceded by a a layer of sintered material circumferentially disposed inbetween the outer layer and a reinforced interior layer of structural material. The aforesaid volatiles enters through the exits from the sintered portion of the tubular structure wherein dispersal takes place.

The class of suitable chemical compounds forming volitiles consists of carrier mediated anesthetics, cryogenics, noxious or temporarily disabilitating chemical substances and the like are combined with various penetrators such as DMSO. The volatiles are complexed with the said penetrator prior to being dispersed which allows the chemically combined substances to pass through clothing, protective shields of plastics, or other means including the designated individuals skin, entering almost immediately into their bloodstream. The supply of volatile substances and penetrators are replenished by the insertion of an array of pressurized cartridges, which are side loaded into the device as expended cartridges are removed from the unit.

A second concomitant system consists of the automated localized discharge of high frequency electrical fields and the programmed delivery of radiofrequency induced hyperthermia. Paralysis and/or localized muscular contraction is immediately induced locally to peripheral areas, such as appendages, without directly involving an individuals cardiovascular system which is often disrupted by conventional electric shock means deployed to subdue potentially dangerous persons. Where the application of localized electric discharges are ineffectual or ill advised the procurement of directed radiofrequency waves are enlisted to induce localized hyperthermia, which when projected from the device causes an intense burning sensation in the specified targeted region. A specified targeted region is preferably, an arm or hand of a potentially dangerous assailant making threatening gestures or grasping a weapon. Both the induced electrical discharge of high frequency electricity and radiofrequency emissions are conducted in and along the system of interlocking tubular structures projected from the body of the device. Sensors operate within the contexts of a interactive feedback in order to control the distribution, intensity, duration and frequency of electrical discharge and/or the characteristics of the radiofrequency emissions. Unlike the operation of conventional means or units which employ electric shock to overcome individuals the transector device monitors individuals vital signs and regulates the delivery of radiofrequency emissions or electric discharge values to coincide precisely with values needed to subdue an assailant, but not cause undue injury or disruption of vital functions involving the cardiovascular, pulmonary system and/or unecessary damage to neurological or other physiological structures.

A tightly focused acoustical transmission is utilized inconjunction with intense beams of non-lethal coherent light provides a third concomitant system. A piezoelectric sonic field resonator and coherent emissive beam generator means embodied within the main structure of the device representing a third concomitant system. A piezoelectric system disposed beneath the barrel of the device projects a series of short intense sonic bursts which temporarily disrupts the auditory and vestubular functions of a specified individual inducing momentary discomfort, disorientation and confusion. An intense burst of light emitted from a miniature laser source induces temporary blindness to sighted individuals preventing either the sending or receiving visual cues by a designated individual. The sensory deprivation of audio/visual signals are cojointly deployed by a preprogrammed format embodied in the device to neutralize the capacity of individuals to initiate and execute acts of violence. The laser system is located within the units main body and is powered, as is the sonic means by either batteries or an ancillary power source for repeated or prolonged operation. The programmed delivery of miniature designated projectiles essentially forms the forth, fifth and sixth concomitant systems or processes, respectively. A variety of small caliber projectiles are dispatched from the central bore of the barrel, which may be either extended or retracted during the delivery operation. The range, detonation radii, dispersal pattern and the like are determined either by manually programming initiated by the user; or automatically controlled and programmed by the microcomputer means. The microcomputer is a self contained unit embodied within the body of an insertable card which can be rapidly loaded into or withdrawn from the device. The projectiles launched from the device are propelled by either chemical combustion or chemical surface reactions, compressed air, compressed fluid gas, phase intermixing, or other suitable means of propulsion. The projectiles are delivered into three separate types or classes which are loaded from separate and distinct magazines into a rotating chamber. The rotating chamber revolves into position until a specific type of projectile is selected and secured into a firing position. The first type or class of projectile consists of a group of miniature flares which when ignited above a specified target area produces an intense blinding light. The second type of projectiles consists of a group of exploding cartridges, which upon detonation above a specified target region or site produces a deafening sound and concussive force generated locally within the said region. The third type of projectile consists of a class of volitile chemicals similar to those dispersed from the distal peripheral portion of the barrel structure, but utilized in a specific manner as to form an aerosol which saturates an entire area encompassing selected targets. Carrier mediated aerosols are composed of anesthetics cryogenics, noxious chemical compounds, or other suitable specialized substances, which consist of a volatile component and an appropriate penetrator means. The chemical aerosols mix with the atmosphere, adhere to and penetrate the surfaces of individuals bodies exacting a number of non-lethal physiological effects calculated to neutralize threats posed by relatively large numbers of individuals.

It is contemplated that the cylindrical configuration of the device could be replaced by other structural configurations which may vary in design depending upon the users needs. The teachings of the subject invention could also be incorporated into a cane, staff, briefcase, or miniaturized small enough to fit into a pen or placed into apparel, or even assume another portable configuration.

Thus, it is an object of the present invention to provide the user with a number of readily available nonlethal options to effectively neutralize potentially dangerous individuals and to defuse potentially explosive situations.

It is a further object of the present invention to provide a means wherein physiological parameters of living systems can be effectively and immediately ascertained in order that the biological tolerence levels of individuals are not exceeded, avoiding unnecessary injury or death to the aforesaid individuals. The frequency, intensity, duration and other properties of effective non-lethal counter measures calculated to neutralize the threat instituted by designated individuals are continuously monitored and readjusted automatically in a computerized feedback loop which operates autonomously of the user or other systems. It is still another object of the present invention to provide a means to designate, track or pursue and to lock onto a specified individual neutralizing the threat posed by the aforesaid individual to the exclusion of others.

It is yet an object of the present invention to provide the operative framework or structure wherein an assemblage of different systems can operate either singularly, simultaneously, or consecutively in response to a given specified threat situation.

It is still a further objective of the present invention to provide a new and or improved means to generate acoustical, electrical, photonic and thermal emissions and in the preporation and subsequent delivery of carrier mediated volitiles.

It is yet a further objective of the present invention to provide the user with a more versatile means to select and deliver non-lethal projectiles which vary in type and composition in instances where large numbers of individuals must be subdued and/or neutralized.

Additional objects of the present invention will become apparent from a reading of the specification and appended claims in which the preferred, but not necessarily the only forms of the invention will be described in detail, when taken in connection with the drawings accompanying and forming in part the application appended herein.

BRIEF DESCRIPTION OF THE DRAWINGS

FIGS. 1, 2, 3, 4, 5, and 6 are pictorial descriptions disclosing the front, aft and angular perspective of the transector device including the barrel assembly of the aforesaid device;

FIG. 9 is a pictorial angular perspective of the transector describing in part some of the loading features for the aforesaid device;

FIGS. 10, 11 are a plan view and side elevation of a magazine or cassette containing cartridges which are side loaded into the aforesaid device;

FIGS. 29 through 48 are perspective views of the loading assemblage, rotating cylinder and selector means utilized to specify the types, quantity and range of projectiles fired from the transector device;

Figure 77:
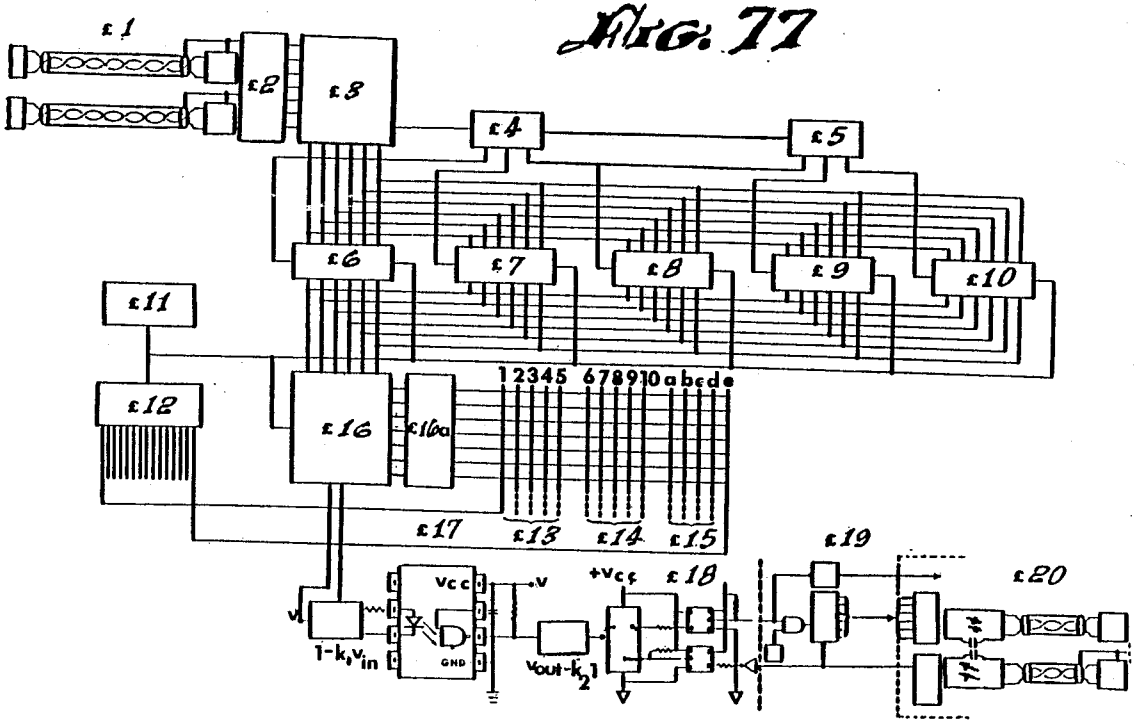
Figure 78:
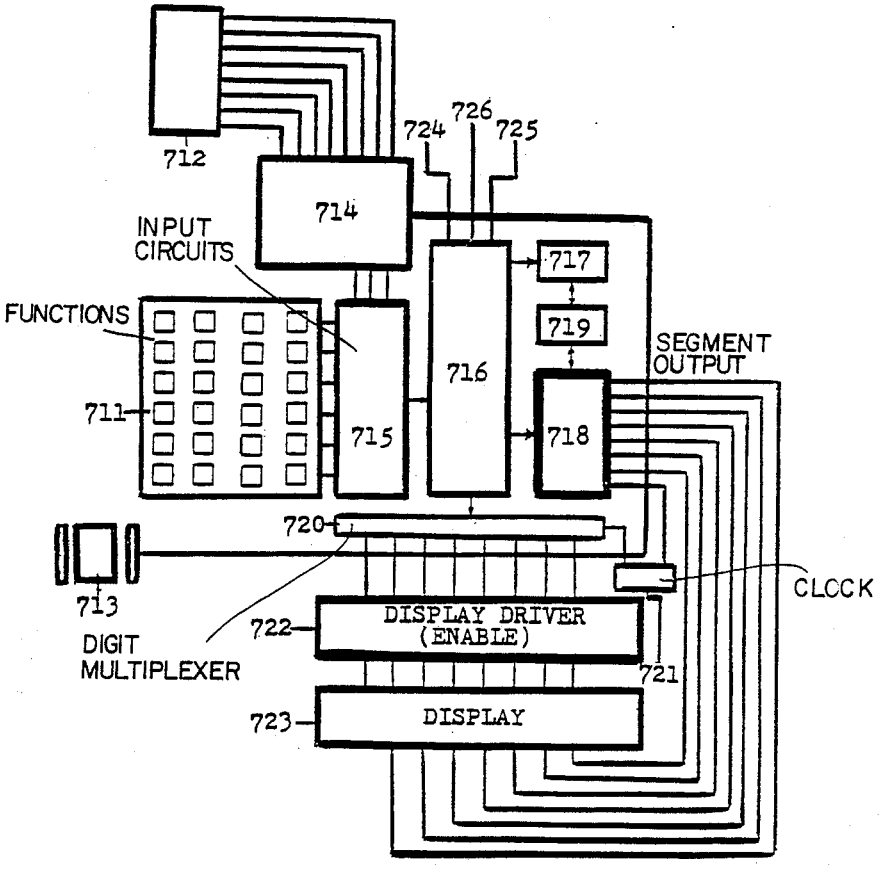
Figure 79:
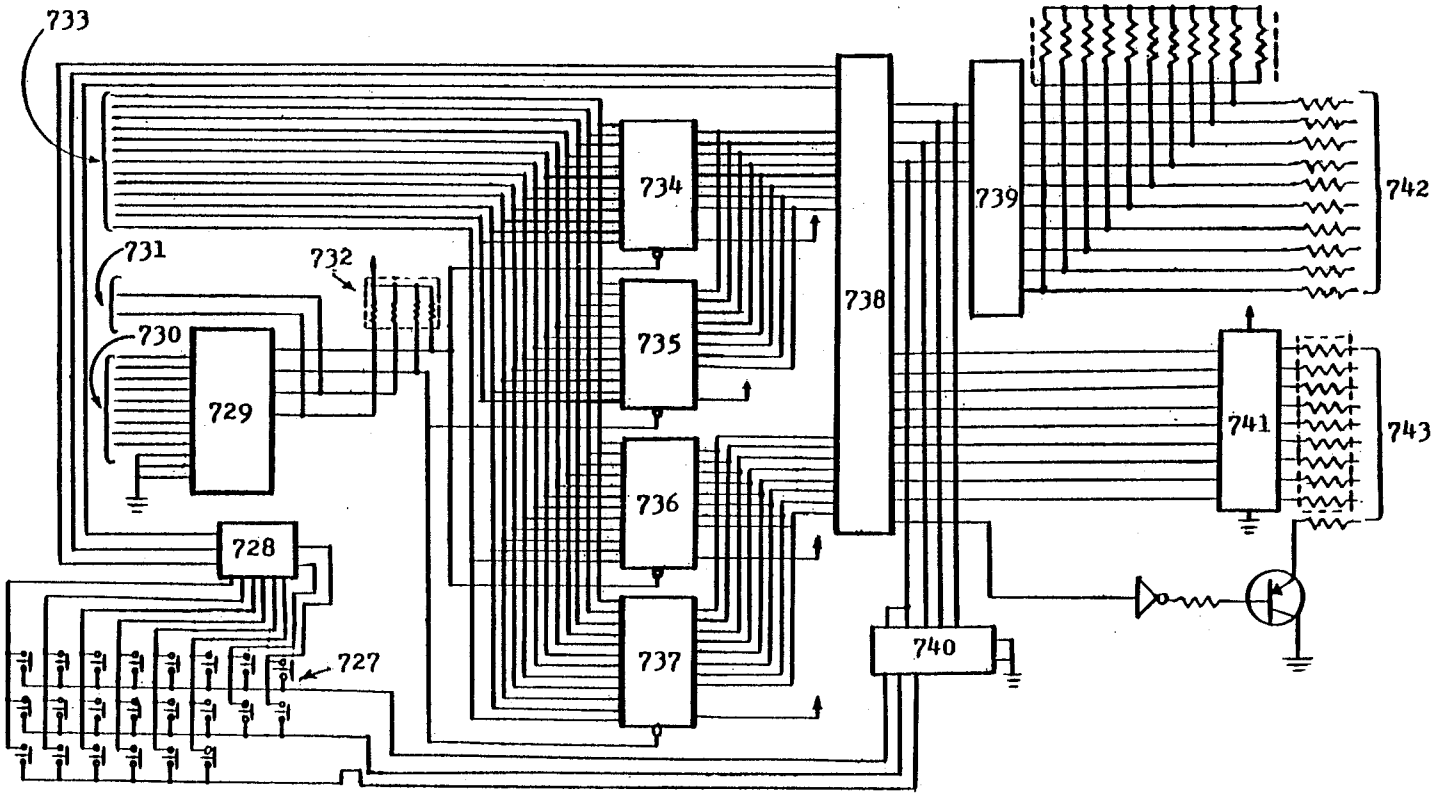
Figures 80, 80A, 80B:
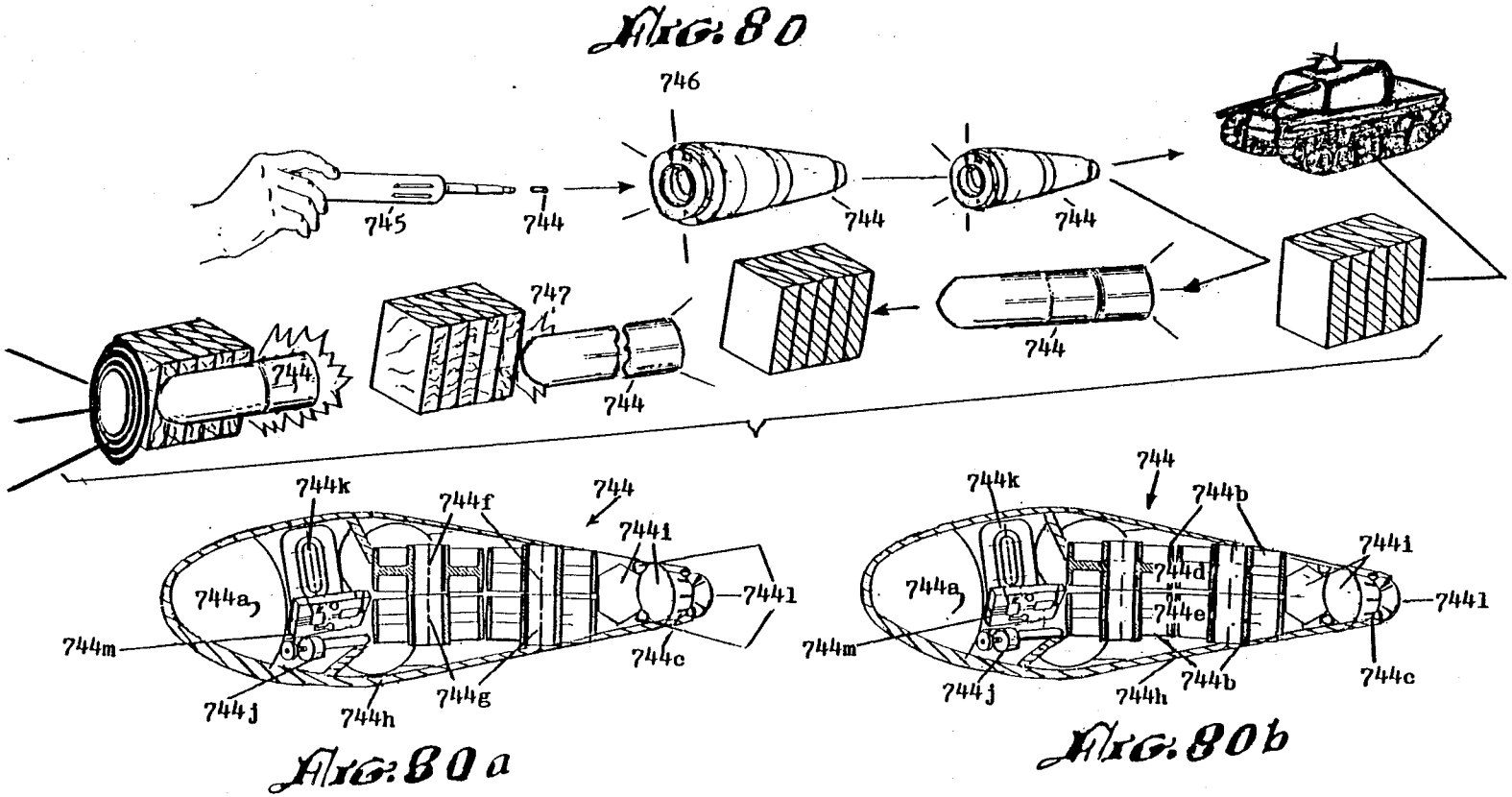

FIGS. *76a*, *76b* are indicative of extended operations and processes consistant with the global memory system;

FIG. 77 describes in part a combination circuit and block diagram schematically illustrating the operation of one of several equivalent electro-optical systems embodied within the transector device;

FIG. 78 illustrates in a simplified schematic fashion in part the mechanism by which the user keys the various functions of the transector device;

FIG. 79 defines a simplified electrical schematic designating a portion of the circuitry involved in keying the interactive screen, holographic, acoustical elements and the like systems associated with the devices operation;

FIG. 80 is a pictorial representation illustrating in a concise manner the delivery of a kinetic energy projectile dispersed from the user based transector device;

FIGS. 80a, 80b are cross-sections of a single projectile dispersed from the aforementioned transector device.

DETAILED DESCRIPTION OF THE PREFERRED EMBODIMENT

FIGS. 1, 2 and 6 are pictorial representationns of three perspective views of the transector device's exterior illustrating the front portion, aft section and side elevation of the aforesaid device. Numerals 1, 2, and 3 of said figures are assigned to three separate perspective views of the device's aft section, a side elevation defining a portion of the unit and a pictorial view of the front section. Numbers 4, 5, and 6 describe the telescopic barrel means, the firing mechanism and a rotatable selector means circumferentially disposed around the body of the device and utilized to program the numerous functions embodied with the transector unit. The laser emissive channel, number 7, is situated above barrel means 4; whereas the piezoelectric acoustical generator unit described by element 8 is disposed directly below the said barrel means, as indicated in FIG. 1. FIGS. 3, 4 and 5 are disclose two side elevations and a front view of the barrel mechanism embodied within said device which consists of a number of interlocking self sealing sections, not shown, and may either be extended or retracted, as described numeric values 9, 9a respectively. The entire transector unit is hermetically sealed, having the capability to function in a submerged state being encased in water proof materials well known by those skilled in the art. Located on the circular face of the aft section, numeral 3 is a series of indicator diodes, a alpha numeric display and a single element key pad means. The single element pad defined by element 10 consists of twenty four separate and distinct multifunctioned keys and two single function key elements. The number of key elements varies with the number of programmable functions. The key pad means serves as a code spcific locking or unlocking mechamism to either actuate or deactivate the transector device. The key pad, number 10, mechanism may at the discretion of the user act as a redundant feature programming the type of projectile fired, the number of projectiles fired, their range and dispersal pattern or the type, number and properties of the emission generated by the transector unit such as, the intensity, frequency and duration of one or more emissive sources embodied within the operative framework of the said device. Element 11 designates an LCD/LED alphanumeric display means, wherein keyed, programmed or automated functions are displayed to the user. A short term memory imprinted on a microchip, not shown, can be utilized to recall what had been previously displayed on the LCD/LED unit providing a record of events. Functions and properties of the said functions therein or qualitatively presented to the user acoustically by a piezoelectric wafer means is described by number 12, or visually in an analog manner through the sequential actuation of diode means, defined by elements 16 through 21, respectively. Manually programmed functions, target designation or automated operations can be conveyed either by a series of tones or verbal announcements through the piezoelectric means when deployed conventionally with a series of microchips encoded with tones or imprinted with digitized electronic equivalents of voice patterns. Diodes 16a, 17a and 18a are assigned different colors and pulsation rates in order to describe laser designation, the automated mode or manual override processes. Diode elements 16 through 21 denote the type of function elicited, the strength or intensity of a generated signal, the frequency of a signal and its duration. The function type is indicated by a flashing of a given colored diode intially which is then preceded by the sequential light of diodes 16 through 21, which are lighted in a linear fashion to disclose the intensity of a given function for which there are six arbitrary values. The frequency of the function is set by the pulsation rate of the diode representing the given function and the duration or time in which the specific function is to be administered by the length of time the function diode remains lit. The colors of the diode are red, orange, yellow, green, blue and white. The red emitting diode disposes the lowest intensity level and each other progressive color emitted, orange, yellow signifies a progressively higher intensity, until the maximum value is attained when the white light emitting diode is actuated. As previously noted, each of the linear diodes numbered 16 through 21 are initially lighted to disclose to the user a specific function. The order or color of the diodes actuated initially are arbitrary and are illustrated by the following arrangement, red signifies the use of volitiles, orange represents the deployment of projectiles, yellow indicates the use of acoustical transmissions, green indicates the deployment of thermoconvective emissions, blue denotes the actuation of electric shock elements and white indicates the implementation of an intense non-lethal laser emission. Numeral 22 defines the piezoelectric means referred to previously, located aft of the device.

The transector device adapts to a cylindrical configuration which is considered to be the optimium design for purposes of manipulation by the user, but may be constructed in other numerous different sizes and shapes depending upon the units intended use. Here the device is depicted in the form of a hand held cylinder with a manual trigger means, that is actuated by pressing the button like projection, numeral 5, with either the thumb, index finger or palm. A rotating selector means numeral 6 or a key pad means can manually set the type, number, intensity, frequency and duration of functions administered by the said device; either through the user rotating the selector means using their fingers or palm or by pressing the keys manually until the desired functions are executed by the device.

Figure 7:
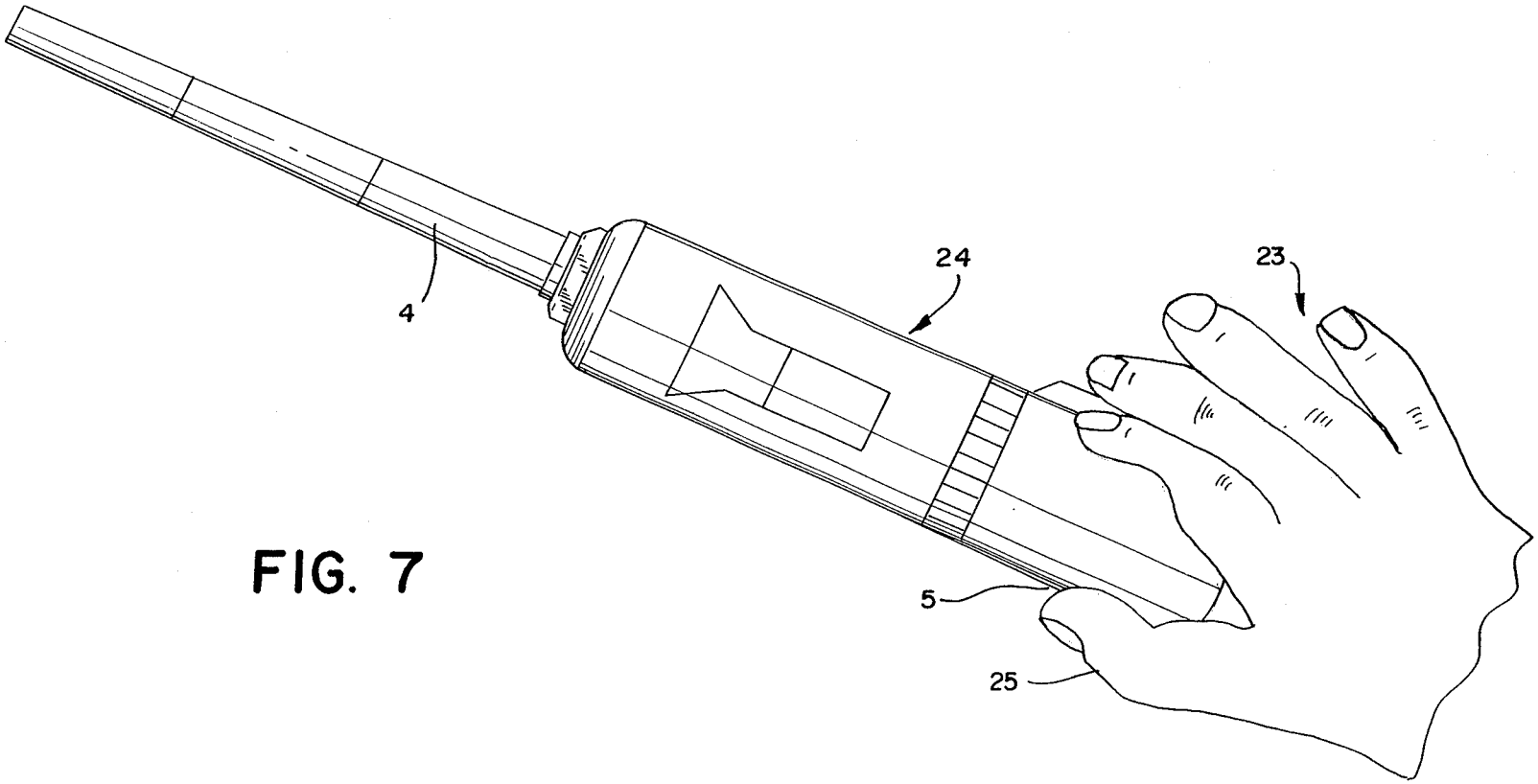
FIG. 7 is a pictorial description disclosing an angular perspective view of said transector device held by the user and positioned for firing.

FIG. 7 is a angular perspective view of the transector device held by the user and positioned for firing. Here the user's hand, number 23, is placed over the transector device, number 24, with the user's thumb, number 25, triggering the firing mechanism, number 5. Numerals 13, 14, and 15 disclose the portion where a power module is inserted, and enclosed charging port/power jack adapter means and a heat exhaust port.

Figure 8:
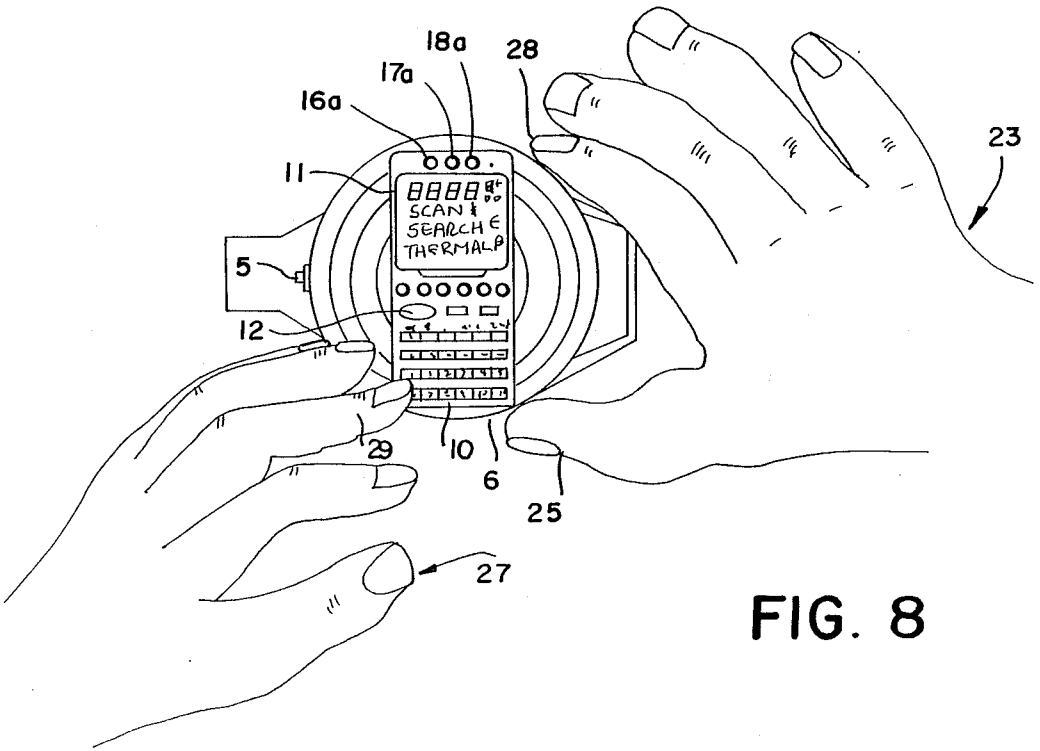
FIG. 8 is a pictorial description disclosing the aft control mechanism being programmed by the user.

FIG. 8 is a pictorial representation of the transector device being set by the user. The transector means, number 24, is held by hand 27, wherein selector means, number 6, is rotated into position by the thumb, numeral 25, and index finger, numeral 28 of hand 23. The device can be similarily set or programmed for one or more function by the keying of one or more separate key elements of pad 10, by anyone of the users fingers, or a stylus. Here the third finger of hand 27, designated by numeral 29 engages a single button element of the said pad, described previously by numeral 10.

FIGS. 9, 10 and 11 are angualr perspectives of the transector device which is presented in an illustrative manner to define the loading features for the projectile and volitile cassette means. Numerals 30*a*, 30*b* and 30*c* or FIG. 1*c* designates the region wherein projectiles cartridges are side loaded into a chamber of a revolving cylinder, which is then inserted into a chamber and the auto-magazine disengaged ready to lock into position by means 30*d*. Each magazine contains eighteen or more projectile cartridges, which are motivated into position by conventional spring action, functioning in a fashion consistant with the operation of conventional automatic or semi-automatic weapons. The said magazine, number 30, provides an additional means wherein projectile cartridges are replenished in either a single mode operation or rapid sequence firing mode. Number 30 describes a loading panel wherein a magazine or cassette of cylindrical cartridges containing volatiles and penetrator chemical substances, not shown, are side loaded into the transector device. Numerals 31, 32, 33 and 34 designate the radial locking means for unit 6, the power module means, heat exchanger elements and aspiration units delivering an electrical conducting spray to the aforementioned barrel.

Figure 12:
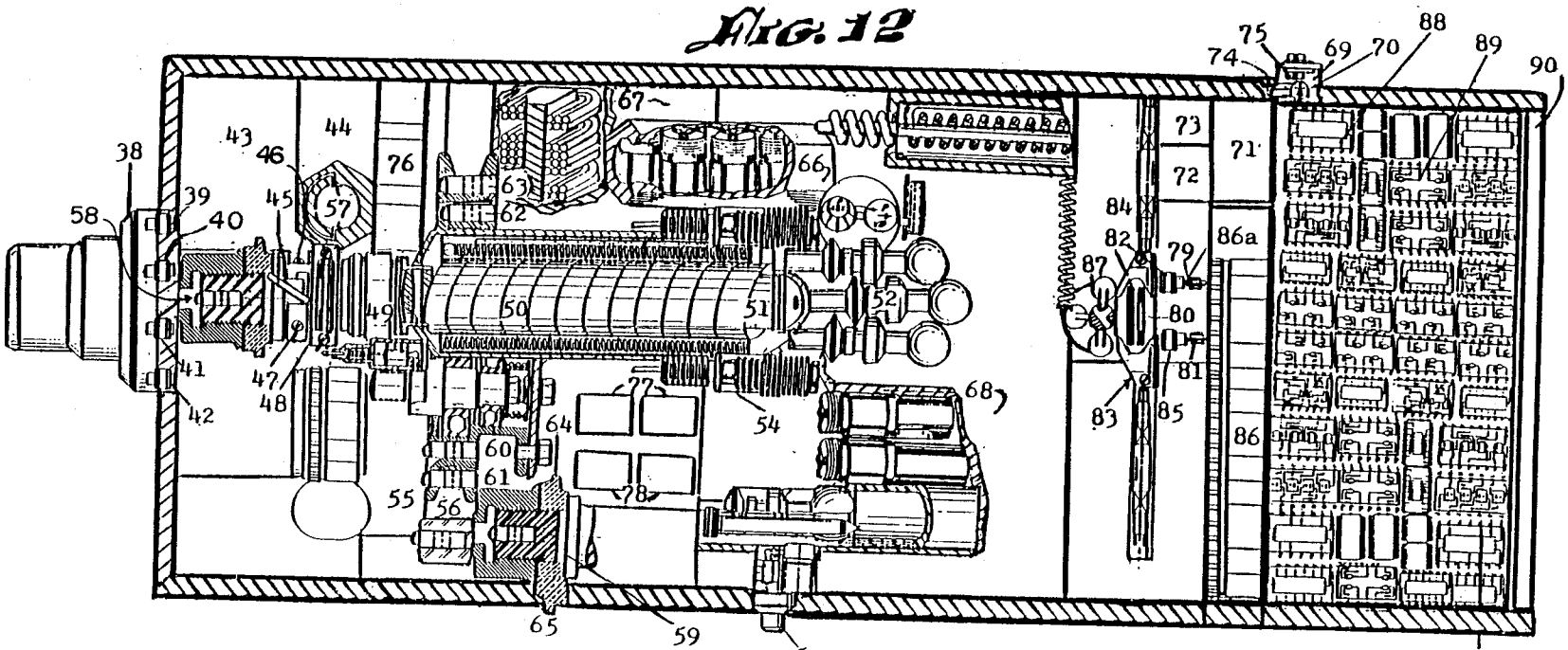
FIGS. 12 and 14 entails detailed sectioned views of the transector device revealing in part the internal disposition of operative systems.
Figure 13:
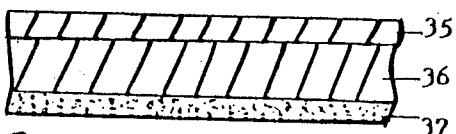
FIG. 13 is a section of the outer casing of the transector device.
Figure 14:
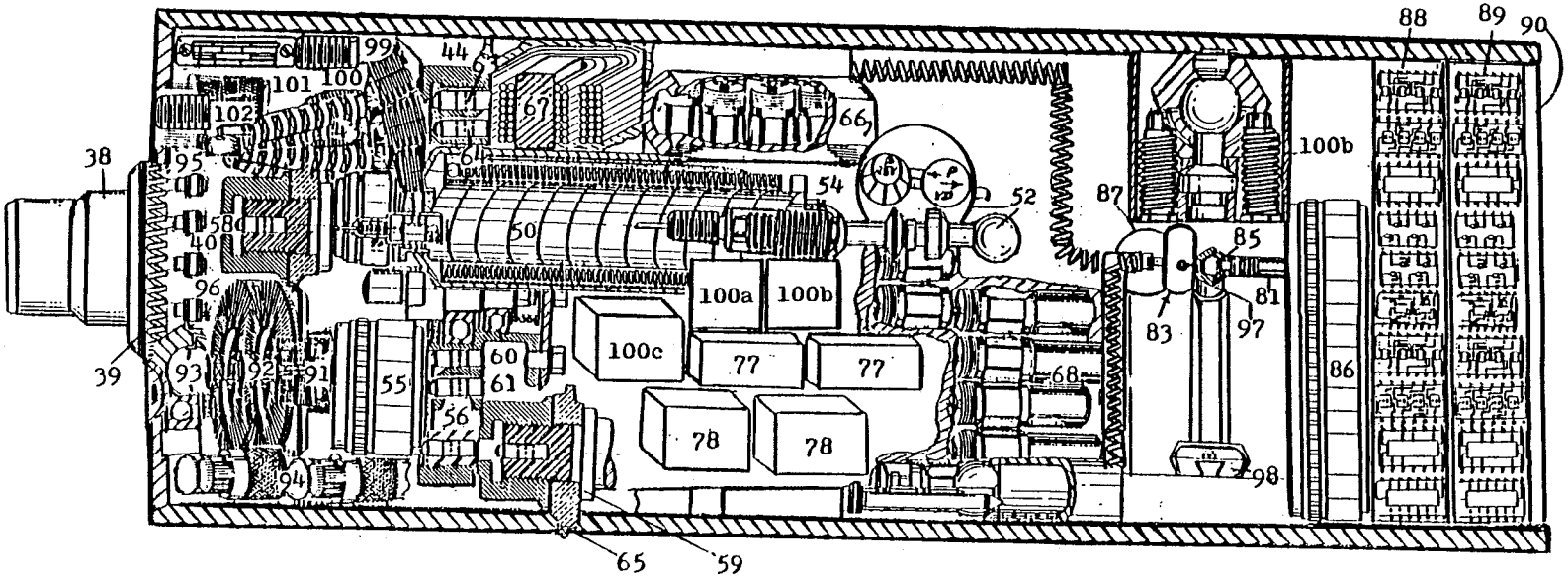

FIGS. 12 through 14 entail partially sectioned perspectives of the transector device revealing in part the internal disposition and/or compartmentalization of operative systems embodied within the said device.

FIG. 12 is a partial sectioned topographical view disclosing the internal configuration units encased in the upper most portion of the transector means. FIG. 13 discloses in part a cross-section of the casing for said device, as indicated by elements 35 36 and 37 said figure. Numerals 35 to 37 represents a case consisting of precision machined structural material which forms the inner hull preferably constructed from an alloy of chromium, titanium carbide stainless steel, a middle layer of an insulatory material preferable formed from a epoxylated composite material containing elastically bonded annealed layers, silicon nitride, and an outer layer of impact resistant water proof polyethylene, eurthane or some other suitable material. The transector device is hermetically sealed by a series of soft self sealing gasket means, not shown, which line, interlocks or compartments where cartridges, cassettes, or magazines are inserted or side loaded and cover or coat entire surface areas of electronic circuits, voltage generating means and other electronic structures disposed towards short circuit in the presence of water or other aqueous conducting mediums. The projecting barrel means, consisting of graduated insertable segments or tubular structures, number 38, is retracted. Numeric values 39, 40, 41 and 42 are assigned to the tubular coupling channel which is excluded from the central bore and circumferentially disposed around the barrel, two of four conducting channels acting as coduit means 40, 41, to transfer volitile complexes * from the mixing chamber, number 86, to the coupling means 39 and solenoid regulator unit 42, which governs the flow of volitiles from element 40, 41 into unit 39. Numerals 43, 44 designates portions of radiofrequency generator means providing ultra-high frequency voltage to the peripheral conducting portion of the segmented tubular structure elements, collectively assigned the value of barrel means 38. Numerals 45, 46 and 47 collectively form the folded optics, complex 48 consisting of three equivalent selectively emissive prismatic beam splitter means, respectively. Elements 49, 50, 51 and 52 describe, semi-emissive partially reflective mirror, a flash coil, a pulse ruby or plasma container means and gasifier means which automatically recharges expended plasma when needed to initiate lasing. Elements 49 through 52 form the resonant cavity, whereas radiofrequency exciters denoted by units 53, 54 provide the necessary excitation to increase the duration and power of the laser emission. Numeric vaules 55, 56 and 57 define a rotating chamber means in which projectile cartridges are selected from an automated selector means, which rotates the chamber means into position and an automated injector unit which loads the specified projectile cartridges into a separate firing chamber. The firing chamber, number 58 is a single explosive resistant cylindrical structure wherein each projectile means is dispersed. The operation and structure of the projectile system will be discussed in detail later on in the specifications. An external side loading chamber, number 59, allows the user to manually replace expended projectile cartridges into their respective orifices located in rotating means 55. Numeric values 60 through 63 define in part four of ten orifices or slots into which cartridges are placed into the said rotating means. Male prongs 64, 65 insert into their respective female slots of the magazine means, not shown, which locks into position, when the said magazine is inserted into position. Elements 66, 67 denotes a capacitor bank and transformer means which is utilized to generate high voltages. Numeral 68 is collectively assigned to a battery module means optimally consisting of a number of low voltage high amperage batteries connected in a series of preferably molten lithium types. The battery module unit, number 68, is rechargable from an automated jack means, number 69, which has incorporated within its structure a blocking diode, sensory device, spring loaded sealant means and deactivator element disclosed by elements 70 through 73. The blocking diode 70 prevents leakage ot voltage or discharge. The sensor device, number 71 actuates the jack receptacle means, number 69. The spring loaded sealant means consists of a simple spring loaded plunger, elements 74, 75 which effectively seal off the said jack means, 69, from moisture, or pressurized water until an ancillary power plug, not shown, is inserted into means 69. Units 76, 77 and 78 are ascribed to circuitry and switching elements associated with the laser target designation means. Elements 79, 81 and 82 of autoselector means 83 consist of two equivalent solenoid operated means utilized to engage reservoirs of volatiles and meditators located in cylindrical cartridges contained within cassette means 86, and a mixing chamber means 87, wherein the contents obtained from the cylindrical cartridges are combined within numeral 80 exiting from conduits 84, 85. The aforementioned cassette means, number 86, inserts into channel 86*a* and remains static, until removed from the said channel when the contents contained within the cylindrical cartridges is expended. The autoselector means 83 is automated to translate up and down, vertically and from side to side horizontally, to simultaneously engage or disengage cartridge pairs. A detailed description of the autoselectors structure and operation will be provided in FIG. 10 of the specifications. Numerals 88, 89 are assigned to two equivalent microcomputer means utilized to control, sequence and program functions of the transector device. The circuitry of each microcomputer unit is etched onto two equivalent insertable cards. One of the microcomputer means serves to operate the transector device; whereas the second microcomputer means functions as a back up system in the event the first microcomputer suffers a systems failure. Element 90 of FIG. 12 is assigned to the entire panel means aft of the transector device, whereas element 90a is assigned to the manual user based electronic circuitry means.

* Carrier mediated volatiles consists of concentrated liquified volatile gases formed under extreme pressure and coupled to penetrators such as, DMSO and chemical enhancers or actuator means.

FIG. 14 discloses a partially sectioned side elevation of the transector device. Numeric values 35 through 90 are equivalent to those numbers assigned to operative elements in the preceding FIG. 12. Number 91 is collectively assigned to the acoustical generator means which consists of a piezoelectric resonator, number 92, a parabolic focusing dish, element 93 is a complex of exciters and ancillary element, number 94. Three of four conducting channel elements 40, 95 and 96 are illustrated in FIG. 14 delivering substances from unit 87 to coupler means 39. Additional motivator means, 97, 98 assist the vertical and horizontal translation of means 83. The laser designator system is defined by numeral 100. Elements 99, 101 and 102 describe an array of fiber optics elements utilized for transmitting and receiving laser emissions, an array of sensors and a tunable laser source generator, respectively. Modular units 100a, 100b and 100c denote ancillary electronics means, secondary backup systems and additional energizer elements.

Figure 15:
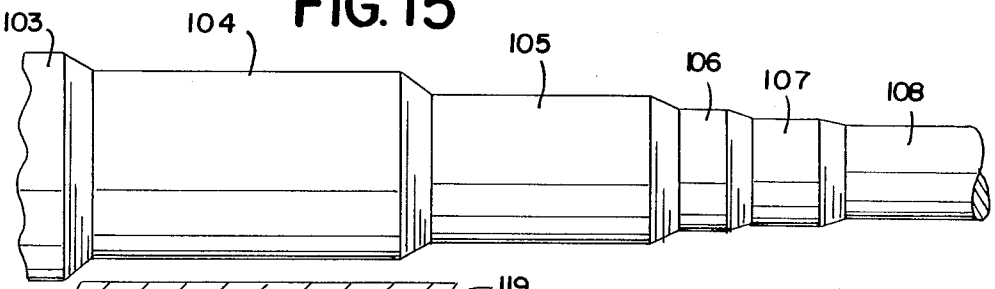
FIG. 15 is a side elevation of the segmented barrel structure of said device extended.

FIG. 15 describes detailed sectioned views of the retractable barrel means embodied within the transector device. The barrel of the transector unit is designed to execute four operative functions. The first operative function of the barrel structure is to conduct high frequency variable electric impulses down the tubular shaft of the said barrel. The conducted impulses have the capacity to either shock, stun, or induce localized paralysis in a specified assailant. A second operative function is to conduct and deliver ultra high frequency and radiofrequency impulses to an assailant, locally inducing small clusters of intense heat by means of thermoconvective agitation into specified surface regions of the said assailant temporarily causing intense pain. The heat generated within localized regions of the assailant is calculated to be noninjurious to the human organism. The third operative function of the barrel means is to project carrier mediated volatiles which are dispersed peripherally from the sintered portion of the said barrel structure. The fourth operative function of the barrel means is to provide an effective delivery means for a variety of projectiles when large numbers of assailants must be neutralized and subdued.

Figure 16:
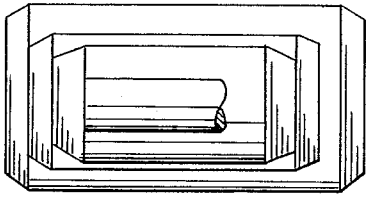
FIG. 16 is a side elevation of the aforesaid barrel means in the retracted position.

FIGS. 15, 16 disclose six side elevations describing six separate and distinct interlocking segments of the barrel structure for said transector device. FIG. 15 discloses said barrel extended; whereas the said barrel is retracted in FIG. 16. Tubular elements 103 through 108 designate six composite structures which are tapered or progressively graduated interlocking segments which collectively form the barrel means, number 4. The optimum length of the barrel unit is recommended to vary between one and one and a half meters and the thickness of each segment which ranges from 10.0 to 5.0 millimeters. Larger single element barrels were originally deployed, but were found to lack the utility and compactability of an equivalent barrel means which have a multiple segment configuration.

Figure 17:
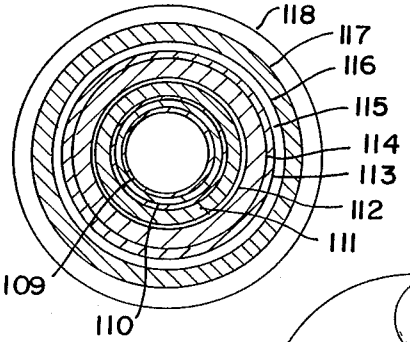
FIG. 17 is a partially sectioned perspective view of the front portion of the aforesaid barrel structure.

FIG. 17 discloses a partially sectioned view of the front portion of said barrel, as described by elements 109 through 118. Circular self sealing gaskets are circumferentially disposed around each tubular insert, 103 through 108, as indicated by numbers 109 through 118 with the exception of the terminal end of the barrel means 4, in order to prevent premature seepage of volatiles. Each sealing gasket structure is self lubricating and made of a suitable commerically available material which is resistant to corrosives, or cracking produced by fatigue and or wide variances in temperature.

Figure 18:
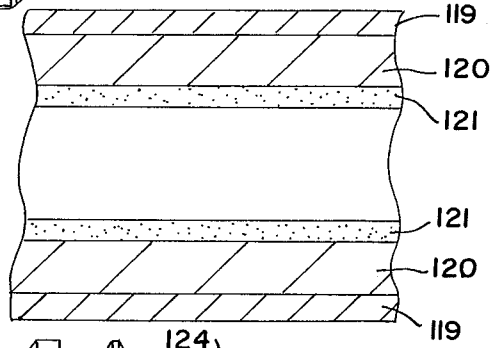
FIG. 18 is a partially sectioned portion of the tubular segment structure of said barrel means disclosing the trilayer configuration of said segment.

FIG. 18 is a cross-section of a segment. Numerals 119, 120 and 121 of an enlarged section, number 120, obtained from one of the six equivalent structures, numbers 109 to 116, gives a detailed description of the trilayer configuration of each said tubular segment. Numeral 119 consists of a hardened but resilient alloy of chromium, titanium stainless steel. Numeral 120 is indicative of a middle layer of sintered material rendered porous to the volatiles by etching and/or atomic bombardment processes, which are well known by those skilled in the art. Numeral 121 consists of a fracture and heat resistant non-conducting composite material preferably formed from a silicon nitride epoxylated ceramic material. Layers 119, 120 and 121 are bonded to one another in a conventional manner.

Figure 20:
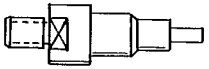
FIG. 20 is a side elevation of a single motivator element.
Figure 19:
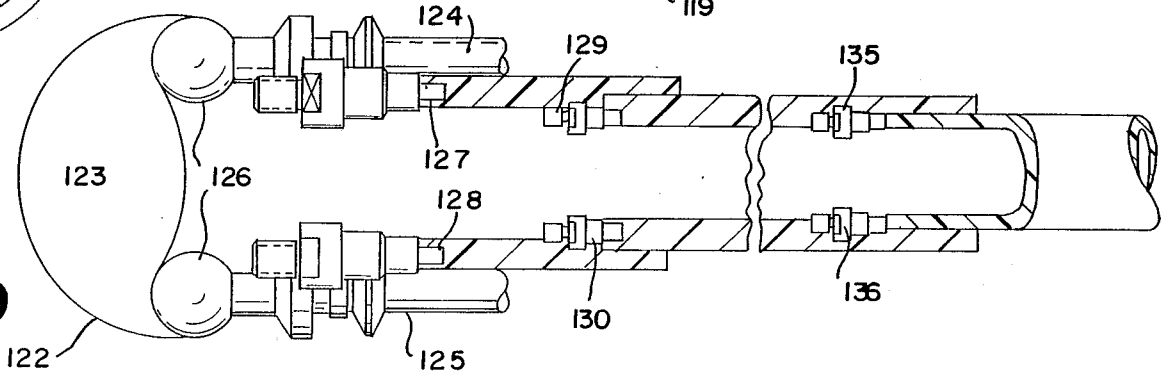
FIG. 19 is a detailed cross-sectioned view of the aforesaid barrel structure describing in part motivator means and ancillary elements.

FIG. 19 is a sectioned view of the barrel and ancillary means. Mechanism 122 is a serviceable reservoir means which is filled with a conducting non-viscous lubricant, number 123, which coats the segments when they are projected from a retracted state. The circular flow 124, 125 channels are provided with a circular release mechanism 126, which aspirates the contents of the reservoir onto the outer surface of the tubular structure means, as described previously by numbers 103 through 108. The projection of the aforementioned tubular barrel means defined by segments 103 to 108 is provided by either one of three mechanisms. The first mechanism initiating projection of the segments is provided by the initial pressure build up caused as the mixture of volitiles expands through the sintered material. The second mechanism for projection of the barrel means consists of the trigger release of a tension spring means which provides the necessary force to kick the segments of the barrel forward. A third release mechanism providing forward motion of the barrel structure as disclosed by FIG. 20 consists of the programmed actuation of solenoid means 127 to 136 by sliding each segment forward and ahead of the preceding segment. The tubular array has tubular interlocking means disclosed by elements 137 through 146, which under prescribed conditions locks each of the said barrel segments into position until disengaged by the user. The barrel means can also be extended or retracted manually by the user, under prescribed conditions. * Numeral 147 is assigned to the headon barrel means, 21.

* The barrel is preferably maintained in the uncharged condition unless specified otherwise.

Figure 21:
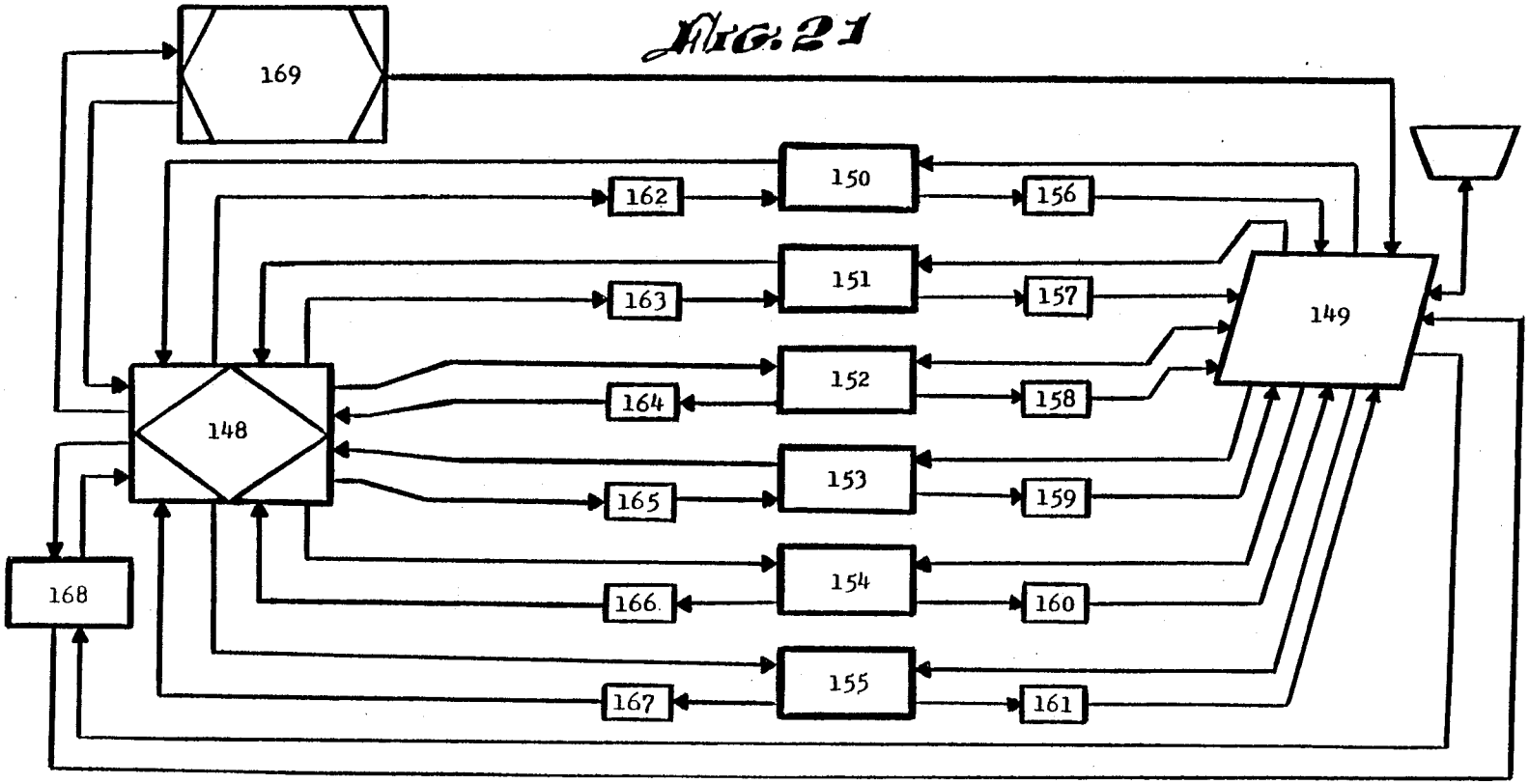
FIGS. 21 through 25 are simplified block diagrams with the number and types of operative systems embodied within the transector device and the way in which each said system interacts with every other system.

FIG. 21 is a simplified block diagram with the number and types of operative systems embodied within the transector device and the way in which each said system interacts with everyother system. Schematically illustrated the transector device has two control centers the microcomputer means as defined by number 148 and the user manually keying means, number 149, which consists of the keyboard pad and rotating selector switch means. Numerals 150, 151 and 152 designates the high voltage delivery means, the radiofrequency generator means and acoustical generator unit. Numbers 153, 154 and 155 are assigned to the laser emission means, the volitile dispersal system and projectile delivery means. Each operative system elements 150 through 155 have embodied within its operative framework a sensor based feedback loop which is represented by numeric values 156 through 167, respectively. Elements 156 through 161 are equivalent to elements 162 through 167 with the exception that the former sensory feedback loops feed into the microcomputer element 148; whereas the later sensory feedback loop means exclusively serves the users based secondary electronics level, as defined by unit 149. The laser target designating system provided identification, ranging and tracking of targets is indicated by unit 168. Element 168 provides digitized computable data to path the microcomputer, 148, and the users electronic subsystem, 149, the array of diodes and LCD/LED means incorporated within the panel of the transector device. The vital signs of one or more given assailants are measured by an array of sensory contained within a feedback loop, element 169, and the said values are sent to the microcomputer, 148, for comparisions and analysis and to the users based electronic system, 149, for display. The microcomputer 148 will automatically and continuously reset the operative parameters ranging from the voltage and/or current delivered to an individual, or the concentration of volitiles dispersed to one or more individuals over a specified interval of time so that the maximium tolerance levels of the targeted individuals are not exceeded, preventing excessive injury or death to the said targeted individuals.

Figure 22:
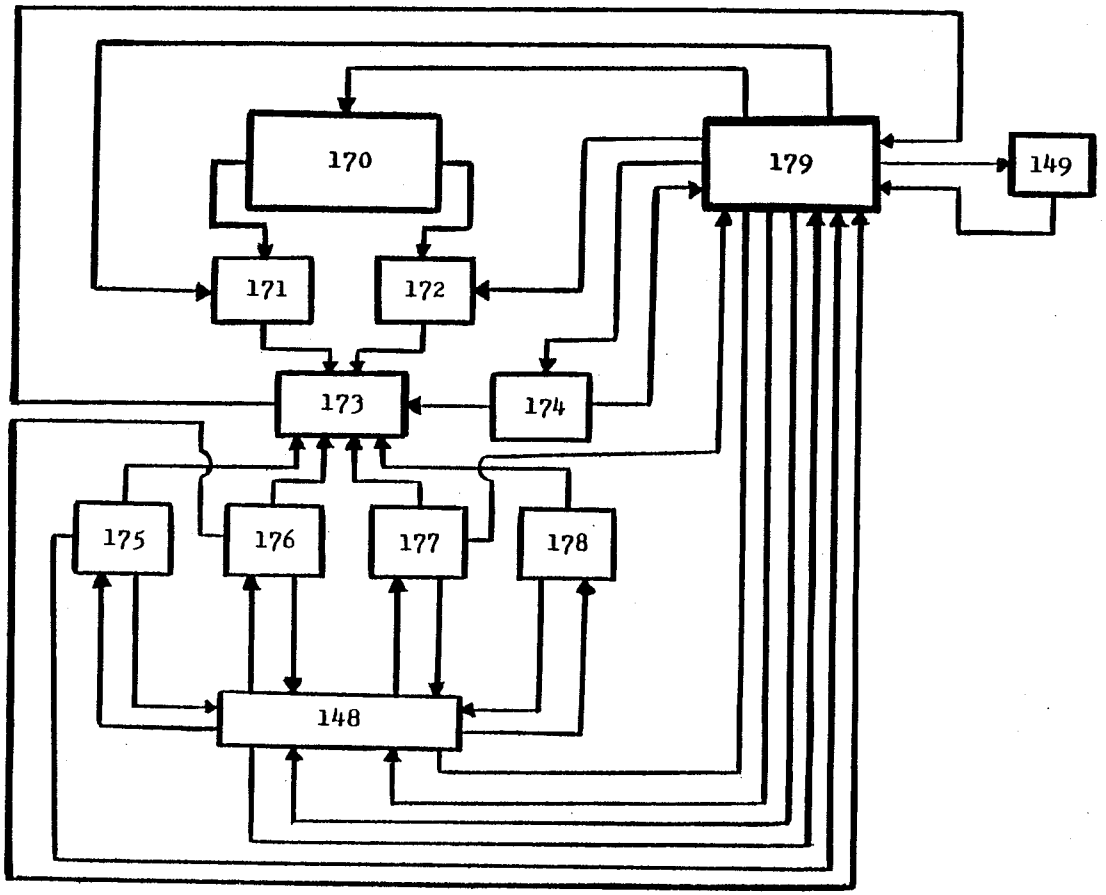

FIG. 22 schematically describes in a more detailed block diagram the operation of the electrical radiofrequency generating system. The power, pulse characteristics, frequency and duration of the electrical discharge and or radiofrequency emissions are set automatically by the microcomputer, number 148 or bypassed by the user, 149. The voltage and ampers are regulated by generator means 170, which adjusts the current delivered to radiofrequency generator 171, and the high frequency voltage generator means 172, respectively. The radiofrequency emissions and/or the high voltage signals are conducted to the barrel means 173, in which they are propagated from in order to engage the targeted individual. Additionally provided is a mechanism, number 174, which delivers an aerosol spray circumferentially along the length of barrel 173, which it coats with a self lubricating electrical conducting medium. An array of sensory apparatuses consisting of laser diodes, piezoelectric means, electronic capacitance system and fiber optics coupled electronic devices which are disclosed by numeric values 175, 176, 177 and 178, respectively; monitors vital signs of the targeted individual. User based data in the form of priority signals are conveyed from means 148 to an electronic substation means 179; wherein the appropriate electronic signals are conveyed to units 170, 171 and 172, respectively.

Figure 23:
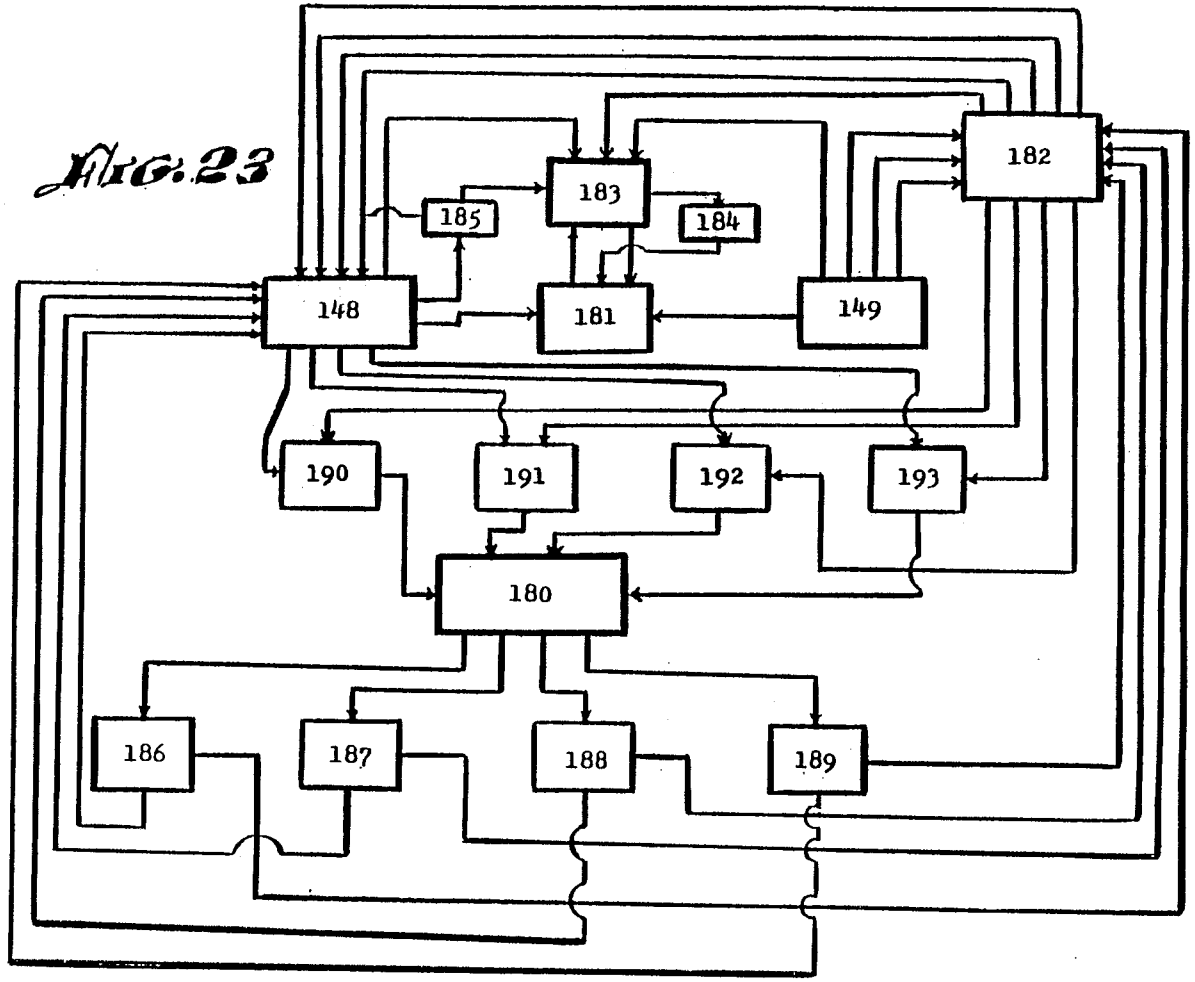

FIG. 23 is a more detailed block diagram indicating schematically the operative subsystems of the laser emission source. The intensity, frequency and duration of the laser pulse is regulated from two command sources, a microcomputer means number 148 and a user keying means defined by number 149. Laser means, 180, may be either a synthetic ruby crystal type, a plasma tube type or a chemical laser, or some other suitable laser beam generator, or some other combination of laser means. The laser source is non-lethal, generating a temporary blinding light, momentarily immobilizing one or more targeted individuals. The laser is powered by energy source 181 and is controlled manually through electronic subsystem 182 and pulse generating means 183, which engages the governor or controller means 184 of said power source 181. The power source can be automatically regulated by electronic signals conveyed from microcomputer unit 148 to power source 181 through means 185. The internal operative status of the laser source generator means 180 is monitored by an array of internally based sensors, described by units 186 through 189. Thermal conditions of the laser are monitored by sensor means 186. Power output is assessed by sensor means 187. The internal pressure of plasma or chemicals when such laser units are employed and are indicated by element 188. The internal charge within the resonant cavity is calibrated by unit 189. The information generated by sensor means 186 through 189 are conveyed to electronic subsystem, 182 which relays the data for display to unit 149 and or to the microcomputer means 148. Compensatory command signals from microcomputer 148 are based on the information retrieved from sensors 186 through 189 or unit 182. If the laser means is overheating, then signals are sent to the closed system coolant means, 190. If the plasma pressure level in the plasma jacket is appreciably low or the chemicals needed to produce lasing in a chemical laser are deficient, then the appropriate signals are generated by microcomputer means 148 to release the contents of one or more recharging reservoirs designated by element 191. Output of the laser means can be adjusted by appropriate signals sent from means 148 to radiofrequency generators 192 and/or voltage regulator unit 193, which would power a flash coil and/or other means if synthetic ruby element, or other suitable means to increase lasing were deployed in the transector device. The microcomputer means 148 may be replaced by the sequence of keyed commands initiated by the user from element 149.

Figure 24:
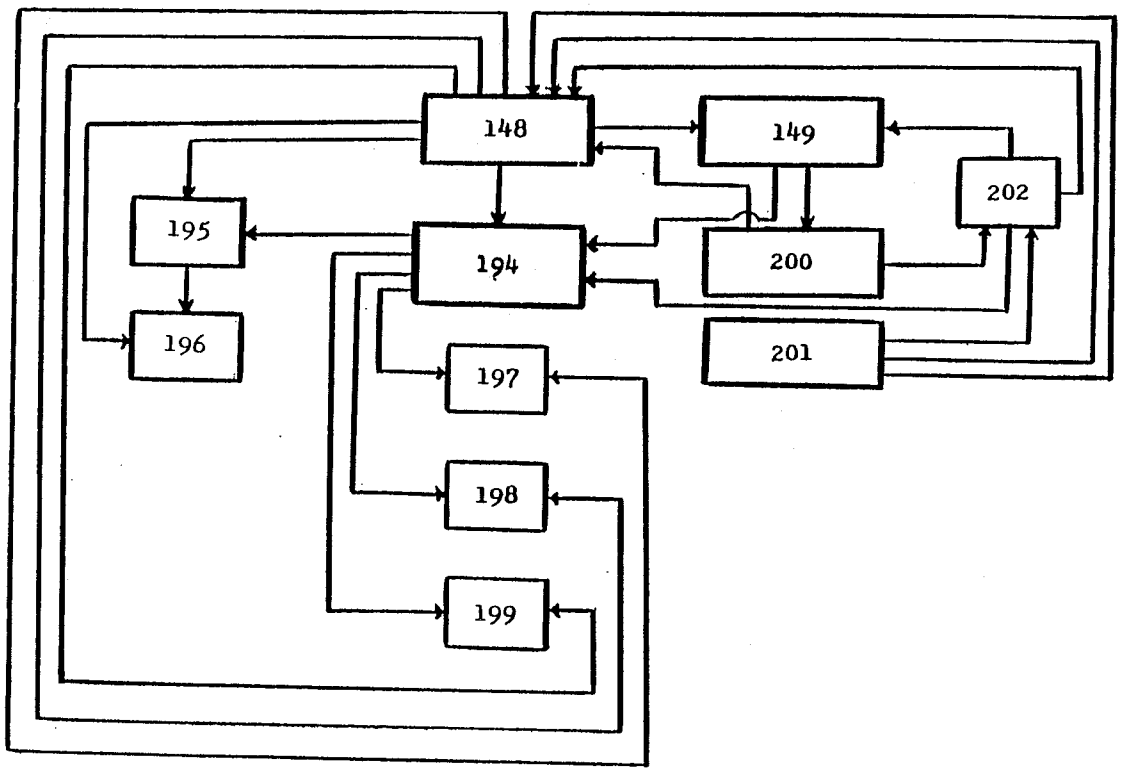

FIG. 24 is a detailed block diagram schematically describing the interaction of subsystems contained within the operative framework of the volatile dispersal unit. The operation of the volatile dispersal unit can be ideally keyed from microcomputer means 148 or manually keyed from unit 149. Cartridges containing volatiles and chemical mediators are contained in a magazine means, not shown, which are selected from by position selector means 194; which is motivated to engage a pair of cylindrical cartridges and to convey the content therein to a mixing chamber 195, which delivers the said contents to a dispersal coupler means 196. The location of the position selector unit, 194, is controlled by vertical translator means, 197, horizontal translator means 198 and solenoid injector/retractor means 199. Feedback from position sensors 200 and pressure sensors 201 provide the user 149 and the microcomputer 148 with data concerning the types of volatiles delivered or to undergo dispersal and the volume to be dispersed or the amount of volatiles and mediators, which are being dispersed from each cylindrical cartridge pairs. Numeral 202, an automated manual override means provides a fail-safe mechanism in the event of a systems failure, wherein damage to circuitry is incurred, or if the position selector jams, or if the cylindrical cartridges rupture.

Figure 25:
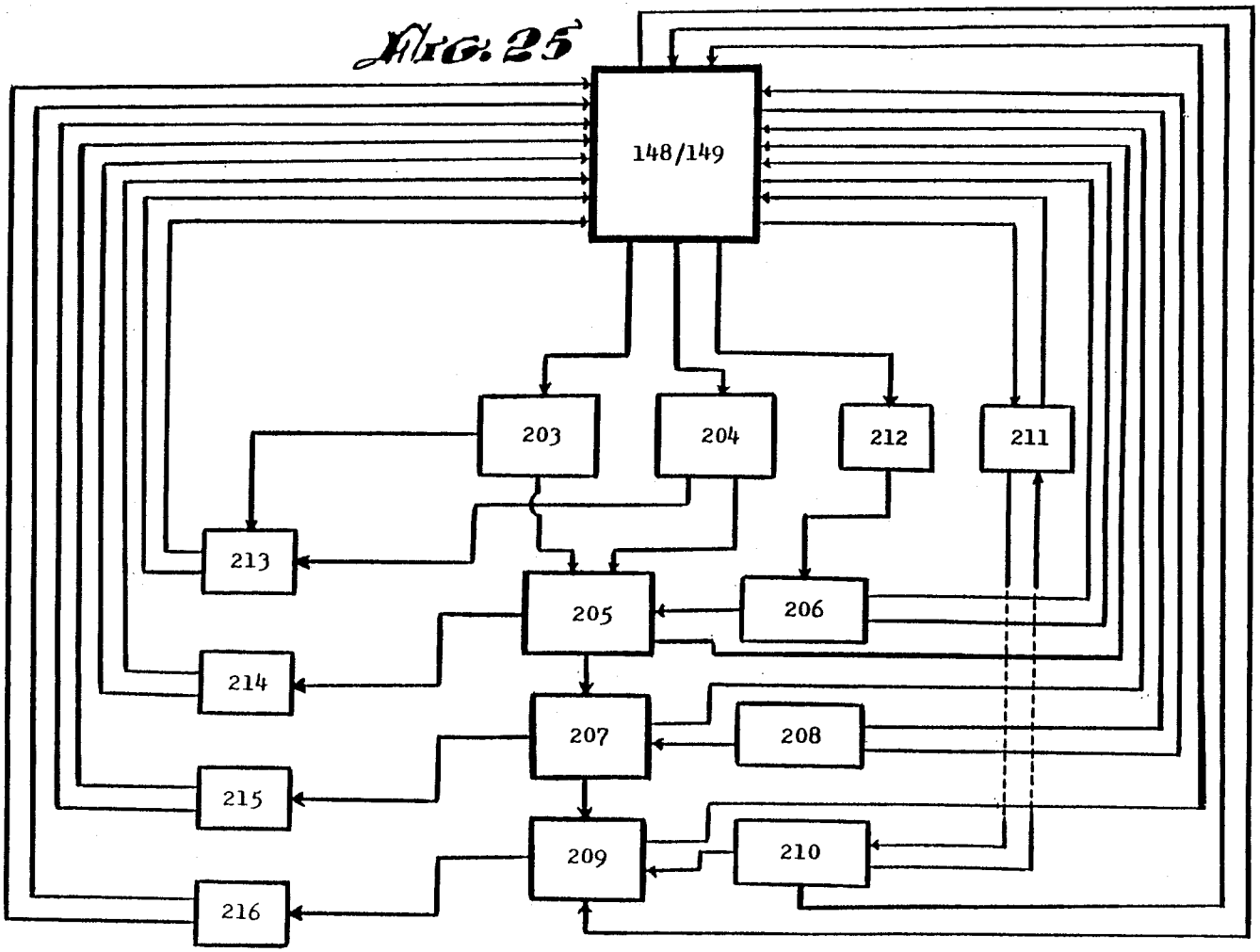

FIG. 25 is a detailed block diagram schematically illustrating the operation of the projectile firing system. The operation of systems operative systems contained within the projectile firing system is controlled and/or mediated by either microcomputer 148 or the user via element 149. Projectiles are loaded in the form of cartridges which are supplied either in relatively large numbers by a magazine, described by element 203, or side loaded individually by placing individual cartridges into the transector device designated by element 204. Projectile cartridges are inserted into a revolving chamber, number 205, wherein ten or more cartridges are positioned in a circular array. Each type of projectile is selected for or based on what is programmed by either the microcomputer means 148 and/or the user defined by number 149. Each different projectile cartridge type is coded with a specific diffraction holograph wherein laser sensor means 212 reads the holograph and provides data signals to motivate autoposition selector, number 206, to rotate the revolving chamber means 205 into position. The position of cartridges being loaded into the chamber from elements 203, 204 is monitored sensor means 213 and the position of the revolving chamber is provided by sensor means 214. Numeral 208 defines the autoinjector means which inserts the selected cartridge means into the autoload projectile slot, means 207. Sensor element 215 indicates whethter or not a projectile cartridge has been droped into an appropriate slot. The specified projectile cartridge drops from slot means 207 into firing chamber 209. Sensor means 216 monitors whether or not a projectile cartridge has been loaded into firing chamber 209, wherein the projectile is eventually propelled. The chamber, 205, is rotated prior to firing of the said projectile means, by element 210. Element 210 is an electronic ignition means which when actuated delivers an electronic signal to the projectile cartridge, allowing it to be discharged from the firing chamber element 209 into the central bore of barrel means 4; whereby the said projectile exits the transector device. The operation of the electronic ignition is monitored by circuit sensor means 211. The array of sensory elements 211 through 216 provides information both to the microcomputer means 148 and to the user 149 in the form of an LCD/LED display and/or a voice synthesizer means.

Figure 26:
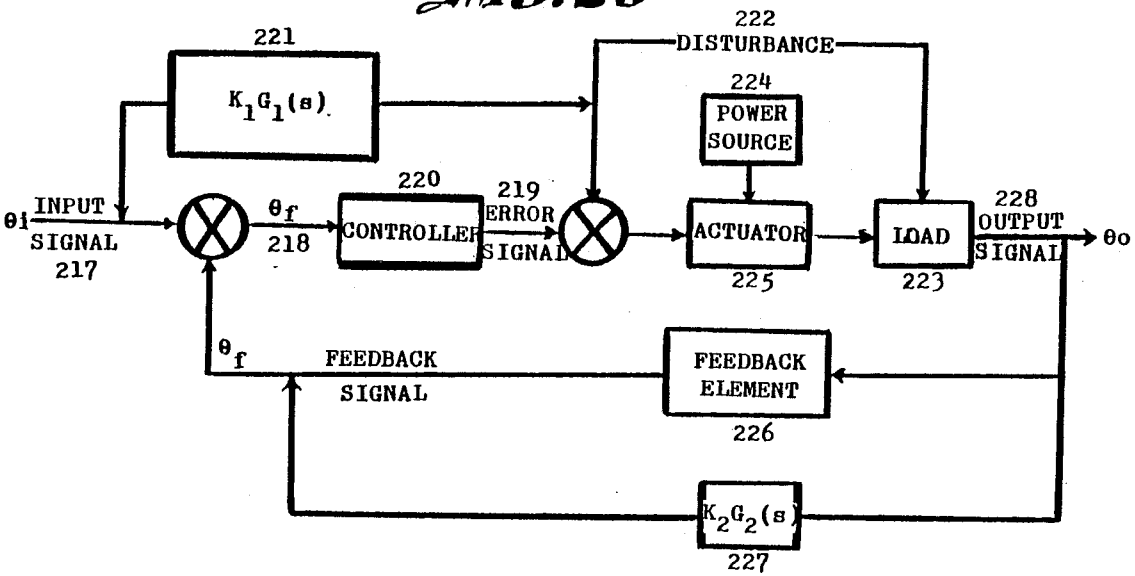
FIG. 26 is a diagrammatic representation of one of several equivalent feedback loops utilized to monitor and adjust the frequency, intensity and duration of functions as not to exceed the biological tolerence levels of the designated individual.

FIG. 26 is a diagrammatic representation of one of several equivalent feedback loops utilized to monitor, and adjust the frequency, intensity and duration of functions in a specific manner so that the biological tolerance levels of a given targeted individual are not exceeded in order to avoid undue injury or death to the said individual. Physiological readings are obtained from the designated individuals by systolic measurments taken by laser doppler means, acoustical measurments of cardiac and respiratory output, electrical measurments of GSR and ECG which are conducted back through the barrel of the transector device and other ancillary operations utilized to assess the designated individuals vital signs. Further, embodied within the operative framework of the feedback loop are a number of automated compensatory mechanism which alter the operative function of the transector unit continuously over the course of the said devices operation. Said function consist of, for example, a electrical charge administered to a designated individual, the intensity of the electrical current conducted by the charge, the frequency and duration of the charge delivered by the transector device. Electrical charge, radiofrequency emission and the dispersal of carrier mediated volitiles are operative functions of the transector device. The intensity, frequency, duration and other parameters of operative functions such as, chemical concentration or activity in the case of dispersed volatiles are continuously regulated based on data retrieved from sensors. Sensors are located in the most forward position of the transector device. Vital signs which are electrophysiologically based and are conducted through the barrel means of the said device during a non-electrical or radiofrequency emitting mode are frequently monitored and continuously updated.

The input signal $\theta$, is received by sensory means, 217, which conveys the signal to error detector element 218 for comparision. The error detection element 218 consists of an array of comparator and interrogator circuits, not shown, which compares the incoming signals $\theta$; with digitized values stored in the units memory. If the values of the incoming signals exceed those physiological norms construed to be the targeted individuals maximum, then an error signal is generated, as defined by number 219 and the symbol $\theta E$; wherein the generated signal is sent to the controller means 220, as is the forward transfer function defined by numeral 221. The controller means is associated with various internal operations which act in a prescribed compensatory manner to offset any discrepancies with an appropriate action, that occurs within the operative framework of the given feedback loop. Values are adjusted whether the action is to lower or raise the intensity of an electrical discharge, radiofrequency emission, or the concentration of volitiles dispersed, the duration of time each of which is administered and/or the frequency or sequence of each counter measure which is delivered to the designated or targeted individual. The effects of the output is being continuously monitored and the output undergoes frequent readjustment based on the influx of data. Disturbances, numeral 222, are registered and effect the load element, 223. A power source, element 224 effects acturator means, number 225, which also acts as a forcing function on load means 223. Current status retrieved from other sensory means, as defined collectively by feedback element 226 and a secondary transfer function, number 227, jointly provide a feedback signal which is reassessed against error detector means 219, as it re-enters the loop as either a negative or positive transfer function. The intensity, frequency, duration, concentration and the like are all parameters which may be immediately modified, numerous times, by the operation of the feedback loop. The output signal $\theta o$, 228, modifies and regulates the aforementioned parmeters. Further contained herein below are a series of standard simplified equations which describe the feedback loop for a control system having transferred functions which are listed in part herein below:

The forward transfer function is defined by the expression:

$$\frac{\theta o(s)}{O\epsilon(s)} = K_1 G_1(s)$$

The forward transfer function $K_2G_2(s)$ is defined by the equation:

$$\frac{\theta f(s)}{\theta\Theta(s)} = K_2G_2(s)$$

The open loop transfer function, the product of the forward and feedback transfer function is defined by the expression:

$$\frac{\theta_f(s)}{\theta\epsilon(s)} = K_1K_2G_1(s)\ G_2(s).$$

The error transfer function is designated by the expression:

$$\frac{\theta\epsilon\ (s)}{\theta_f(s)} = \frac{1}{1 + K_1K_2G_1(s)\ G_2(s)}.$$

Figure 27:
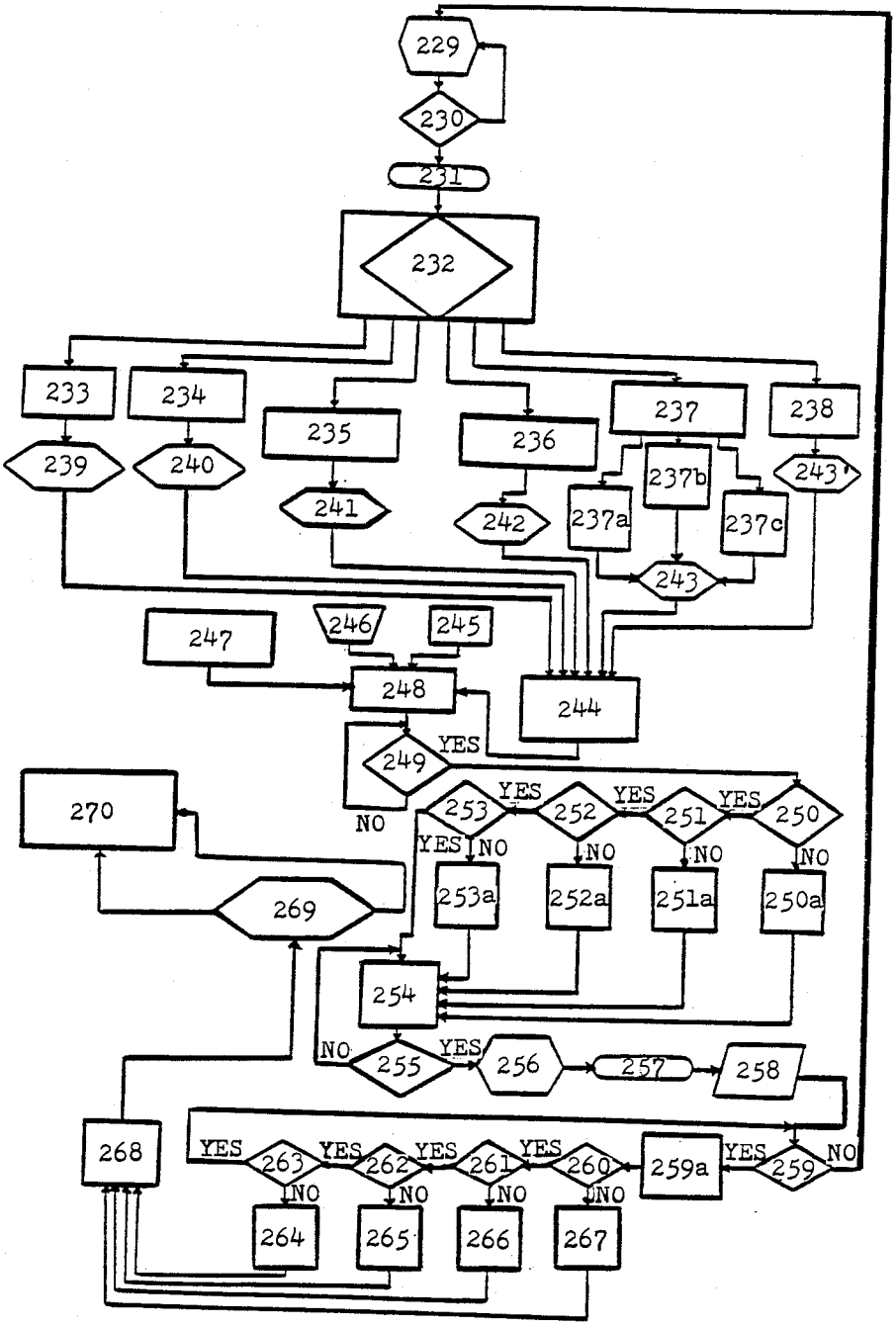
FIG. 27 is a flow chart for a program for processing input information derived from sensors to alter emissive parameters of the transector device so that the designated individuals biological limits are not exceeded.

FIG. 27 is a flow chart for a program for processing input information derived from sensors to alter the emissive parameters of the transector device in such a manner that the output of the said device does not exceed the biological limits of the designated individual. The biological norms are established based on a statisical analysis of established human values obtained in a population. The variance due to size, weight and sex are adjusted for in the program as well as variances in emotional conditions alluding to agitation of the designated individual. The programs are additionally constructed as to make certain allowances in the process of subduing dangerous individuals who for some reason are under the influence of alcohol or medications, or psychometrics (amphetamines, barbiturate, hypnotics, P.C.T., and/or other pharmacologicals) do to the incorporation of an expert system within the programming of the transector device. The targeted individuals are initially identified and tracked, as indicated by process 229, prior to being engaged as indicated by numeral 230. If the targeted individuals have or are being engaged, 230, then the program is actuated, as indicated by start sequence 231, or else the system will return to identify and further track the designated individuals, number 229. Usually when the target designate moves beyond the effective range of the device, or is obscurred from sensory process 229, which must be re-enlisted. Once the program has been actuated, 231, program selection is enlisted from a repetorie of appropriate counter measures consisting essentially of six catagories identified numerically by 001, 010, 011, 100, 101, 110 and the classes contained within each of the said catagories are collectively designated by number 232. The catagories of programmed functions are identified by elements 233 through 238. Numeral 233 identifies a subprogram catagory which delivers high voltage electrical shocks locally discharged are implemented to temporarily induce partial local muscular contraction and/or paralysis, or to effect other means in order to neutralize a designated individual. The subprogram governing the projection of radiofrequency emissions in order to induce localized hyperthermia in specific regions of an individual is expressed by element 234. Numeral 235 defines a subprogram catagory involving the projection of narrow beam acoustical emissions producing a temporary deafening sound inhibiting verbal or auditory cues in designated individuals. Numeral 236 is indicative of a subprogram controlling the parameter of an intense flash of laser light temporarily blinding one or more designated individuals depriving them of visual cues. Element 237 illustrates a subprogram specifying the dispersal of carrier mediated volitiles. Elements **237*a*, 237*b* and 237*c* define subcatagories or subprograms governing different classes of volitiles to be dispersed to carrier mediated volitiles producing states of anesthesia leading to drowsiness or sleep, which is described by number 237*a*. Number 237*b* designates a class of volitile antabuses inducing states of nausea and confusion in targeted individuals. Numeral 237*c* denotes a subprogram governing the dispersal of cryogenic agents utilized to induce rapid chilling or freezing in localized regions inducing a form of hyopthermia in the said specified regions of the designated individuals. Numeral 238 is assigned to a subprogram specifying the launching of projectiles when the number target designates are greater than 10 and range from 50 to in excess of 200 meters from the body of the transector device. The initial parameters of a single function such as intensity, frequency, duration, concentration and/or dispersal patterns are regulated by scanning circuitry; which additionally provides sequencing and timing of one or more given functions generated by the transector device, as indicated by six equivalent processes assigned the values 239 through 243, respectively. Additional circuitry to monitor the output of each function, calibration and internal operations conducted within each operative system are provided by operative means 244. After the first counter measure is instituted, an array of sensors effectively calculate the designated individuals physiological parameters currently updating status regarding vital signs, as indicated by number 245. Information is additionally provided concerning data retrieved from sensory apparatuses which had measured physiological parameters of designated individuals prior to administration of one or more functions of the transector device to the said individuals, which is illustrated by number 246. Data entering from system 245, 246 are compiled, collated and compared with digitized signals retrieved from memory chips contained within the global memory system of the device, as indicated by the statistical format contained within element 247. The statistical values are based on physiological norms taken from mean averages of population studies. The deployment of a global memory system within the contexts of one or more expert systems will be discussed further in the specifications. The programming of element 247 allows the device to assess the average weight, sex, and physiological condition of designated individuals. Various traces of drug residue can be monitored by means of laser spectrostrophy of chemical species formed in the perspiration which will be disclosed in reference material and later on in the specifications. The values compared against statistical norms by interrogator circuits indicated by element 248 and if the value does not exceed those construed to be life threatening, then the program is channeled for display and eventually termination, provided the designated individual or individuals are neutralized. Elements 249 through 253** define values such as, systolic output provided by laser means, measurements of respiratory function conveyed by piezoelectric sensors, body temperature derived from infrared sensors and spectrophotometric analyses of chemical species in the perspiration of the targeted individuals, respectively. * The values which deviate from the norm are displayed as are those which correspond to various established norms. The data from elements **250*a* through 253*a* are conveyed collectively to compiler means 254; wherein the overall status of designated individuals are determined. A decision upon whether or not designated individuals are neutralized in conducted by element 255**. If the designated individuals are neutralized, then the program procedes towards termination as indicated by the process described by number 256. The internal systems and functions residing in the systems therein are placed on standby, as illustrated by number 258, until one or more targeted individuals are assigned by the user, 257. If however, the targeted or designated individuals are not neutralized an additional numeric cycle is provided, as indicated by number 259, which automatically re-engages process 229. If values of systolic respiratory function, basal metabolism, body temperature or other vital functions sufficiently disturbed are indicated by decision processes 260 through 263. The values pertaining to the disturbance of vital signs are assessed on a priority basis by elements 264 through 267, which collectively input into means 268; wherein the program acts in a compensatory manner to effect alterations in the parameters of various programmable functions of the transector device. Means 268 initiates a series of reduction processes which alters or reduces the output of such parameters as, intensity, frequency and duration of generated emissions and/or the concentration or chemical composition of volitiles and the like in the form of signals; which directly effect element 232 and the properties of 001 to 110 contained therein. Numeral 268 contains within its embodiment a multivariant feedback loop which asserts the capacity of the program to undergo program modification in order to make the necessary adjustments in given parameters of specific functions, an exemplary form in which a program is modified and is illustrated by number 269. Additionally, you have programs acting on programs during the operation of transector device, which is indicated in part by number 270. Numerals 269, 270 are only simplified generalizations of a number of processes taking place and therefore should only be taken in an illustrative manner rather than in a restrictive or limited sense.

* Rosenberg laser spectrophotometric analyses patent Ser. No. 4,589,078.

Figure 28:
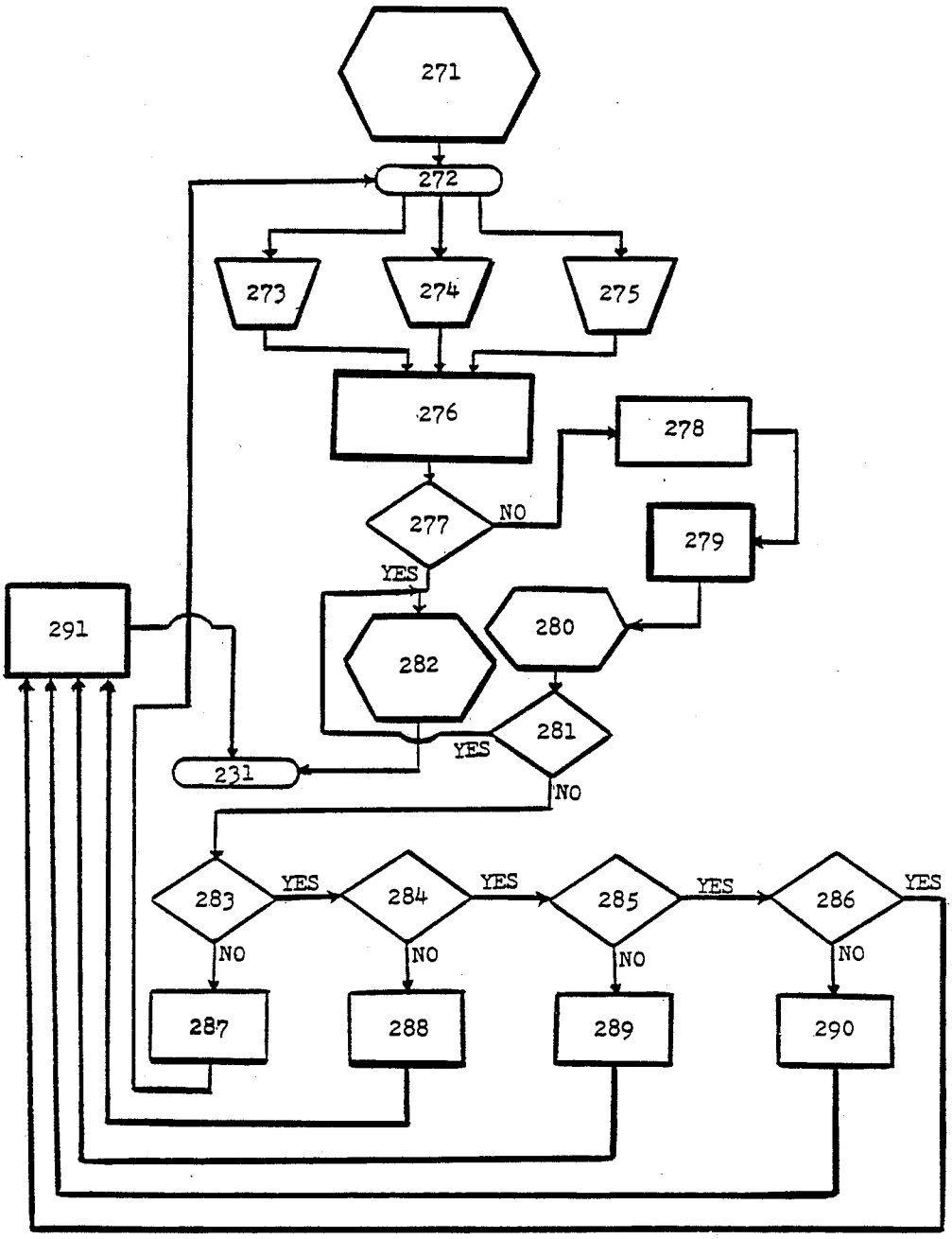
FIG. 28 is a flow chart for a program for processing data received from sensors providing for target designation, target pursuit or tracking and engagement of the designated target.

FIG. 28 is a flow chart for a program for processing data received for target designation, target pursuit or tracking and engagement of the designated target. The user first sites targeted individuals and points the transector device at the said individuals and then actuates an autokeying sequence, which is indicated by numeral 271. The autokey sequence actuates the laser designator means, disclosed by numeral 272. Once the laser designator is activated an array of sensors and circuitry computes the range, speed and movement or motion pattern of the targeted individuals, as described by numerals 273, 274 and 275, respectively. Data derived from sensors is accumulated, collated and transferred to higher order computational circuits, as indicated by numeral 276. Decision process 277 determines whether or not a target is illuminated. If the targeted or designated individual is not illuminated by the laser emissive source then a process wherein the return laser beam source is scanned for power, wavelength and effects are instituted whereby the wavelength is tuned appropriately, as indicated by numbers 279, 280. If the target is illuminated by a laser signal monitored by sensors, as defined by number 281, then the range, speed and pattern of flight is computed by process 282 to the exclusion of other individuals and targets and each of the designated targets are assigned the appropriate matrix number and motion vectors. Once process 286 has identified the target the transector means is locked onto the said target and ready to begin the neutralization process, as defined initially by start sequence 231. If however, the target is not verifiable, then data which is returned to sensors are interrogated by elements 283 through 286. If the target is illuminated, then the decision element 283 moves to 284; and if not the data is returned via means 287 to the start number 272 for reprocessing of data. Element 284 determines whether or not the range is computable and if it is then the process is advanced to element 285; if not the data is recalibrated against the targets last known position, as indicated by number 288. Element 285 determines whether or not the pattern of movement is generated by the designated individuals. If the pattern of motion of the targeted individuals are computable, then decision process 286 is engaged; wherein a measure of the targeted individuals vital sign are measured. If the pattern of motion of the targeted individual can not be determined, then the pursuit trajectory is recalculated based on last known position or probalistic patterns of evasive action, as determined by numeric means 289. If the vital signs of the targeted individuals are computable, as indicated by decision element 286, then the confirmed data is transferred from elements 283 to 286 to compiler means 291; wherein new values of range, speed and pattern behavior is computed, evaluated and confirmed. If the vital signs of said individuals can not be determined by element 286, then ancillary sensors are actuated, as indicated by number 290. The data derived from elements 288, 289 and 290 are collectively sent to means 291 for collation, cross-referencing and conformation of the targeted individuals range, speed and pattern of motion. The data from 291 is like that of 282 channeled to actuate the start sequence 231, wherein appropriate behavior to neutralized designated targets is computed and then inacted by the laser based transector device.

FIGS. 29 through 45 are partially sectioned perspective views of the loading assembly rotating cylinder unit and selector injector means. The types, quantities and effective range of projectiles loaded and fired from the barrel of the transector device which is ultimately controlled by the operation of the selector injection means in conjunction with the rotating element and loading assembly means.

Figure 31:
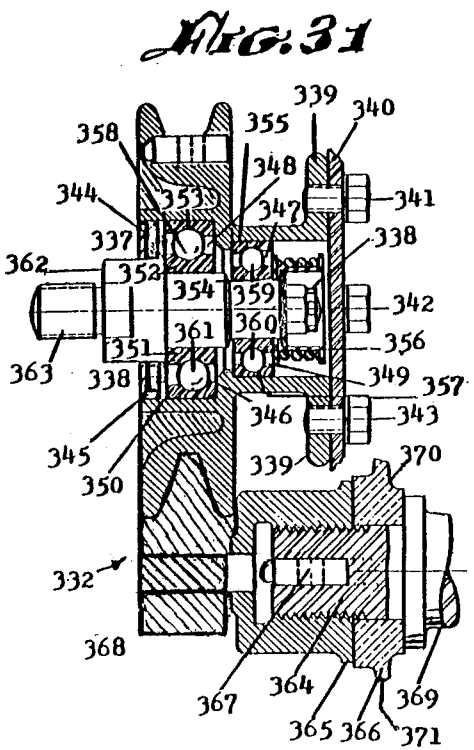
Figure 30:
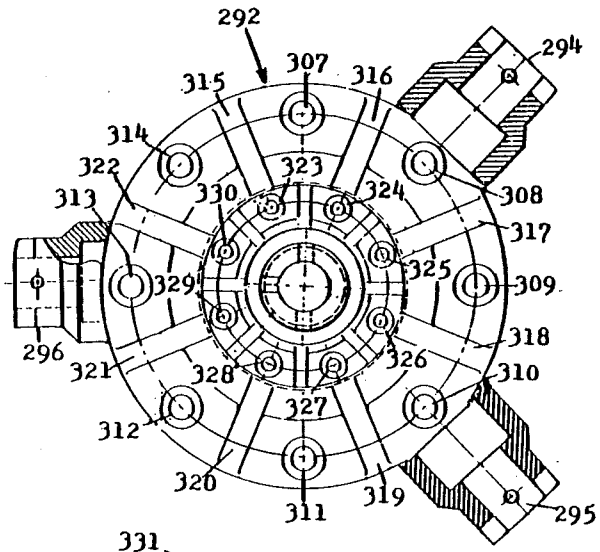
Figure 32:
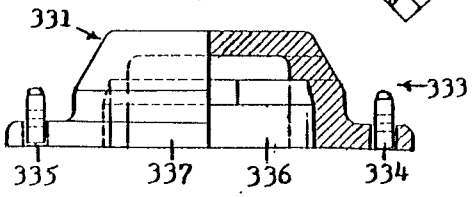
Figure 29:
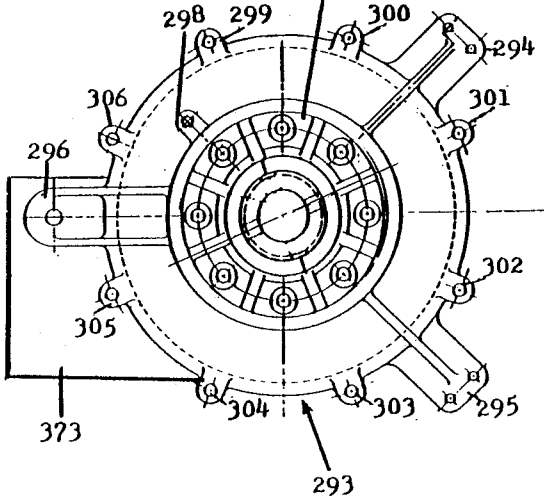
Figure 34:
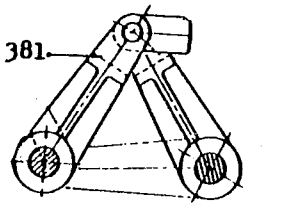

FIG. 29 through 48 entail four partially sectioned views of the rotating or revolving cylindrical means. Numeral 292 is assigned to the entire cylindrical means, which is encased by unit 293. Elements 294, 295 and 296 of FIG. 29 describe the housing of two equivalent injector means for loading projectile cartridges from revolving cylinder means 292 into the firing chamber, not shown, and a selector element for rotating cylindrical means 292. Numerals 297, 298 denote the housing for a laser sensor means to detect the position of the cylindrical means 292. Case means 293 is secured by precision insert and matching screw means 299 through 306 to the mainframe of the transector device, not shown. The revolving cylindrical chamber means, as described by number 292 of FIG. 30 is schematically shown with eight cartridges receptacles loaded with projectile cartridges, described by elements 307 through 314 and their respective slide channels, which is described by grooved means 315 through 322. Information regarding position is provided by electro-optical sensor means 323 through 330. Essentially when the cylindrical chamber means 292 rotates into position by selector means 294, 295 it stops and injector means 296 thrusts a single specified projectile forward and down into the firing chamber, 373. In FIG. 32 numerals 331, 332 are assigned to the side elevation of the rotating chamber means. Numerals 333, 334 and 335 are ascribed to the outer casing, peripheral loading channel for projectile cartridges, and the internal casing emboding the rotating shaft, ball bearing complement and other ancillary structures. In FIG. 31 numerals 336, 337 and 338 define the static brace into which the inner and outer race means of unit 292 are mounted, an internal reservoir containing a silicon based synthetic lubricant for the ball bearing system and an inlet means to service the said reservoir. Numeral 339 describes a mounting bracket for static means 337 and is secured to the mainframe of the device, 340, by four bolts, three of which are indicated by numerals 341, 342 and 343. Internal sealing gaskets 344, 345 provide effective seals for the ball bearing system and the lubricant reservoir. Numerals 346, 347, 348 and 349 are conduit channels conducting synthetic lubricant from the reservoir means to the complement of the ball bearing system. The inner and outer races of the ball bearing system are defined by elements 350 through 357 and the ball bearing means are described in part by means 358 through 361. Elements 362, 363 describe locking means for cylindrical chamber 292. The loading means is defined by casing means 364, 365 and 366, with the inner case 364 formed from a soft silicon composite which is threaded and inserts into casing 365, 366. A single projectile, numeral 367, is illustrated traveling towards a receptacle, number 368, which is contained within cylindrical chamber means 292. Coupling 369 leads to the outside of the transector device where the user may insert or side load one or more projectiles. Elements 370, 371 denote male insert elements, wherein the female portions of an autoloading magazine which engages and locks said magazine, not shown, into position for rapid replacement of expended projectile cartridges.

Figure 35:
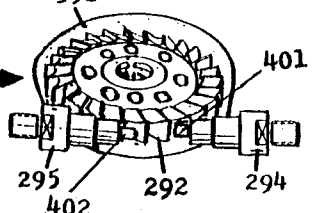
Figure 33:
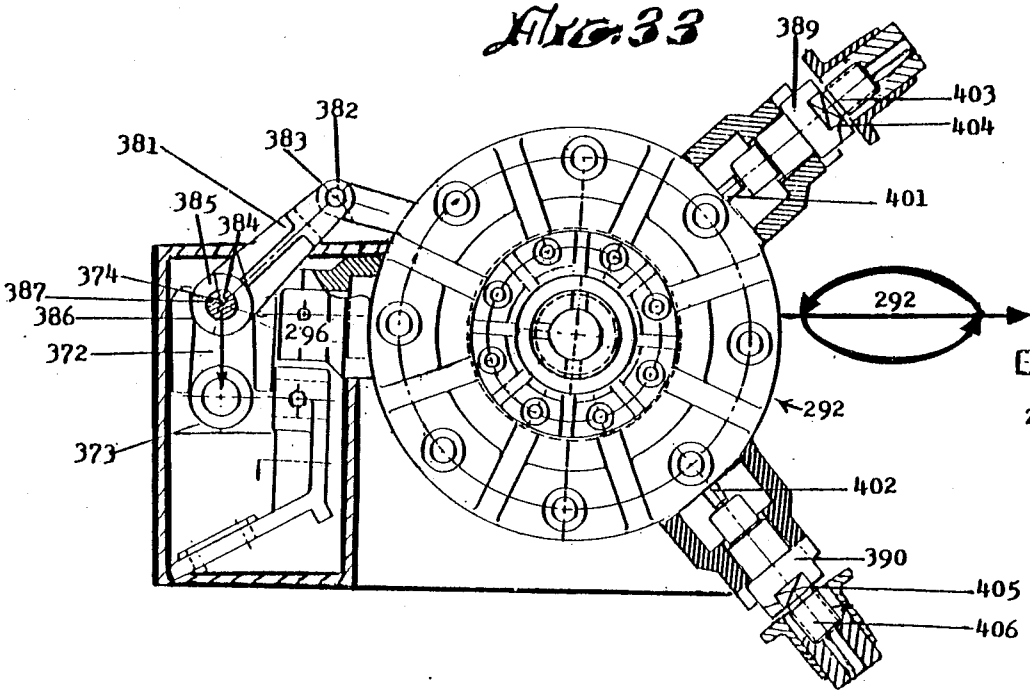

FIG. 33 is a partially sectioned view of the injector selector means and autoloading mechanism for firing either single or sequences of projectiles in or near designated regions where targeted individuals reside. Projectiles are injected from the cylinder means 292, along slotted channels or slide 372, into the firing chamber 373 by injector means 296. Once a given projectile is loaded into the firing chamber 373 through port 374 the cylindrical chamber means is advanced in such a manner as to seal the said port with the non-slotted portion of means 292, wherein the chamber means is closed or sealed from the rest of the transector device. The outer case of injector means 296 is defined by numerals 375, 375*a* and the inner lubricating channel is defined by means 376. Numerals 377, 378, 379 and 380 describe collectively the solenoid means, an inner casing, a miniature electromagnetic coil, a composite return spring and a plunger means, respectively. The operation of injector means 296 by the angular action of gearless slide means 381, which articulates with 382, 383, gearless discs 384, 385 and holding receptacle 386. Unit 381 temporarily encases the specified projectile cartridge number 387 by receptacle 386 as the said projectile cartridge travels linearly along slide 372 until the port, number 374, is reached at which point the projectile cartridge is released dropping into the firing chamber, number 373. Each selector means 294, 295 advances the entire revolving cylindrical chamber means 292 either forward in clockwise motion or in a backward counter-clockwise rotation, until the receptacle containing the desired projectile cartridge is rotated into the loading position adjacent to the injector means 296. The operation of slide means 381 is schematically indicated by number 388 of FIG. 34. Each equivalent selector means 294, 295 consists of a interactive solenoid complex collectively assigned to numerals 389, 390. Each selector unit 389, 390 are angularly disposed abutting against channeled grooves listed in part by numerals 391 through 400 which are circumferentially disposed around the peripheral edge of chamber means 292. In FIG. 35, forward movements by plunger means 401, 402 advances element 292 either in a forward or backward direction, clockwise or counter-clockwise motion. The motion of the cylindrical chamber is set by either or both solenoid means 389, 390 which disengage once the chamber is put into motion re-engaging the grooves, which act like teeth of a gear once a desired loading position is achieved the solenoids are locked into position preventing further rotation by the said chamber means, number 292. Each solenoid means may operate independently of the other solenoid and at any given time unit 389 remains in a standby mode, while unit 390 is actuated or visa versa. A spring loaded secondary solenoid pivot system is described by means 401 through element 406 which angularily move units 389, 390 towards or away from the groove means of the cylindrical chamber unit.

Figure 36:
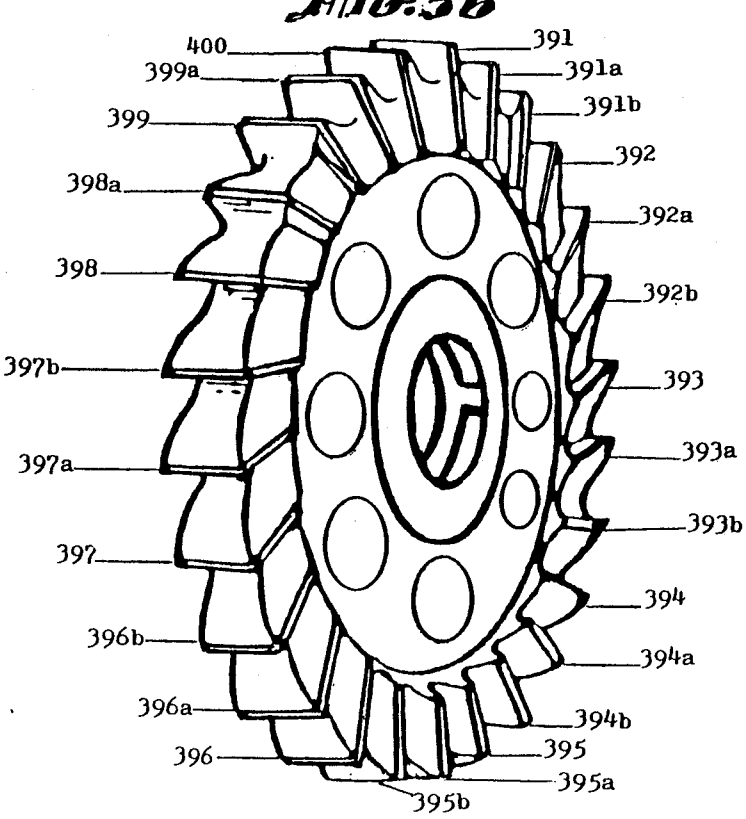

FIG. 36 entails a pictorial description of unit 292 and elements 391 through 400, respectively.

Figure 37:
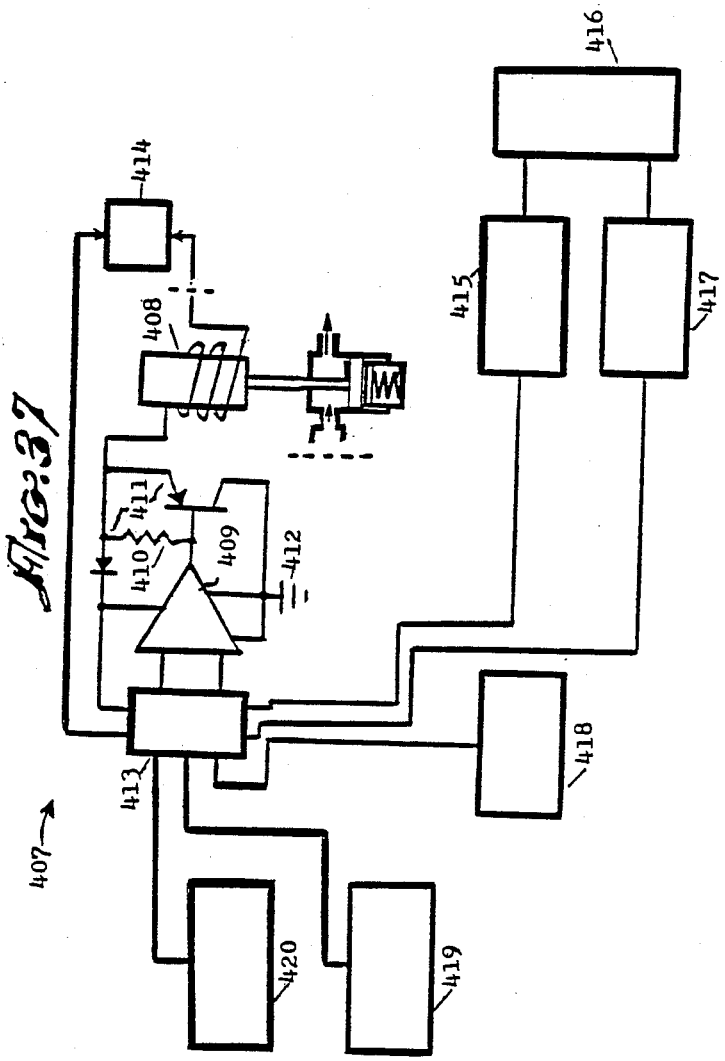

A brief circuit schematic block diagram describes the elementary operation of the solenoid driving means of FIG. 37 is collectively assigned the numeric value 407. Numerals 408, 409, 410, 411 and 412 define one of several solenoid means, an integrated circuit means, typical diode and resistive elements and a suitable ground means, respectively. A control and sequencer means, numeral 413 controls the input delivered to the solenoid circuit, the output delivered by the said circuit and the sequence in which one or more solenoids are actuated in order to perform a specific function. Other equivalent solenoid means of the sequence are illustrate by element 414. The position of the chamber 292 is indicated by elements 415, as specified by, laser diode, sensors and electrical contact means 416. The position of specified projectiles are provided by means 417 which also receives data from elements 416, 418. Element 418 is defined as a single mode static scan electro-optical array which verifies the type of projectile by identifying the holographic encrypton pattern or code etched on the surface of the said projectile. Numeral 419 designates a counter latch and decoder unit for signal processing and locking mode. The internal scale factors alluding to logistics, range, disperal patterns and other parameters are set by user based automode element 420.

Figure 38:
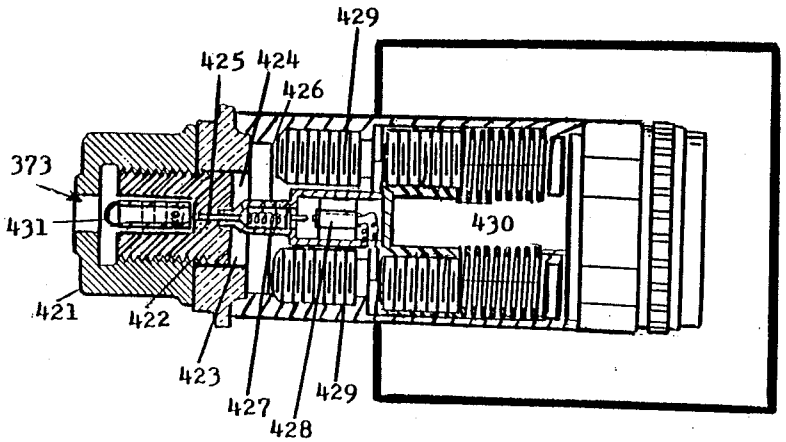
Figure 42:
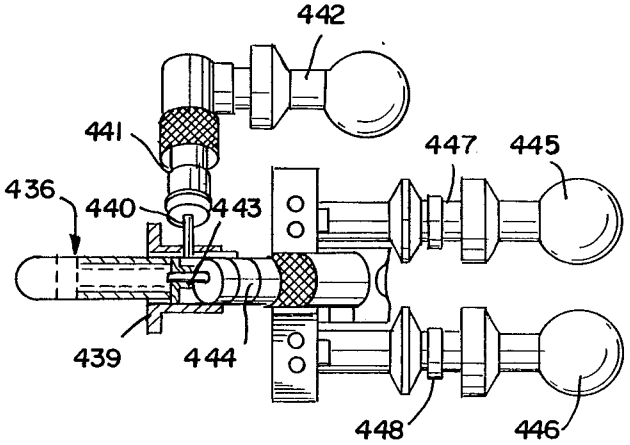
Figure 44:
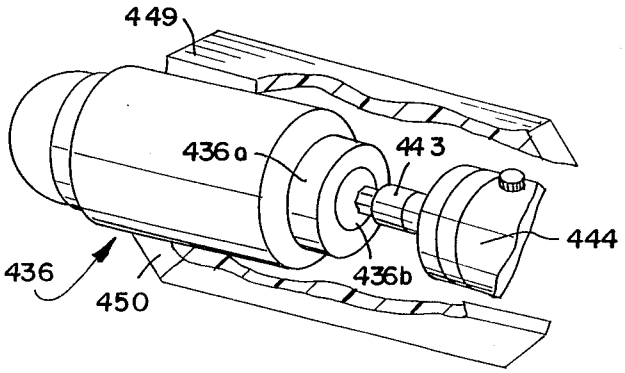
Figure 41:
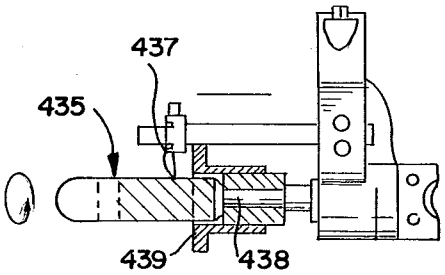
Figure 43:
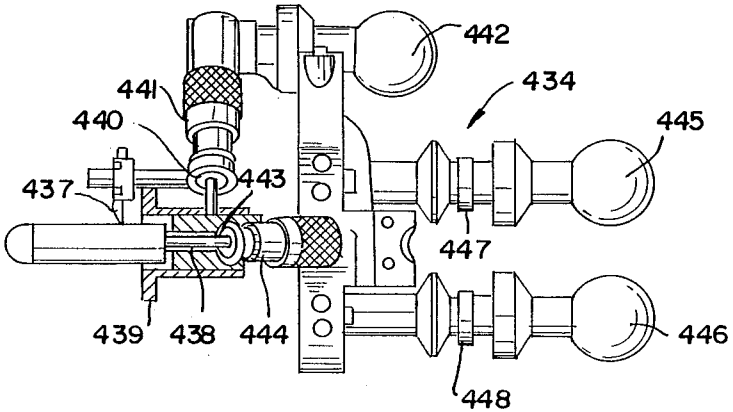

FIG. 38 defines in part the ignition system and firing chamber. Once the specified projectile 431 is loading into the firing chamber 373 the proper ignition sequence is provided by elements 421 through 425. The outer and inner casing of the firing chamber means is defined by elements 421, 422. Numeral 421 consists of a synthetic epoxylated metallic element composed of tungston, titanium stainless alloy embedded in a synthetic carbon fiber matrix. Numeral 422 describes the inner housing of chamber means 373 which is composed of a flexible ceramic composite of polymorphic silicon nitride embedded in a synthetic carbon fiber matrix. Numerals 423, 424 and 425 describes two equivalent positive carrier means and a negative biased discharge means for producing an electric arc. Enclosed element 426 contains a ignition coil means 427, 428. A miniature capacitance bank for charging ignition coil means 427, 428 is defined collectively by element 429. Numeral 430 designates a secondary transformer means utilized to charge capacitance bank 429.

Figure 39:
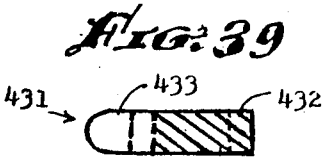
Figure 40:
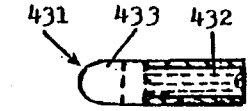

FIGS. 39, 40 are cross-sections of two equivalant ant projectile types. Projectile cartridge means 431 is sectioned to reveal a primary explosive charge, numeral 432, which upon ignition provides propulsion and a warhead assembly defined by means 433, which upon dispersal either ignites, detonates or reduces to a highly volitile vapor depending upon the type of projectile exiting through the barrel of the transector device.

The range and dispersal pattern of projectiles is contingent on the type of projectile cartridges selected, the composition of the propellant system employed and the type of charge applied to the coil. The propulsion system consisted of either a solid propellant, liquid propellant or charge of compressed air, for more limited ranges. The concentration of the propellant as well as its quantity can be regulated prior to packaging, a bleeding off process in the case of liquid propellant, or the process of structural deletion for solid propellant means, wherein a prescribed section of the explosive charge is removed prior to the projectile cartridge being loaded into the firing chamber. It is obvious that the range of a specified projection can vary directly with the amount or quantity of propulsive charge expended. Packaging of contents varying the charge of a solid propellant or the bleeding of fuel in liquid propellant are conventional means of regulating range in the ranging of missiles, rockets and certain variable mortar means.

FIGS. 41 through 48 designate partially sectioned views denoting the structural configuration of the range selector means. The range selector means, number 434 operates on the propulsive portion of the projectile cartridge. There are basically six types of propulsion mediums available; however only two types of propulsion means will be disclosed by projectile cartridges 435, 436. The other four types of propulsion means vary in chemical composition from those illustrated by elements 435, 436, but have the same structural configuration and operational parameters of the said disclosed projectile cartridges. Projectile cartridge means 435 discloses a solid propellant means. The range of solid propellant powered projectile cartridges are diminished by simply excising and removing an appropriate portion of solid propellant calculated by sensors to reduce the range of a projectile by a given specified measure of distance. A carbide blade means, number 437, scores and cuts a predetermined length circumscribed and specified by a programmed based on the range of targets monitored by the laser designition means, not shown. A portion of the cartridge containing solid propellant is cleaved by means 437 and ejected by solenoid means 438 into a holding chamber 439. If the propellant is liquid or compressed gas then the range is diminished by bleeding a measured portion of the propellant away from the cartridge reducing the range of the said cartridge, number 436, so that the expended projectile travels an exact distance coinciding with an exact distance determined by laser designation and sensors. Numerals 440 to 442 and 436*a*, 436*b* define a solder junction, bleeding nozzle, solder/flux unit, a self sealing gasket and casing for the propellant embodied by projectile means 436. Numeral 443 designates a solenoid injector retractable needle means by which elements 436*a*, 436*b* are pierced and the contents of 436 are bleed off. The solenoid element which advances and retracts the fine bore needle means 443 is described by element 444. The flow into and out of reservoir means 445, 446 are controlled by bidirectional solenoid means 447 and flow channel governor 448. Reservoir 445 receives contents bleed off from the propulsive element of projectile cartridge 436; whereas reservoir 446 is charged with either high pressure gas or liquid propellant for increasing the fuel and/or propulsive force generated by projectile means 446. Numerals 449, 450 are autostays which grasp onto projectile means 436, while it is undergoing further charging from reservoir 446, or being discharged by passing propellant into reservoir 445. The autostays 449, 450 are automatically retracted when the operation of ranging the projectile is completed; wherein the modified projectile cartridge is inserted into an ancillary loading chamber, 451 which is adjacent to the loading chamber of the selector means 454. A solenoid motivated cylindrical shell, 452, moves either modified projectile cartridges 435, 436 into the loading chamber of selector means 434. Solenoids 452*a*, 452*b* move cylindrical plate means 453, laterially back and forth, so that projectile cartridges are conveyed to and from the loading chamber of the selector when either modification are initiated and/or completed. As for the miniature warhead assemblies which vary upon the type of function designated which range from blinding chemical flares to encapsulated cylinders of volatile charges and the dispersal patterns of each can be programmed by mechanism embodied within the said assemblies (i.e. programmable timing or logic circuits understood by those skilled in the art.

Figure 49:
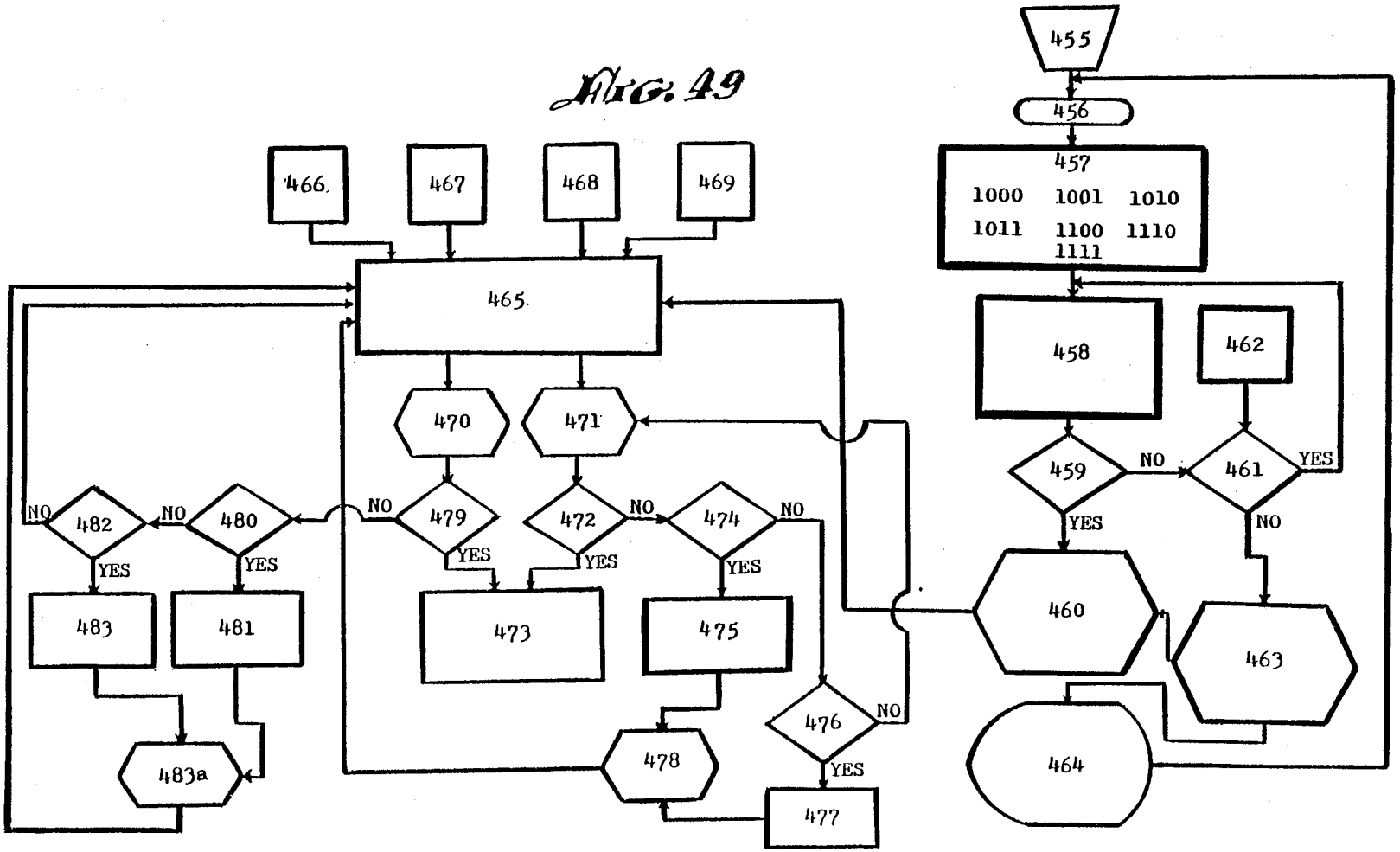
FIG. 49 is a flow chart for a program for determining dispersal pattern, selecting projectile types, quantity and the range of the same said projectiles.

FIG. 49 discloses a flow chart for a program for selecting projectiles, types, quantities, dispersal patterns and the range of the said projectiles. The program governing the type quantities, dispersal patterns range and other parameters are essentially keyed by the user in conjunction with various onboard systems embodied within the transector device. The user can at any given time manually override the operation of any system simply by keying modifications in a prescribed manner. The start sequence 456, is initially actuated by the user, as disclosed by number 455. The user keyed/instructions provides the basis wherein projectile types are defined by numeral 457. The types of projectile types are as follows, value 1000 specifies the use of carrier mediated volatiles in the form of anesthetics, 1001, noxious or irritating antabuses,* 1010, and/or neural inhibitors, 1011. Fast evaporating aerosols dissipate surface heat rapidly inducing a chill factor to groups of targeted individuals, as described by programmed value 1100. The selection of concussive projectile cartridges 1110, which upon detonation above targets produce a deafening sound and concussive forces. Value 1111 specifies for the selection projectile cartridges containing miniature flares, which when ignited above a specified target region produces heat and intense blinding light. The programmed selection further actuates a scanning circuit which scans for the specified projectile, provides timing and sequencing for dispersal of the said projectiles, as indicated by element 458. Decision process 459 determines whether or not an appropriate target has been selected; and if so then a subprogram numeral 460 is actuated; and if not then the data is channeled to element 461. Element 461 determines whether or not a given specified projectile is contained within the present inventory of load projectiles. Information describing the entire disposition of projectile cartridges loaded in cylindrical chamber 492 is qued by, or otherwise by scanning the holographic patterns or codes imprinted on each projectile cartridge means as determined by process 462. If certain specified projectile cartridges are not contained within the inventory than new alternative projectile cartridges are reassigned to their respective targets, as illustrated by process 463. The information obtained from process 463 is relayed to element 464; wherein the data is displayed and the system immediately returns to element 457 for new instructions. However, if it is determined by element 459 that the target can be selected for by one or more specified projectiles, subprogram, number 460 is enlisted. Element 460 automatically selects parameters alluding to but not limited to those values of chemical concentration force range and dispersal patterns, as previously indicated and relays its data to unit 465 for further processing. Unit 465 is additionally implemented with data received from processes 466, 467, 468 and 469, respectively. The position of one or more projectile cartridge in relation to the load assembly is indicated by elements 466, 467. Information concerning the current range of targets and their patterns of motion or movement is currently provided by means 468, 469. The aforementioned parameters selected by subprogram 460 are computed by unit 465. The information derived by unit 465 is channeled to two equivalent, but separate and distinct processes described by numerals 470, 471. Process 470 is deployed when the propulsion system of a given cartridge is specified by holographic pattern code to be either liquid or compressed gas. Process 471 is deployed if the given cartridge means is specified by said holographic code to be a solid (i.e. hard solid, paste or fused powder). In the event the propellant is determined to be a solid, then it is established by decision process 472 whether or not the amount of propellant contained is exact to reach a targeted region. If the propellant contained within a cartridge is deemed sufficient to reach a designated targeted region, then element 473 is elicited; and if not, then decision element 474 is enlisted. Element 474 determines whether or not the distance of the target will be greatly surpassed by the propellant contained within the said cartridge. If it is affirmed that the target will be surpassed by the projectile, then a portion of the cartridge with the length defined by X is removed or subtracted from the circumferential length of the solid propellant element defined by Y, so that some optimum value N is reached, as indicated by element 475. If however, it is determined by process 476 that the required distance to engage a target is beyond the capacity of a given specified projectile, then element 477 is engaged wherein the length of the propellant Y is extended by some specified value Z (i.e. a cylindrical section of a specific length containing propellant Z and is added to length Y from a storehouse of reserve propellant elements). Both processes 475, 477 are upon completion verified by means 478 which re-enlists element 465 for confirmation of data. If it has been determined by element 479 that the range of the targets match those parameters provided by the propulsion means of a specified projectile cartridge containing compressed gases, liquid propellant or some other suitable media, then unit 473 is enlisted to determine the optimium values firing sequence and the like needed to survive one or more targeted regions. If the range of the targets do not match those of the propellant system then decision process 480 which determines whether or not the targets are out of range is inacted. If the targets are beyond the propulsive capabilities of the specified projectile cartridge, then means 481 is engaged; wherein the contents of the liquid or gas propellant are recompressed and added to the propellant, such that propellant Y is added to proportion to propellant X1 which is compatable with Y and produces a new quantity Z. Quantity Z is calculated to provide the projectile means with sufficient thrust to reach the specified targets. If however, the thrust provided by the propellant system is in excess of that needed to reach designated targets, which are determined by decision process 482, then process 483 is engaged wherein excess propellant is bleed off. The amount of propellant bleed off from the initial amount of propellant contained within the specified projectile cartridge Y is that amount or volume X2, removed or subtracted from Y, Z which allows the projectile means to avoid overshooting the said targets. As in the case of the solid propellant system once a programmed modification has been instituted the new value X2 must be verified and confirmation requires a return to system 465. Process **483*a* verifies the new parameters and returns to unit 465** for further confirmation.

* a non-injurious noxious substance which induces vomiting when administered in concentrated form i.e. tetraethylthiuram disulfide, etc.

FIGS. 50 through 63 are detailed sectioned views illustrating the loading assembly, selector means, mixing chamber and dispersal means for the carrier mediated volitiles. The operation of the above mentioned system requires a minimum of maintance for normal operation. A cassette loaded with eighteen separate and distinct cylindrical cartridges are arranged in rows of six and disposed in pairs. Each cartridge charged with a volitile substance is situated adjacent to a cylindrical cartridge containing some carrier mediated chemical complex such as DMSO or other suitable substances. An automated servo means described as a selector means consists of a pair of fine bore needle means mounted on a translating bore means, which acts as a two dimensional variable stage motivating the said needle process either vertically or horizontally along the complement or array or cartridges. A solenoid complex thrusts the fine bore needles forward, when actuated into a prescribed pair of cylindrical cartridges, which automatically retracts from the programmed cartridges when the solenoid complex is deactivated. The needle means project into each respective cartridge means piercing a self sealing gasket complex and the pressurized content of each cylindrical means is conveyed by a pair of miniature corrugated conduits to a miniature phase mixing chamber means. The pressurized content delivered from the conduit means intermixes in the mixing chamber and is conducted to the peripherally located sintered material which is embodied within the barrel structure by an array of miniature corrugated pipes. A series of equivalent solenoid values emit the flow of pressurized carrier mediated volitiles into and out of the said mixing chamber.

Figures 50, 51, 52, 53, 54, 55, 56:
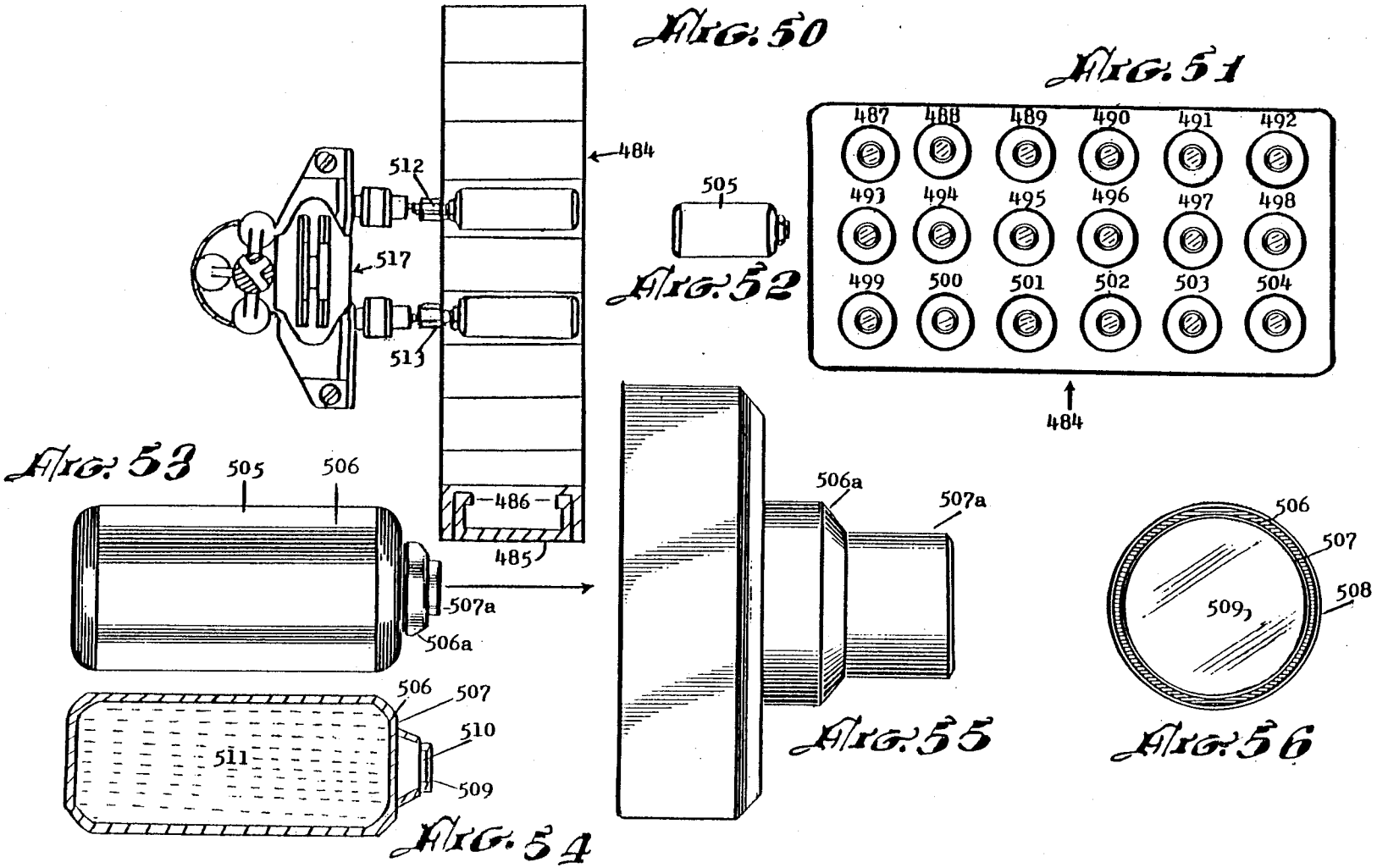
FIGS. 50 through 63 are detailed sectioned views illustrating the loading assembly, selector means, mixing chamber and dispersal means for the volatiles.

Numerals 484, 485 and 486 of FIG. 50 designate the loading cassette containing eighteen separate liquidfied gas cylindrical cartridges, the load ramp or slide and carriage means in which cassette 484 is accepted and a crimpped or beveled portion of the said cassette means 486 which inserts into carriage 485. In FIG. 51 numerals 484 through 504 define eighteen separate and distinct cylindrical cartridges loaded into their respective receptacles of cassette means 485. A sectioned view of a single cylindrical cartridge, as described by numeral 505, in FIG. 52, is equivalent in structure and design by anyone of the eighteen said cylindrical cartridges of the complement containing volatiles, or penetrators, or other suitable pressurized liquified gas mediums. In FIG. 54 the outer wall, 506, consists of a layer of aluminum which is epoxylated to a thin insulatory layer, number 507, coating the interior of cylindrical means 505. The front portion of the cartridge, 505 is slightly elongated forming a neck which is gradually tappered as indicated by numbers 506*a*, 507*a* in FIGS. 53, 55. Covering the central bore of the neck, 508 is a thin sheet of aluminum which is fused circumferentially to the flat surface face, as described by number 509 of FIG. 56. A cylindrical plug means described by numeral 510, which is composed of a suitable soft self sealing synthetic plastic gel. Upon penetration by a fine hollow bore needle means, number 512 the plug means 510 seals around the said needle means in a fashion as to prevent leakage of the cylinder, 505, contents, 511, from the peripheral portion of the needle means 512. Upon retraction of needle means 512 from the bore 508, of the neck cylinder means 505 the hole made by the penetration of the needle means immediately seals itself preventing seepage of pressurized contents 511 from exiting the aforesaid cylinder. A pair of fine bore needle means 512, 513 are mounted on a translatable stage, 517. Aft of each needle means are two spring loaded recoilable solenoid flow governors, numbers 514, 515 which control the flow of pressurized fluids or gases from needle means 512, 513 respectively, as disclosed in FIG. 57.

Figures 57, 58, 59:
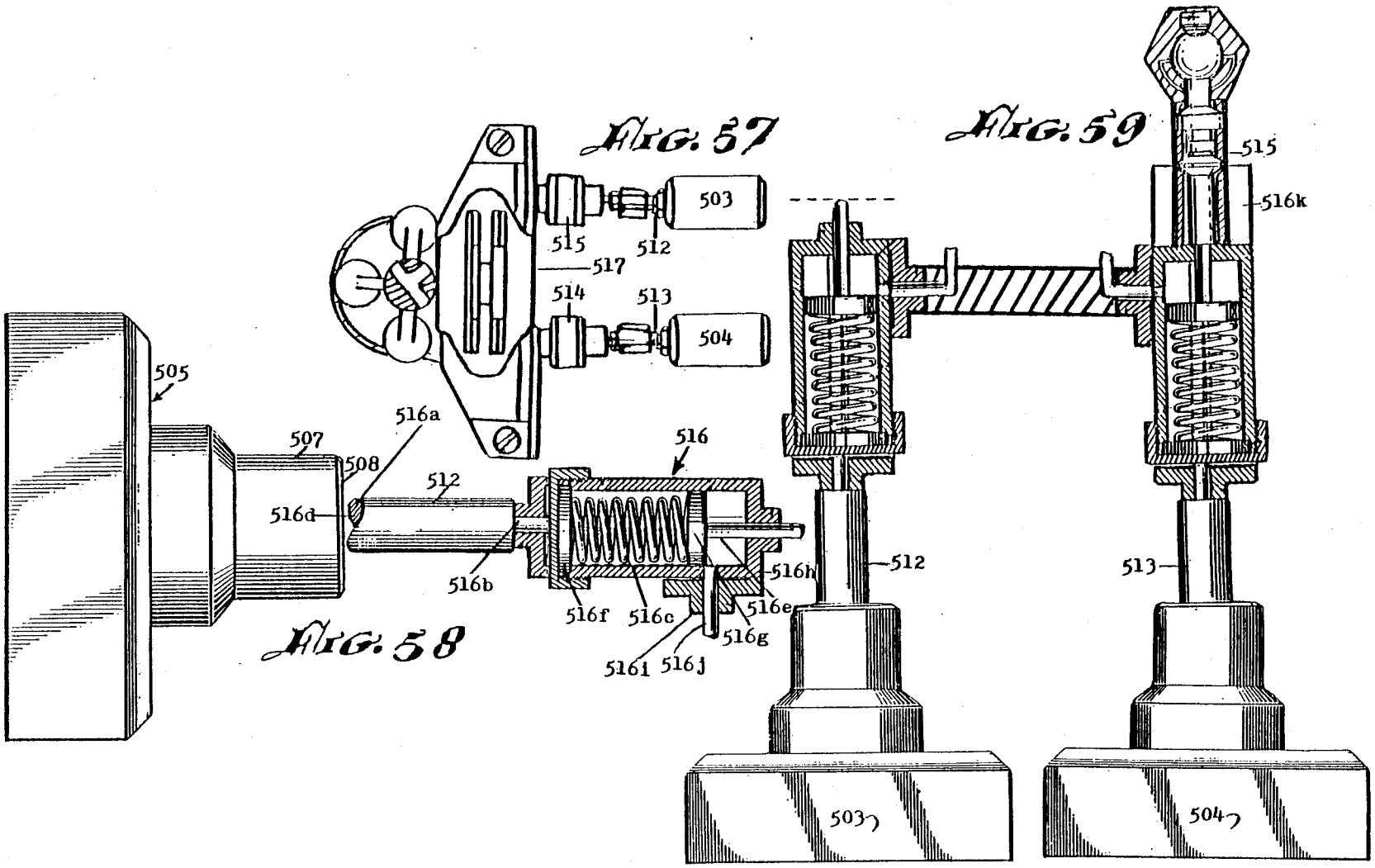

FIGS. 57 to 59 disclose detailed perspectives of the selector means, Numeral 516 is assigned collectively to a sectioned perspective of needle means 512, 513 and flow governors 514, 515 to schematically reveal the operation of the needle governor inlet system. In FIG. 58 elements 516*a*, 516*b* and 516*c* define the outer casing of the needle means which is composed of a suitable stainless synthetic composite material, a solid rod composed of a suitable non-reactive composite material which prevents a portion of plug means 510 from falling back down hollow bore 516*d* of the said needle and a coiled stablization spring means. The base of rod 516*b* is a plunger means 516*e* which abutts against a self sealing washer means 516*f*, 516*g* front and aft of the said plunger means. This seals washers 516*f*, 516*g* operating inconjunction with a tension spring, 516*c* which abutts up against projections 516*h*, 516*i* to effectively close the channel of bore 516*j* until solenoid means 516*k* as seen in FIG. 59 is actuated, opening the said channel so the pressurized contents, 511, can back up and exit the outlet of the governor means.

Figures 60, 61, 62, 63:
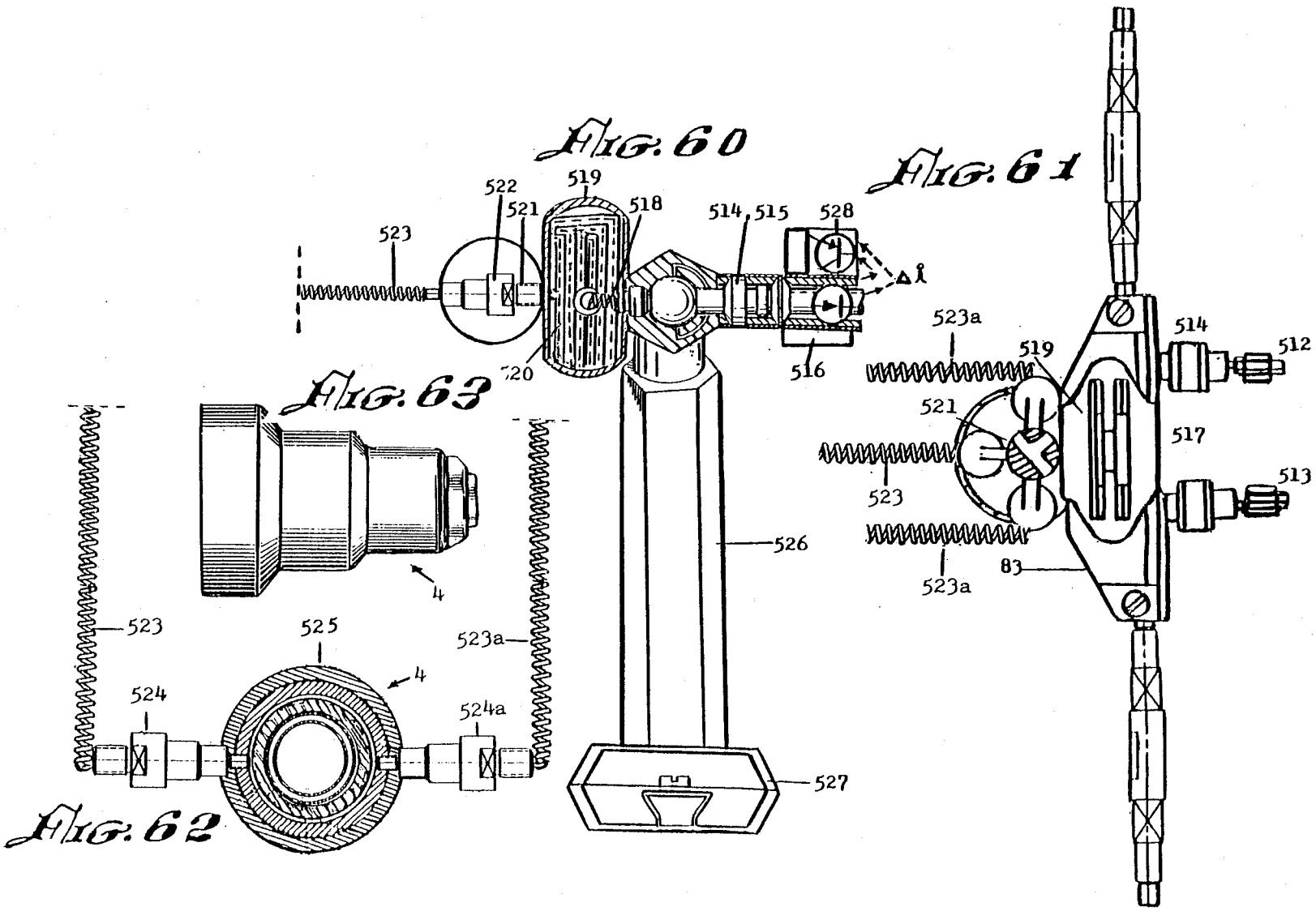

FIGS. 60, 61 are partially sectioned views of said selector means. The contents of each governor means 514, 515 exit into mixing chamber 519. It is within the aforesaid mixing chamber 519 wherein the aforementioned volatile and penetrator means are intermixed. A thin film baffle system described by element 520 provides an extended surface area wherein chemical interactions or complexing can readily occur. A coupler outlet numeral 521 entailing a solenoid governor means 522 controls the exit of pressurized carrier mediated volatile complexes out of mixing chamber means 519. Elements 518, 523 are corrugated exit pipe or conduit means, numeral 523, inserts into coupler outlet means 521 and functions to convey the carrier mediated complexes to a secondary coupler element described by element 522. Said corrugated pipe means 523 diverges into two or more sections, as indicated by FIGS. 61, 62, respectively.

FIG. 63 is a partial side elevation describing the exterior or barrel means, number 4; whereas FIG. 62 describes a partially sectioned schematic view of the aforesaid barrel structure and ancillary means for the release of volatiles. As indicated in FIG. 62 conduit means 523 diverges into two conduit structures 523, 523*a* and said structures enter secondary govenor elements 524, 524*a*. Elements 524, 524*a* are fused to structure 525, which forms the peripheral sintered casing component of said barrel means. The pressurized contents conveyed by conduit means 523 is distributed to the sintered material of barrel means 4, wherein it filters forward through the poreous sintered portion of the said barrel exiting out peripheral from the aforementioned barrel means, as previously disclosed. The translational stage or support bar 517 is mounted on vertical support 526, which is mutually disposed on XYZ translational stage, 527, which operates in a specific manner to move the mixing chamber and needle governor complex precisely in in either one of three directions, as described in FIG. 60. The XY translational stage means 527 is automated by either solenoids or miniature motorized units and operates in a manner consistant with conventional systems. Numeral 528 consists of a series of miniature laser based sensory means which assist in positioning the needle means, so it can accurately pierce a given specified pair of cylindrical cartridges at any time. The aforementioned laser based sensor system and translational stage means operate within the contexts of an automated feedback loop readily understood by those skilled in the art and will be elucidated further by the flow chart described in FIG. 64.

Figure 64:
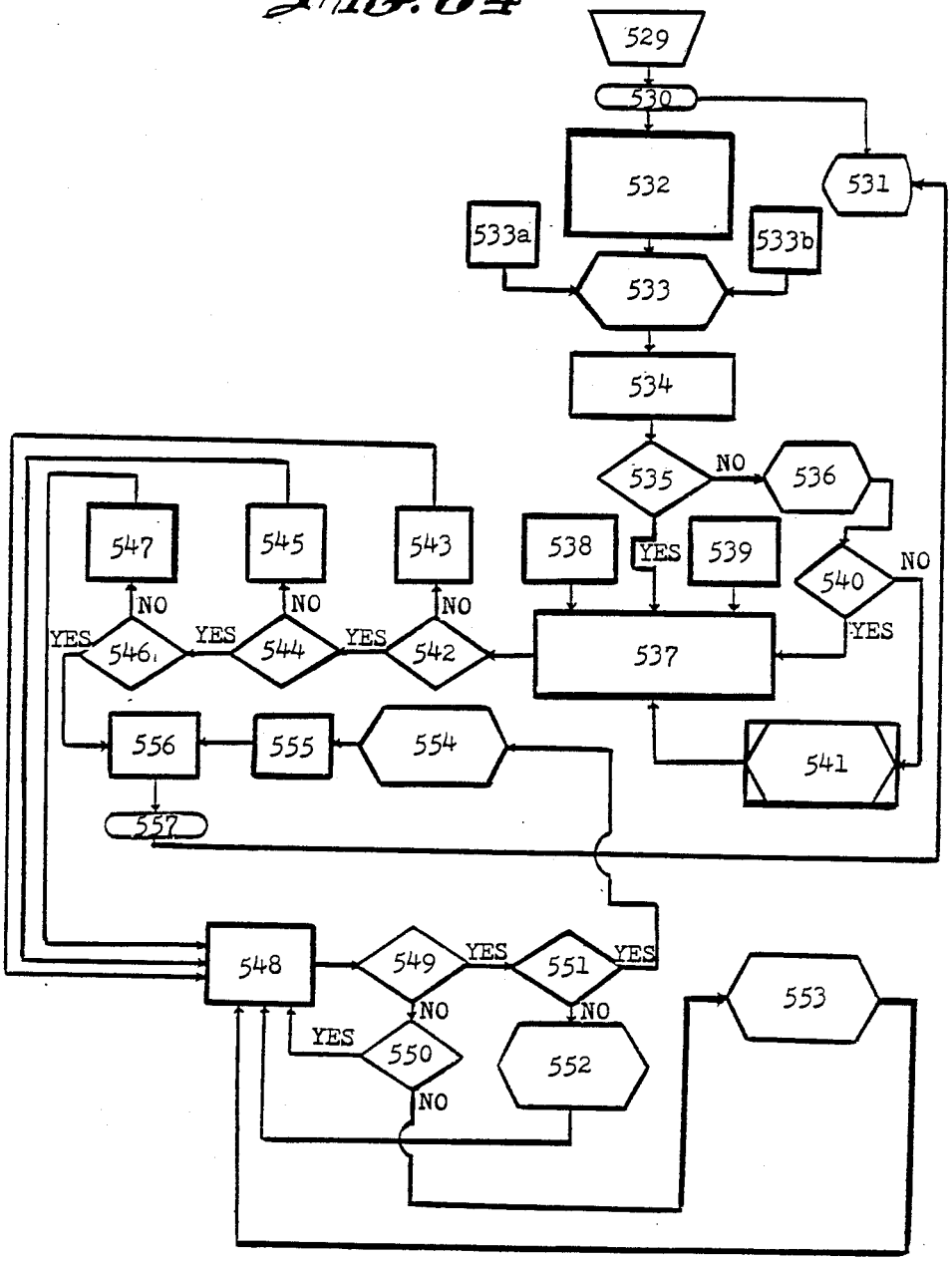
FIG. 64 is a flow chart for the program governing the concentration, type and range of the volatiles to be dispersed.

FIG. 64 is a flow chart for the program governing the concentration, type and range of volitiles to be dispersed by the user actuated transector device. The user initially keys the start sequence number 529 and makes the initial selection described by element 530. The current status of the cylindrical cartridge means, the types, quantity, charge capacity and viability of each which is displayed to the user by ancillary means 531, denoting status of the volatile delivery system. The user upon receiving the information concerning the operative readiness of the volatile system by hearing and/or viewing the status as per means 531, which actuates a keyed selection, as indicated by number 532. The alphanumeric code is keyed by the user, specifying the type of volatile to be delivered, the duration of the delivery period, the sequence and concentration of the carrier mediated volatile dispatched is determined by means 532. Once a set of instructions is initiated by the user, number 532, then a scanning procedure is instituted by process 533. Data received from internal intersystem based laser sensory means identifies specified cartridges and their subsequent positions, as denoted by elements 533*a*, 533*b*. Once the scanning procedure, number 533 has been completed, then data is channeled into an accumulator means 534; wherein positional data based on a three dimensional axial grid is identified, locates and verifies the position of the selector means 194 in relation to a given pair of specified cartridges contained within the cassette means, number 486. Determinant process 535 is redundant and functions to match and verify the digital signals retrieved by the reflected holographic code, which is etched or imprinted on the specified cylindrical cartridges. If the code match is verified, then data is channeled to means 537; whereas if verification is not substantiated or confirmed, then a search subprogram is initiated and the results are deployed, as indicated by number 536. Online data derived from means 535, 538 and 539 is conveyed to element 537 for processing. The data from element 536 is channeled to deterministic process 540, which assesses whether or not a second scan provides a verification of an exact match or not. If the second scan is verified, then data from element 540 is sent to the aforementioned element 537 to be acted upon. If the second scan is still not verified by the said process 540, then the information obtained from element 540 is conveyed to process 541, wherein an alternative selection is made and the choice generated is displayed to the user. The data from the subprogram described by element 541 is conveyed to element 537 to be acted upon. Process 542 determines whether or not the coordinates for the X axis match those designated coordinates affirmed by the sensors. If conformation of the X coordinates are exacted, then data from 542 is transferred to 544; and if the said X coordinates are not verified, then element data from 542 is conveyed to 543. If the data derived from process 542 is verified, then the coordinates are reset and the necessary corrections are exacted in a specific manner as to have the X coordinates match those of the specified coordinates. In a equivalent fashion decision processes 544, 545, 546 and 547 act on data concerning the coordinates of the Y and Z access as paired elements 542, 543 act. The data exchanged and processed by elements 542 through 547 are collectively sent to unit means 548; wherein the selected pairs of cylindrical cartridges are engaged by selector means 194. Decision process 549 determines whether or not a given specified cylindrical pair is engaged or not. If it is determined by element 549 that indeed the proper cylinders are engaged, then the data is channeled from 549 to 551. If however, the selected pair of cartridges are not engaged, then the data is transferred from determinant process 549 to determinant process 550; wherein it is determined if the X,Y,Z motivators, solenoids, motors and/or the like are operative. If the said motivators and like are all operational, then data from 550 is sent back to unit 548 for reprocessing; wherein if 550 exacts a negative decision the data is channeled to subprogram 553. It is in element 553 wherein a subprogram is enlisted to institute an alternative program and resets all coordinate values, returning the modified data to process element 548 by way of determinant process 550. Data concerning determinant process 551, wherein it is determined whether or not sufficient volume is presented in cylindrical cartridge means 552, is conveyed to either process means 554 or process 552. If a negative response is elicited from 551, then the data is sent to means 552, wherein a search for an equivalent cylinder or pair of cylinders to those which had been initially specified, each of the substituted cartridges now are selected and monitored by pressure sensors and the like in order to confirm that they are sufficiently charged. The data derived from process 552 after completion is conveyed to unit 548 to be further acted upon. If the specified cartridges are sufficiently charged, that is the said cartridges contain a sufficient quantity of substance to deliver a prescribed dosage, then process 554 is enlisted. Process 554 determines the length of time or duration of delivery and the sequence of the said delivery controlling signals to solenoid release mechanisms and the like. Data from 554 is conveyed to subprogram 555 which controls solenoids governing the release and mixing of volatile penetrators and the like. Information acted upon by subprogram 555 is conveyed to means 556, which actuates the governor means controlling the release of carrier mediated volatiles. Data is transferred from element 556 to process 557 wherein the resultant release is displayed forcing a return to process 531; wherein the systems readiness to complete another function is signaled by means 532 for the next cycle. Originally, eighteen separate and independent solenoids were assigned to each of the separate eighteen cartridge means, but difficulties were incurred in a loading cassette with expended cartridges and replacing the said cassette with one which contained fully charged cartridges. Therefore, it was determined that the selector means operated to function in a more reliable manner than selection provided entirely by a complement of solenoid apparatuses.

Figure 65:
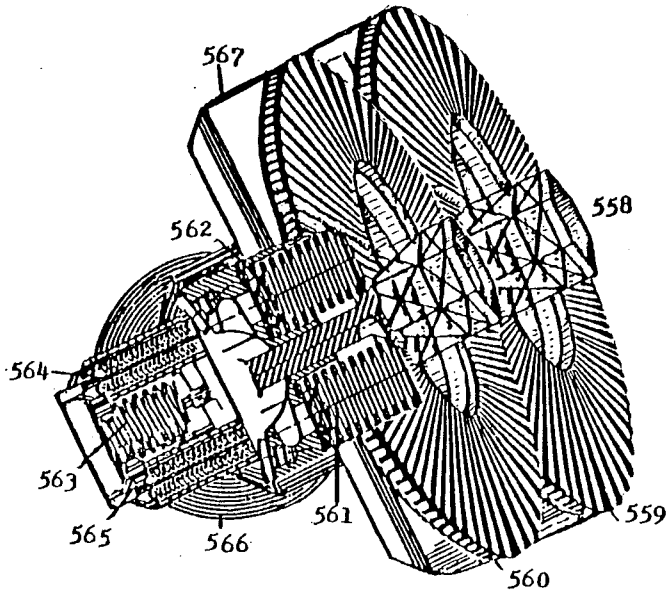
FIG. 65 is a detailed partially sectioned perspective view of the acoustical piezoelectric generator means.

FIG. 65 is a detailed partially sectioned perspective view of the acoustical piezoelectric generator means illustrating in part the operative structure of the said unit. Numeral 558 designates a metallic quartz crystalline piezoelectric generating means which initiates the sonic transmission. Elements 559, 560 denote two separate and distinct charging plates. The charging coils for plates 559, 560 are defined by elements 561, 562, respectively. A pulse generator means is described by unit 563. Commercial pulse generators like the one described by numeral 563 can either be obtained locally or readily manufactured from conventional components. Numerals 564, 565 designate sectioned view of electro-optical transducers and proportional coolant elements. Numeral 566 defines an articulating joint and socket means which enables the unit when automated by motivator means, not shown, to rotate 360 degrees of arc in any one of three directions. Numeral 567 designates an outer peripheral parabolic dish means for concentrating or focusing the acoustical transmission towards a specified targeted region of the designated targeted individual.

Figure 66:
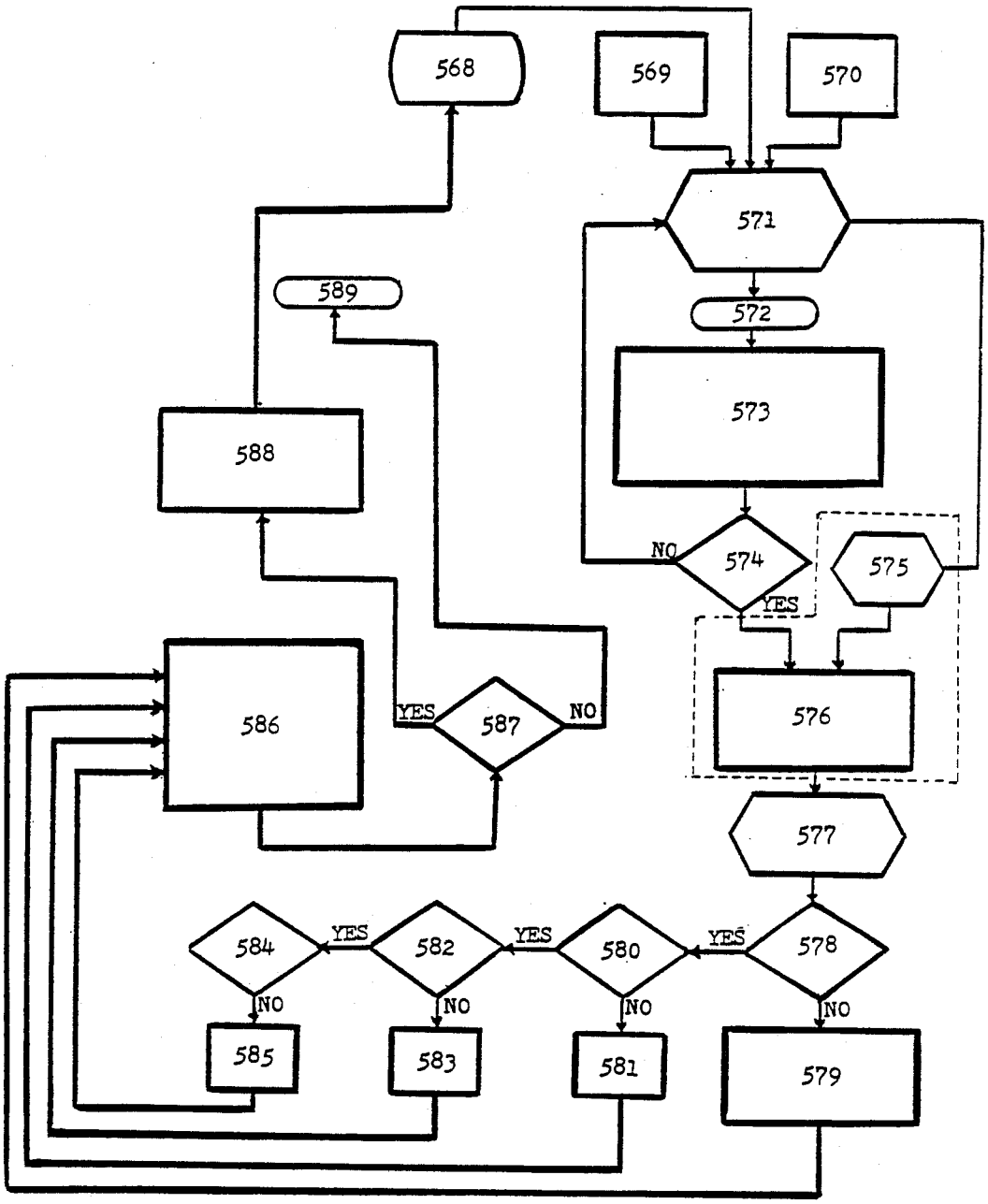
FIG. 66 is a flow chart for the program governing the frequency, duration, intensity and other characteristics of the sonic emissions produced by the acoustical generator means.

FIG. 66 is a flow chart for the program governing the frequency, duration, intensity and other characteristics of the sonic emissions produced by the acoustical generator means. The user initiates process 568 wherein the transector device is aimed or pointed at a target along the axis of sight; while the user actuates or keys the laser designator means, which is described by process 569 and acoustical locator means 570. The data processed by elements 569, 570 are channeled to process 571, which entails a subprogram wherein the process of target acquisition is instituted on the said data. The start sequence, number 572 is actuated upon the completion of numeral 571. The user selects a set of instructions which define parameters such as, power level or intensity, pulse shape and the duration of the acoustical emission, as indicated by programming process 573. Once element 573 is keyed then verification process 574 determines whether or not the primary targets are illuminated. If the primary targets are not illuminated (i.e. identified, tracked and locked onto) then the data from 574 is reconveyed to element 571 for reprocessing. If however, conformation of illuminated targets are exacted by determinant process 574, then process 576 is actuated. The information supplied from 574 is supplemented by a subprogram 575, which provides an informational update on primary targets. It is in process 575, wherein acoustical transmissions are deployed to engage primary target designations 1, 2, 3 . . . N. The first emission sequence is immediately followed by the administration of a second sequental sonic burst which is delivered to primary targets, as indicated by numeral 577. The data from 577 is sent to a number of determinant processes, as described by elements 578 through 585. Process 578 determines if all the parameters are operational. If the parameters are all actuated, then data from process 578 is conveyed to element 580, if not, then the data from 578 is conveyed to process 579. It is in 579 where circuits are electronically scanned to verify power parameters and to recalibrate systems. Elements 580,583 and 584 ascertains the status of the intensity, pulse shape and duration of the acoustical emission; whereas if negative values are elicited by the aforementioned processes then means 581, 582 and 585 operate to reset and correct deviations in the established norms of intensity, pulse, shape and the duration of the acoustical emissions. Elements 578 through 585 collectively input into system 586. It is in element 586 wherein the proper execution of instructions is displayed to the user. If no secondary targets are available then the program is terminated, element 587 and the start sequence 572 is once more reinstituted. If secondary targets are specified then reinterative processes, collectively assigned the value 588 are enlisted. The processes contained within subprogram 588 are equivalent to those 574 through 586. Once the keyed instructions are completed in means 588 the program is terminated and the system is placed in a standby state numeral 589.

Figures 67, 68, 69, 70:
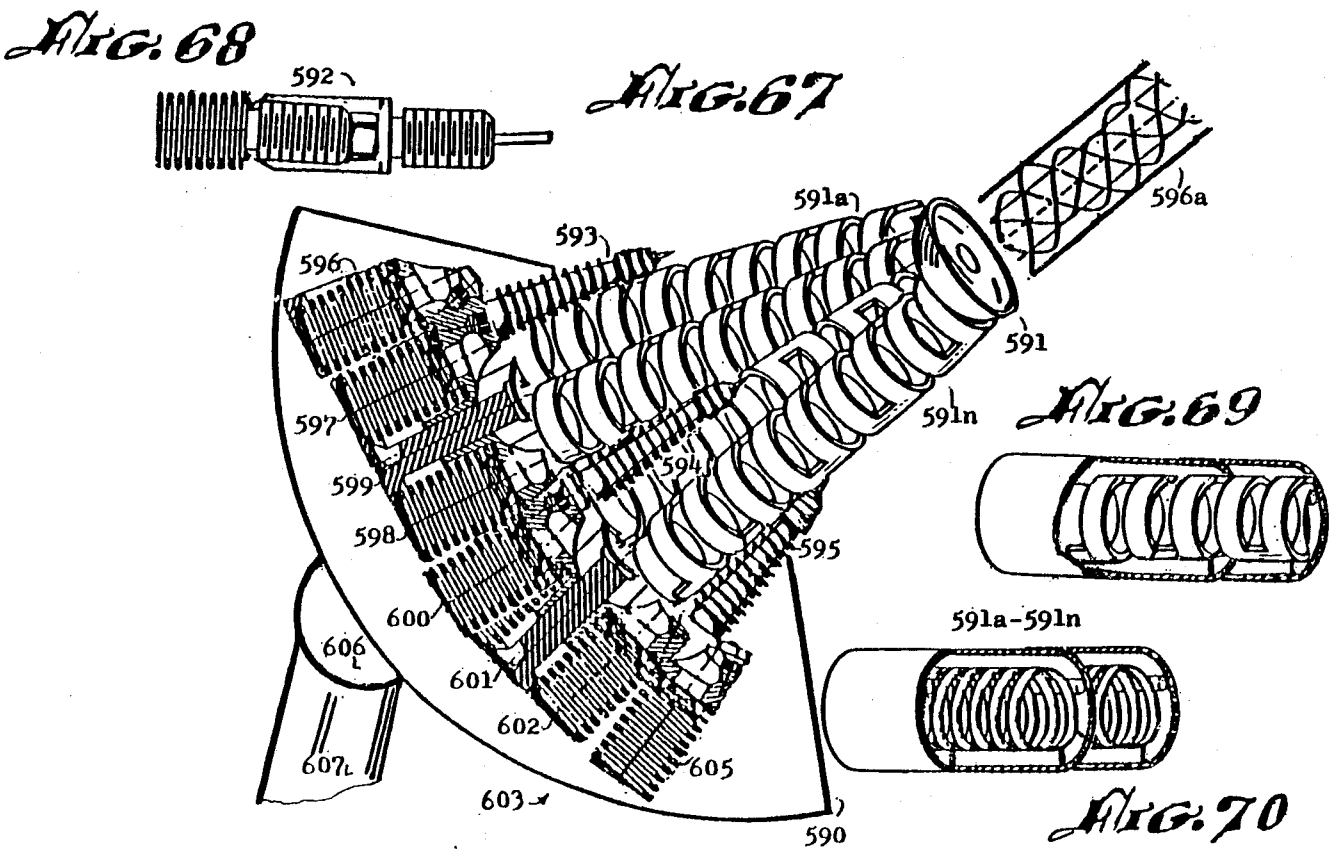
FIGS. 67 to 70 are detailed partially sectioned views of one of several radiofrequency means generating high frequency electrical charges and/or localized thermal gradients.

FIG. 67 is a detailed partially sectioned perspective of one of several radiofrequency means generating high frequency electrical charges and or localized thermal gradients circumferentially along the transector barrel means. An emission schematically defined by number 596*a*, the centroid dish by element 590 which assist to collimate the source emissions generated and channeled through a series of wave guides which are described collectively by numeral 591. Numerals 591*a* through 591*n* are equivalent wave guide means arranged in a specific geometric manner as to project a tight beam emission. Elements 593, 594 and 595 designate separate and distinct r.f. coils each of which having distinct termine located along the central axis of each separate and distinct waveguide.

FIG. 68 discloses a detailed partially sectioned view of a single radiofrequency coil, numeral 592 with an extended terminus. Element 592 is equivalent to radiofrequency elements 593, 594 and 595 previously disclosed in FIG. 14. Numerals 599, 601 of FIG. 14 denote internal guide or internal support structure means for parabolic dish 603. Elements 596, 597, 598, 600, 602 and 605 denotes separate charging coils for the radiofrequency coil means. Numeral 606 describes a single articulating socket joint means which is located inbetween support column 607 and dish means 603 giving a configuration which allows a 360 degree rotational frame in three dimension when motivated by solenoid means or some other automated means, not shown.

FIGS. 69, 70 describe in detail wave guide means 591*a* through 591*n* previously disclosed in FIG. 67.

Figure 71:
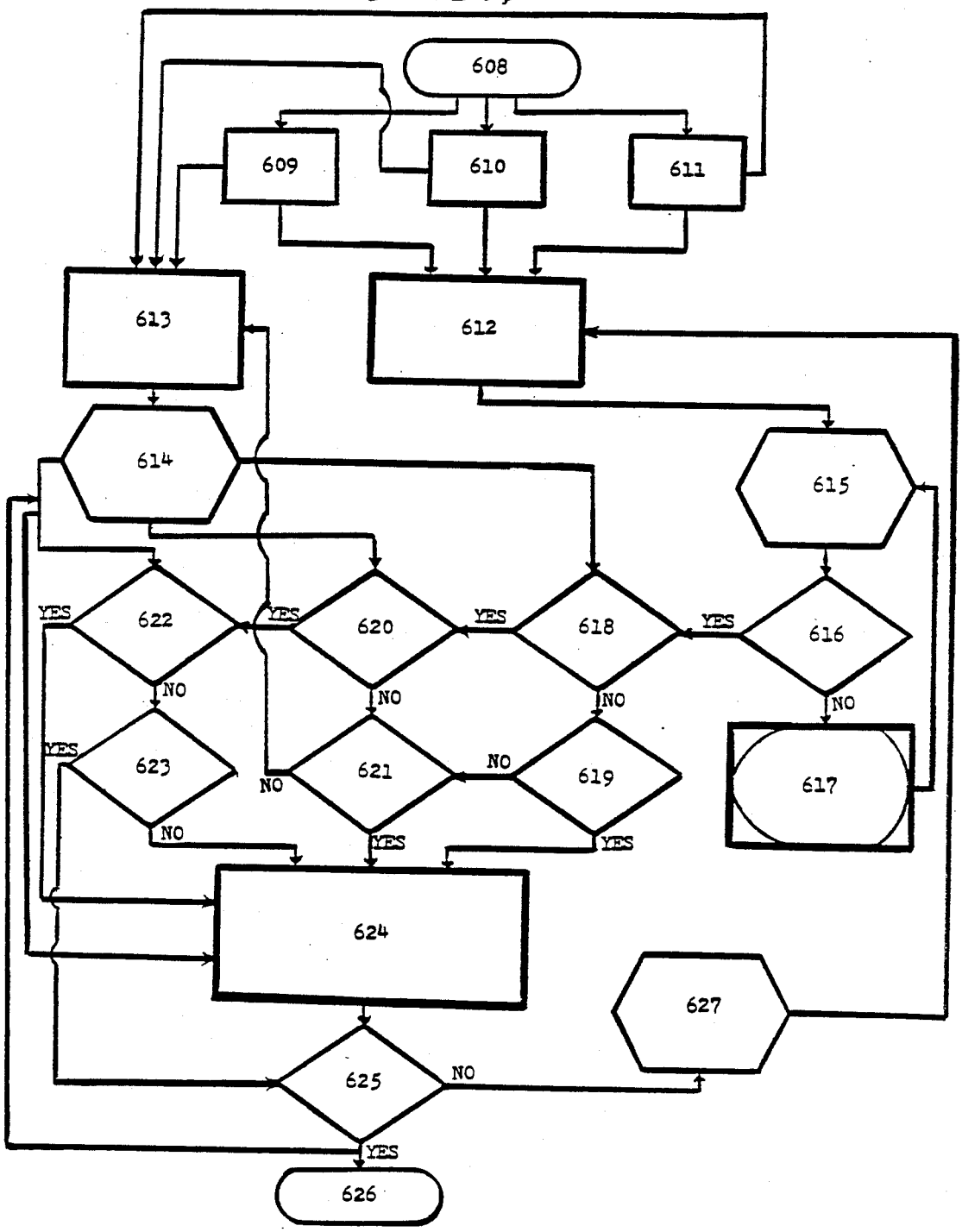
FIG. 71 is a flow chart for the programming of the radiofrequency means described in FIG. 67.

FIG. 71 is a concise flow chart for the programming of the radiofrequency means described in FIG. 67. The numeric value 608 defines the user actuated start sequence which re-enlists the laser designator means, an acoustical piezoelectric contact element and GSR/temperature contact sensors reassigned values 609, 610 and 611. Data provided by means 609, 610 and 611 is channeled to both elements 612, 613, respectively. Numeral 613 denotes an accumulator means wherein the designated individuals cardiac output, respiration, galvanic skin response, body temperature and the like are compiled to be acted upon by subprogram 614. The power discharge level, frequency, pulse shape, duration and other parameters are selected for by the user, as indicated by element 612. The administration of radiofrequency emissions and subsequent engagement of specified target areas is exacted by process 615. Decision process 616 determines whether or not given target areas or regions are engaged. If a target region is engaged, then decision process 618 is enlisted; and if a negative response is elicited, then a search process is instituted; wherein the current status is displayed by subprogram 617, which acts to return to process 615 wherein new parameters are selected by the user via number 612. Numeral 618 establishes whether or not the cardiac parameters correspond with those norms construed to be either equal to or less than the maximum tolerance level. If the cardiac output is either equal to or less than the established physiological maximums then decision process 620 is enlisted, if not decision process 169 is engaged. Decision process 619 determines whether or not the maximum limit for cardiac output has indeed been exceeded and if so subprogram 624 is engaged, if not decision 621 is enlisted. Element 620 determines whether or not respiratory parameters are obtained from the designated individuals and are either equal to or less than preprogrammed values construed to be the maximum tolerance levels for respiratory output. If the aforementioned respiratory values correspond to the said preprogrammed values then decision process 622 is engaged; if the said values do not correspond, then decision process 621 is enlisted. If it is determined that the respiratory output exceeds the maximum tolerance values then process 624 is engaged. Process 622 determines whether or not the maximum tolerance values for body temperature, galvanic skin response and the like correspond to the established values. If an affirmative answer is enlisted by element 622 then process 625 is enlisted; if however a negative response is indicated, then decision process 623 is engaged. Decision process 623 determines whether or not the maximum tolerance parameters of process 622 are exceeded or not if the said values are exceeded; then process 624 is enlisted, if not process 625 is enlisted. It is in process 624 whereby a subprogram recalibrates, resets if needed all values and temporarily terminates the on running program to display the current status to the user and to return to the user for further instructions, unless specified not to, as indicated by element 615. Decision process 625 ascertains whether or not all instructions have been executed by the system. If it is established that all instructions have been executed by process 625 then the program is terminated, as described by process 626. If however, all instructions have not been executed as determined by element 625, then system enters a subroutine wherein the information is displayed to the user, as indicated by element 627 and then is readied for receiving new instructions from the user.

Figure 72:
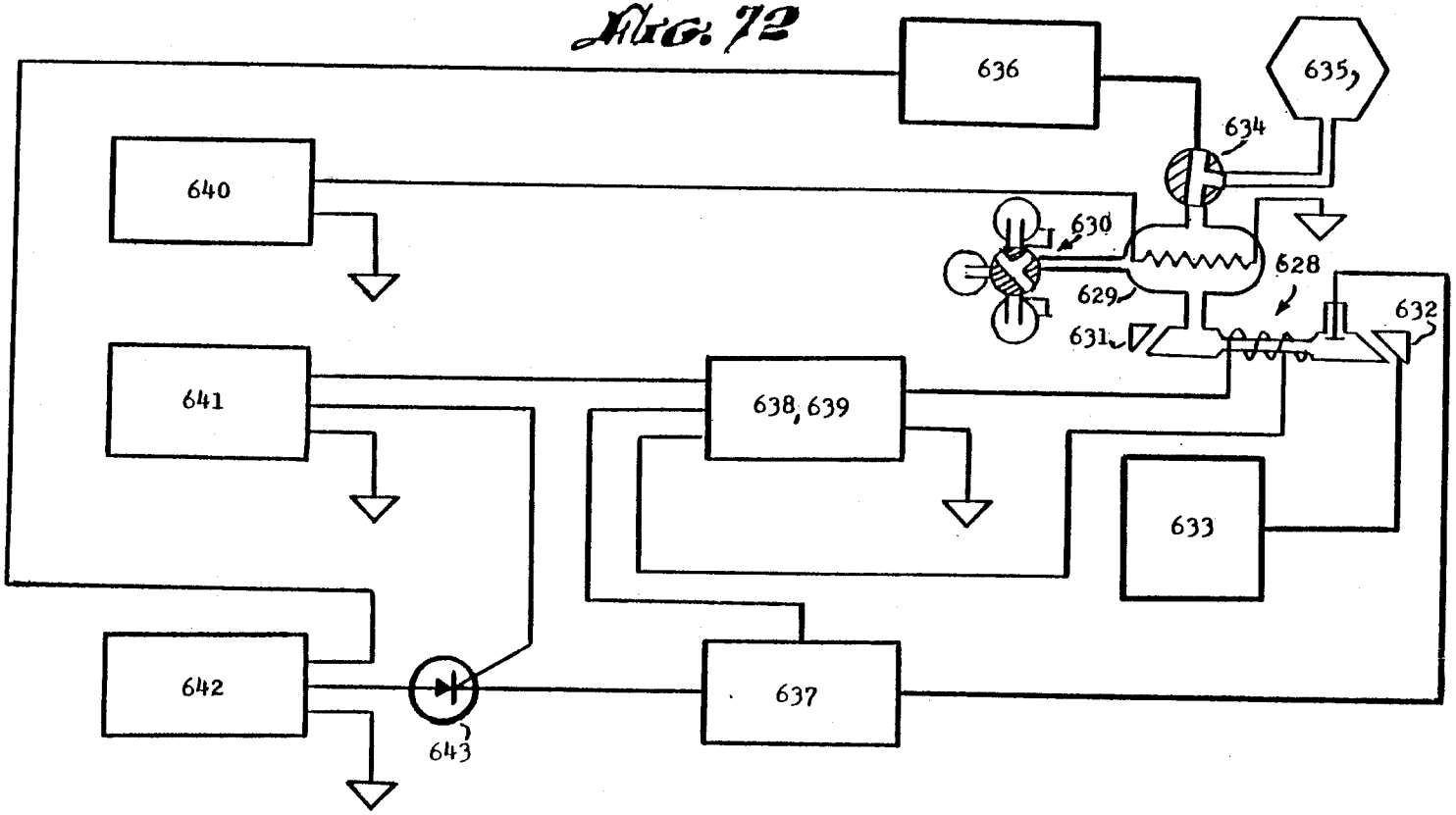
FIG. 72 is a simplified block diagram describing in part the basic operative subsystem of the laser emission means.

FIG. 72 is a simplified block diagram describing in part the basic operative subsystem of the laser emission means. A simple plasma laser generator means is indicated in FIG. 16 rather than a ruby type, chemical laser, or other suitable coherent light generating means. Numerals 628, 629 and 630 disclose the resonant cavity, the fracture resistant quartz plasma containment jacket and discharge vessel. Numerals 631, 632 and 633 represent a totally reflective prismatic mirror, a selectively emissive automated mirror and the control circuit for the same said automated mirror means. Elements 634, 635 and 636 designates an automated inlet valve or governor means for controlling the flow of plasma during the recharging cycle, a plasma reservoir containing a suitable lasing medium under pressure and a controller element utilized to regulate the release of the lasing medium and its pressure within the plasma jacket. Numerals 637, 638 and 639 are delegated to a radiofrequency element to provide additional excitation for enhanced lasing and additionally an ancillary circuitry concerned with pulse shaping formation. Units 640, 641 and 642 are assigned to the filament supply, timing circuits and power supply, respectively. Element 643 signifies a SCR means.

Figure 73:
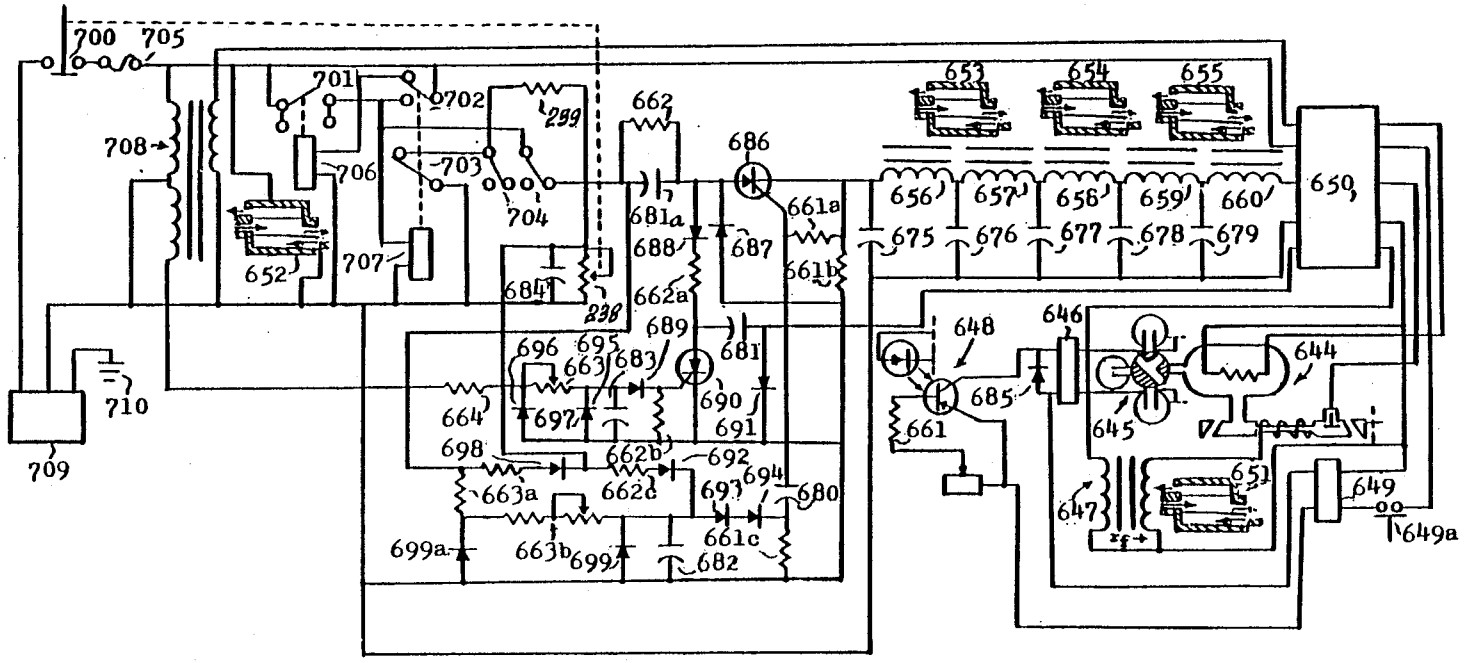
FIG. 73 is a simplified electronic circuit schematic and block diagram of the emissive laser means.

FIG. 73 is a simplified electrical schematic of a single plasma laser source generator unit. Numerals 644, 645 and 646, 647 of FIG. 73 designates the plasma ion laser generator, a valvular control governor, solenoid gas pressure valve and radiofrequency excitor means. Number 648 is collectively assigned a light emitting sensor complex utilized to detect and respond to the concentration of gaseous plasma which is contained in a given reservoir. Elements 649, 649*a* define an automated control mechanism governing the release of gas plasma from the reservoir and a manual release switch gasifier means. The central control microcomputer 650 is utilized for timing electrical impulses, sequencings of electrical impulses and the delivery or distribution of impulses to various points of junctures. Heat exchanger means are utilized to conduct thermal energy away from circuits, inductive elements and the like and are designated by values 651 to 655, inclusive. Numerals 656 through 660 are assigned to inductive elements taken in series. The resistive elements of the circuit are defined by numerals 661 through 664; whereas the capacitance elements are defined by element 675 through 684. The diode elements of the circuit diagram are indicated by numerals 685 through 699. Numerals 700, 701, 702, 703 and 704 designate switching elements for the standby and operative modes, inclusive. Numerals 705, 706 and 707 defines a fuse element and two guardian elements utilized to protect or shield the circuit. Elements 708, 709 and 710 are assigned to a transformer means, a power source and ground means.

Figures 74, 75:
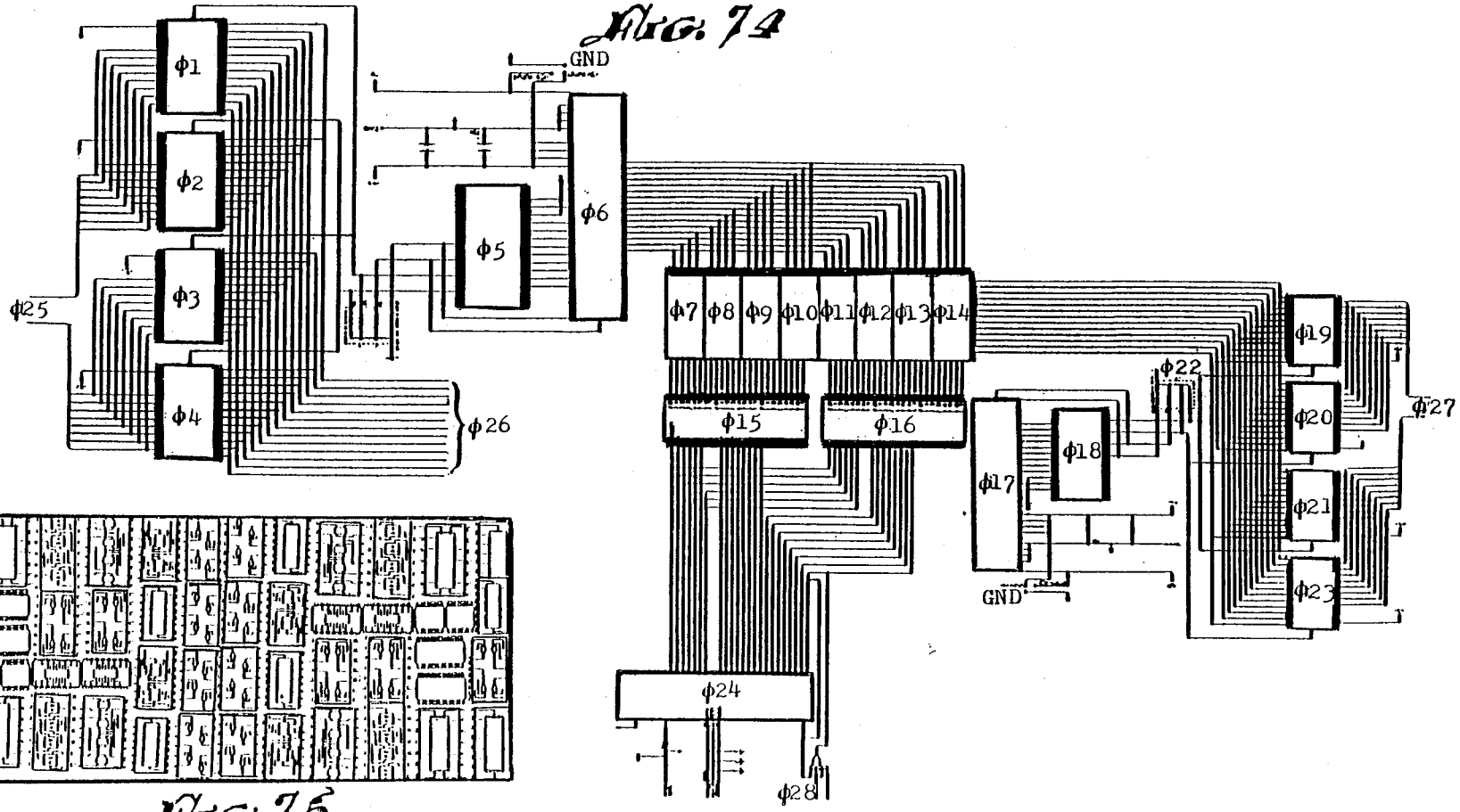
FIGS. 74, 75 discloses a portion of the repetitive logic circuit forming the basis of the microcomputer means imprinted on the insertable VHSIC card.

FIGS. 74, 75 discloses a portion of the repetitive logic circuit forming the basis of the microcomputer means which is etched or imprinted on one of several equivalent insertable VHSI cards. Here the vital portion of the circuit which is shown is equivalent to a multitude of similar such circuitry utilizing VLSI/VHSIC technology. The separate I.C. elements are so constructed as to be repetitive providing a reliable microcomputer with an increased ability to calculate and implement information, acquisition, the dissimination of data, the calculations of pursuit vectors, the administration of various aforementioned functions and their related parameters. The I.C.'s are disposed on a single portion of the VLSI card which is replaceable in and of itself as well as each of the microminiature integrated circuit means or modules. Each integrated circuit is designated by its own alphanumeric value and there are twenty-four I.C.'s depicted in the figure herein. The I.C.'s are listed by element Ø7 through Ø6 acting as interrogator means for logic elements Ø1 through Ø14. Comparator means for data are indicated in part by elements Ø1 through Ø4 and elements Ø19 through Ø23. Alphanumeric values Ø25, Ø26, Ø27 and Ø28 are indicative of origins of embarkation wherein data either enters from other circuits or leaves from portions or the circuit, as depicted in FIG. 74 and is for other circuits. The other portions of the partial circuit diagram depicting capacitors, grid means, resistive elements and the like are straight forward to one skilled in the art and therefore are not assigned any alphanumeric value.

Figure 76:
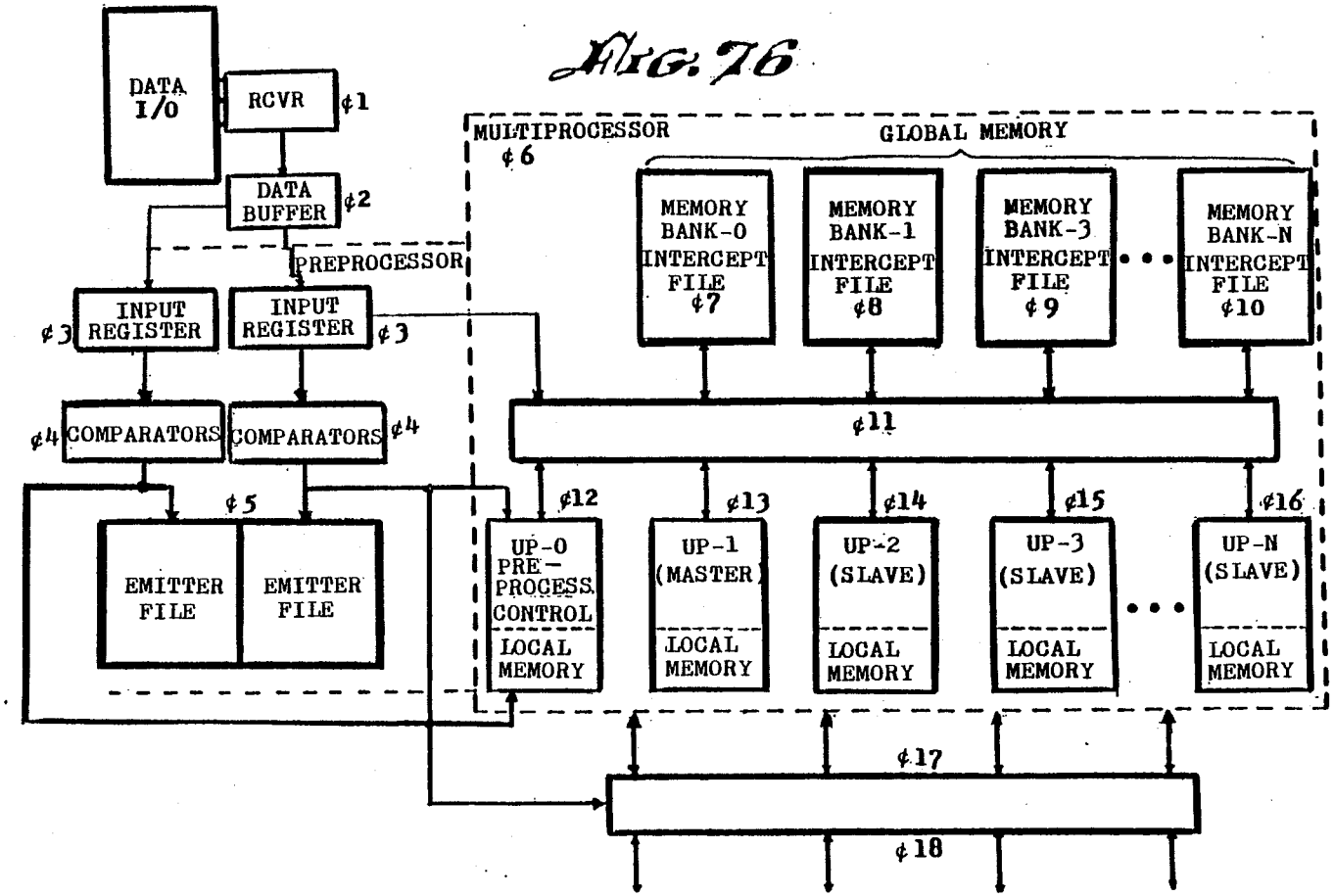
FIG. 76 entails a block diagram schematically illustrating in brief the operations of a global memory system.

FIG. 76 entails a simplified schematic block diagram illustrating in brief the operations of a global memory system. The simplified block diagram described in FIG. 76 illustrates in an exemplary fashion a microcomputer array processor element disposited on a single VHSIC card. Information is received and encoded by element ¢1, which sends the data to be buffered by ¢2. The data obtained from ¢2 is then conveyed to a series of serial input registers, as denoted by element ¢3. The data from ¢3 is sent to a comparator bank described by ¢4 which either processes the data by sending it to an emitter file ¢5, or to a series of interrogator circuits. The microcomputer array processor means is designated by value ¢6, which is contained within the embodiment of elements that are defined by a series of memory bank elements and intercept files, denoted by elements ¢7 through ¢10; wherein element ¢10 is a memory bank consisting of a number of subelements carried out to some desired element and all of the elements, ¢7 through ¢10 form what is losely known as a global memory. Element ¢11 forms a typical memory request logic interrogator means and elements ¢12 through ¢16 form a preprocessor control local memory interrogator, a master control local memory and a series of slave memories with EEPROM capabilities. The processed data and preprocessed data are both entered directly into the systems computer controller means, as defined by embarkation point ¢17 and ¢18.

Embodied within the structure of the global memory system are integrated circuits or microprocessors which are responsible for manipulating the data fed into the microcomputer, in accordance with the operative set of instructions provided here by the user. The instructions are keyed by the user and are provided within the operative framework of a digitized list or sequence, forming a program which is encoded and stored into the memory elements of the microcomputer. Each instructional element of a sequence of instructions consists of a specified number of bits averaging 256 bits of information, which is stored in one or more registers collectively called a memory address. The number of addresses of instruction sequences to be employed by the system is stored in order to form the proper sequence in a program counter. A controller means usually receives the address of the new set of instructions from the program counter which obtains the digitized data stored in the aforementioned memory address and transfers the said data to the instruction register. The way by which data is conveyed is by three separate and distinct communication channels as designated by the, address bus, the control bus and the data bus, respectively. The instructional address placed in the program counter is entered in the address bus, which readies the storage means to yield or transmit the instructional data. A digitized signal or electrical impulse on the control bus enables the data to be transferred to the data bus means. An additional control signal conveyed to the instruction register is held while the controller means decodes it and issues further digitized control signals to perform the given set of instructions. The instructions pertain to data stored in the data buffer and may be initiated by either some input device or in and from the memory. If the instructions perform a given operation the results of the said operation may be stored temporarily in the accumulator means; wherein upon completion of the same said operation the results are sent back to the specified memory address. The ALO and accumulator means are associated with a set of condition codes also known as flags, which function as single bit registers with each unit indicating something about the results about a given operation held in the accumulating means. When subprograms and frequent subroutines are embodied within a given program, which requires several instructions in the same sequence that are conveyed to adjacent memory addresses, collectively defined as a stack means. Said stack enhances the speeds in a given operation. The memory addresses forming the stack are separately addressed as if only a single memory location and the address accessed is stored in a means defined as the stack pointer. The stack pointer functions in a specific fashion as to allow the controller to use only a single address to call for the entire stack.

Figure 76A:
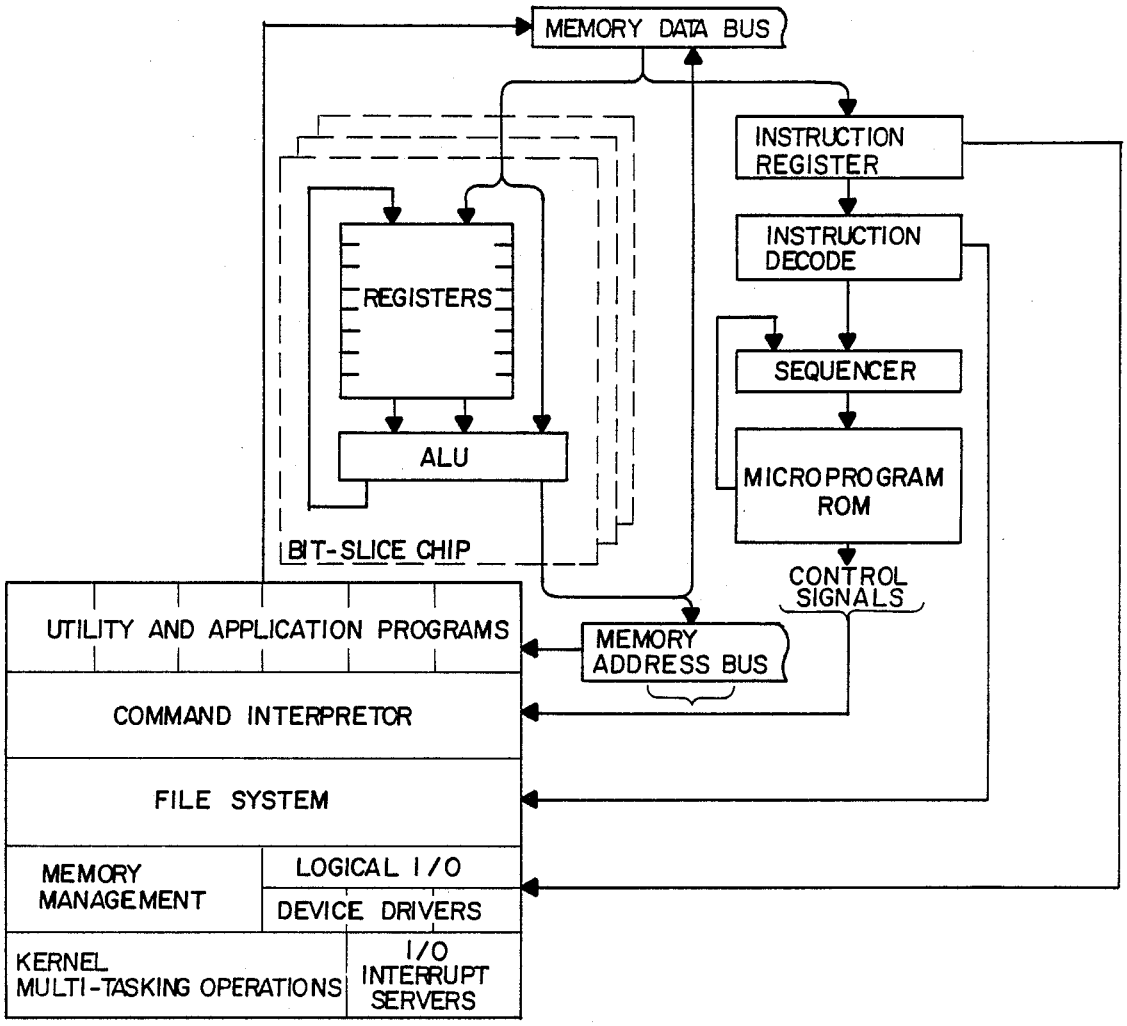
Figure 76B:
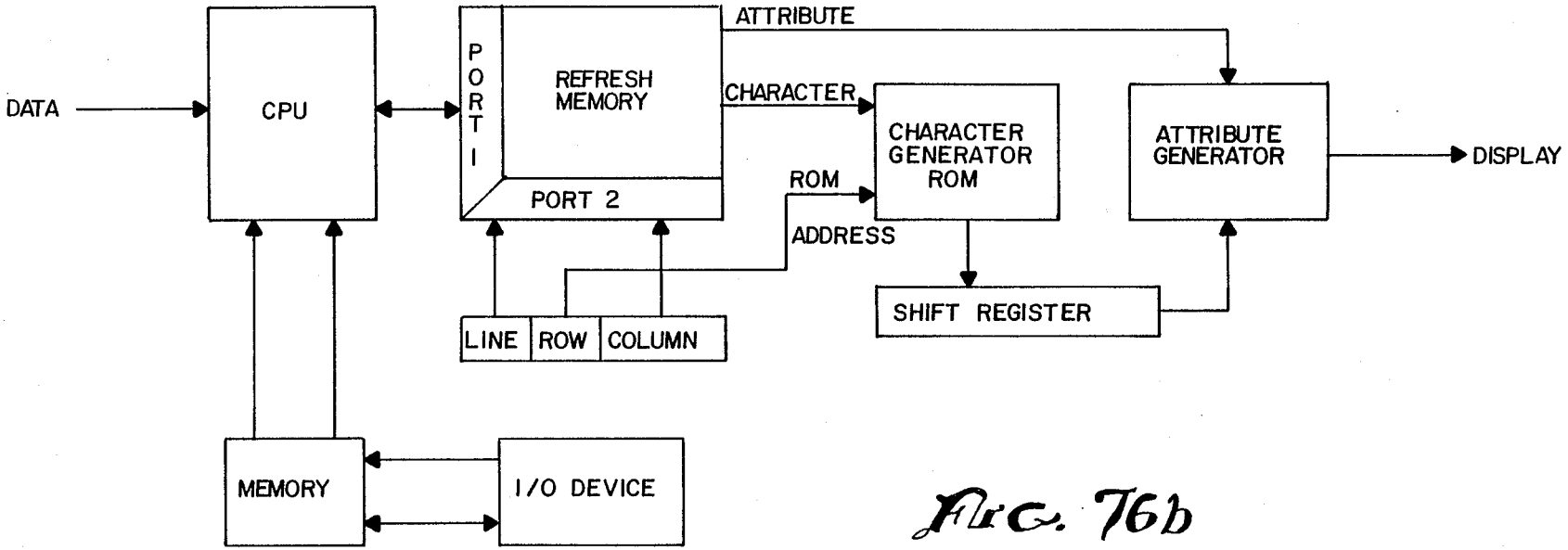

A series of other ancillary registers known as general purpose registers, which are used as required. The ancillary resistors have or consist of a exact finite number of registor elements n, beginning with an accumulator and ending with a high order byte register and a lower order byte register means. Other means are disposed in the form of external connections including, a clock, power supply, data input/output means, analog/digital converters and other means. The CPU is implemented with secondary memory devices, which are defined by such means as read only memories (ROM's). Random access memories (RAM), charged coupled devices (CCD's) or other equivalent means embodied within such means as I.C.'s are etched or imprinted on a card along with the microprocessor. The above aforementioned operations of the central processing unit CPU and how the CPU transfers data are illustrated schematically by FIGS. 76*a*, 76*b*. Numeric values are not assigned to the elements in the figures because each element is clearly defined and straight forward, consistant with the operation of conventional computer systems.

FIG. 77 describes in part a combination circuit and block diagram schematically illustrating the operation of one of several equivalent electro-optical systems embodied within the transector device. Optical electronic analog/digital converter feedback units are typically employed by the transector means for sensory updates, scans, target pursuit and other processes. Alphanumeric values are assigned to each subsystem in order to more clearly define a few basic component systems of an array. Elements £ 1, £ 2 and £ 3 are indicative of the optical electronic sensory array, optical electronic encoder and analog/digital interfacing and keying means. Alphanumeric values £ 4, £ 5 and £ 6 through £ 10 designates an array selectors and a full complement of input storage buffers. Elements £ 11, £ 12 and £ 13 through £ 15 denotes a clock/timing means, column drivers and display terminals. Element £ 16 collectively describes a VLSI chip containing data input transfer means, a column selector, comparator encoder/decoder signal out flow means, respectively. Element £ 17, £ 18, £ 19 and £ 20 designate a voltage to frequency converter, a monopulse multivibrator drive means and a line driver receiver bidirectional means.

FIG. 78 illustrates in a simplified schematic fashion imparts the mechanism by which the user keys the various functions of the transector device. Numerals 711, 712 and 713 of FIG. 78 define interfacing elements such as, a single element multiple function key pad, a bidirectional piezoelectric system and a rotating selector means. Numerals 714, 715 designates input circuits for manual manipulator means 711, 712 and acoustical piezoelectric means 713. Element 716 is collectively assigned to the CPU means, CPU element 716 inputs directly onto elements 717, 718 and 720. Element 720 is a digit multiplexer means. Element 718 entails an IC means governing the display of data. Element 717 defines a speech synthesizer means with bidirectional capacity. Element 719 denotes a bidirectional relay circuit providing input/output flow or accessibility between element 717 and 718. Numerals 721, 722 and 723 are assigned to an ancillary clock means, the display driver (enable) and display means. Numerals 724, 725 and 726 are indicative of embarkation points; wherein data is exchanged between the CPU and other systems, a bidirectional point whereby data is conveyed from means 717, 719 for analysis and processed by speech recognition systems and output lines leading to the alphanumeric display means 723.

FIG. 79 defines a simplified electrical schematic designating a portion of the circuitry involved in keying the interactive screen, holographic, acoustical elements and the like systems associated with the devices operation. Numerals 727 of FIG. 22 is collectively assigned to manual keying elements which are manipulated by the user to insert, recall, or modify data. All signals retrieved from duel or tri-function keying elements are essentially processed by a signal digitizer and encoder means defined by element 728. Numerals 729 designates a signal encoder/processing means to relay data derived from a radial selector knob mechanism and/or a light wand means. Numbers 730, 731 and 732 are points of entry for data generated by interactive systems such as, an electro-optical video, a radial selector means and supplemental LCD touch unit. The entry and exit point defined by value 733 corresponds to circuitry concerned with voice recognition and synthesis. Integrated circuits 734, 735, 736 and 737 act as comparators and interrogators for LSI circuit 738. Other integrated circuits 739, 740 and 741 serve higher order functions and additional data signals are exchanged at points 742, 743. Resistive element, grounds and the like are straight forward and are unnumbered for the sake of simplicity.

A military version of the transector unit was similarily constructed with the same basic structural and operative functions of the said devices, but differing in the intensity of parameters and the type of projectiles delivered to designated targets. Multistage armor piercing kinetic energy projectile and miniature projectiles delivering explosive clusters where constructed for the transector unit. The multistage armor piercing projectiles are initially launched from the barrel of the transector device by compressed gases or an equivalent low velocity propellant. Once the armor piercing projectile exits the barrel of the device, a secondary high velocity propulsion system is actuated when the projectile is in flight. The secondary or second stage propellant system is calculated to cut in or be actuated a safe distance away from the user and the initial launch site in order to eliminate the near crushing recoil or danger of incineration caused upon actuating the high velocity propellant system. The secondary propulsive means consists of but is not limited to, the ignition of liquid oxygen and hydrogen to form water vapor, various military grade glycernated plastic explosives and liquified hydrazine in the presences of a suitable reactant. Completed herein below is partial list of materials presented in a tabular form, assessed to be either an explosive means, propellant means, or precursor of each thereof and the mechanism by which said means and the like undergoes modification therein.

A closed-loop servomechanism

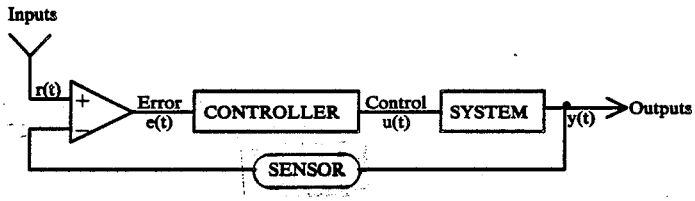

A more general closed-loop controller

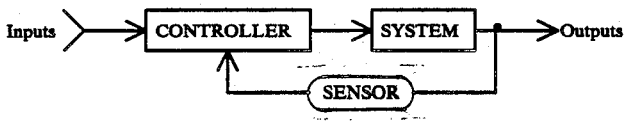

TABULAR FORMAT (P) ITAR AS PER U. S. GOVERNMENT ASSIGNMENT

Military explosives, propellants, and pyrotechnics, and constituents and precursors thereof, as follows:

1. Guanidine nitrate
2. 2,4,6 trinitroresorcinol (styphnic acid)
3. 1,3,5 trichlorobenzene
4. 1,2,4-outanetriol (1,2,4 trihydroxybutane)
5. Bis(chloromethyl)oxetane for bis(azidomethyl)-oxetane
6. Polynitroorthocarbonates Military explosives, propellants, and pyrotechnics, and constituents and precursors which are substances and mixtures that contain more than 2%, alone or in combination, of the following:

1. Nitrocellulose with nitrogen content of over 12.2%
2. Spherical aluminum powder with uniform particle size and an aluminum content of 97% or more
3 Metal fuels in particle sizes less than 500 microns, whether spherical, atomized, spheroidal, flaked, or ground, consisting of 97% or more of any of the following: lithium, magnesium, zirconium (ECCN 3604A), titanium, uranium, tungsten, boron, magnesium, zinc, and alloys of these; misch metal; fine iron powder (1–3 microns) produced by reduction of iron oxide by hydrogen
4. Triethylaluminum (TEA), trimethylaluminum (TMA), and other pyrophoric metal alkyls and aryls of lithium, sodium, magnesium, zinc, and boron
5. Potassium nitrate or other oxidizers (such as perchlorates, chlorates, and chromates) composited with powdered metal or other high energy fuel components
6. Nitroguanidine (NQ)
7. Compounds composed of fluorine and one or more of the following: other halogens, oxygen, nitrogen
8. Hydrazine in concentrations of 70% or more; hydrazine nitrate; hydrazine perchlorates; unsymmetrical dimethylhydrazine; monomethylhydrazine; and symmetrical dimethylhydrazine
9. Carboranes: decaborane; pentaborane and derivatives
10. Ammonium perchlorate
11. Cyclotetramethylenetetranitramine (HMX); octahydro-1,3,5,7-tetranitro-1,3,5,7-tetrazacycloctane; oktogen; octogene
12. Cyclotrimethylenetrinitramine (RDX); cyclonite; hexahydro-1,3,5-trinitro-1,3,5, triazine; 1,3,5-trinitro-1,3,5-triazacyclo- -continued

TABULAR FORMAT (P) ITAR AS PER U. S. GOVERNMENT ASSIGNMENT hexane; hexogen; hexogene
13. Nitroglycerin (or glyceroltrinitrate, trinitroglycerin) (NG)
14. 2,4,6-trinitrotoluene (TNT)
15. Hexanitrostilbene (HNS)
16. Diaminotrinitrobenzene (DATB)
17. Triaminotrinitrobenzene (TATB)
18. Triaminoguanidinenitrate (TAGN)
19. Any explosive with a crystal density greater than 1.8 g/ml and composed of compounds of carbon, hydrogen, nitrogen, and oxygen or fluorine
20. Any explosive with a detonation velocity greater than 8,700 m/s or a detonation pressure greater than 340 kilobars
21. Ethylenediaminedinitrate (EDDN)
22. Pentaerythritoltetranitrate (PETN)
23. Lead azide, normal and basic lead styphnate, and primary explosives or priming compositions containing azides or azide complexes
24. Other organic high explosives yielding detonation pressure of 250 kilobars or greater that will remain stable at temperatures of 250° C. or higher for periods of 5 minutes or longer
25. Boron hydrides (ECCN 1715A); titanium subhydride of stoichiometry $TiH_{.65-1.68}$
26. Hydroxylammonium nitrate (HAN); hydroxylammonium perchlorate (HAP)

Military explosive, propellant, and pyrotechnic constituent and precursor additives, such as:

1. Glycidylazide polymer (GAP)
2. Polycyanodifluoraminoethyloxide (PCD)
3. Trimethylolethanetrinitrate (TMETM); metrioltrinitrate (MTN)
4. Triethyleneglycoldinitrate (TEGDN)
5. Butanetrioltrinitrate (BTTN)
6. Bis-2-fluoro-2,2-dinitroethylformal (TEFO)
7. Butadienenitrileoxide (BNO)
8. 1-vinyl-2-pyrrolidinone; 1-methyl-2-pyrrolidinone
9. Dioctylmaleate
10. Ethylhexylacrylate
11. Catocene
12. 2,2-dinitropropanol
13. Bis(2,2-dinitropropyl) formal and acetal
14. 3-nitraza-1,5-pentane diisocyanate
15. Basic copper salicylate; lead salicylate
16. Lead beta-resorcylate
17. Lesd stannate; lead maleate; lead citrate
18. Monomers and polymers containing energetic nitro, azido, nitrato, or nitrazo groups Military explosive, propellant, and pyrotechnic constituent and precursor stabilizers, including:

1. Ethyl and methyl centralites
2. N,N—diphenylurea (unsymmetrical diphenylurea)

-continued

| TABULAR FORMAT (P) ITAR AS PER U. S. GOVERNMENT ASSIGNMENT | |
|---|---|
| 3. | Methyl-N,N—diphenylurea (methyl unsymmetrical diphenylurea) |
| 4. | Ethyl-N,N—diphenylurea (ethyl unsymmetrical diphenylurea |
| 5. | 2-Nitrodiphenylamine 2NDPA |
| 6. | p-Nitromethylaniline; N—methylparanitroaniline |
| 7. | 4-Nitrodiphenylamine (4NDPA) |

The armor piercing projectile itself is formed from a variety of materials including but not limited to synthetic diamond based composites, expended fissiles materials such as U238, silicon nitride based ceramics. At a limited range of between 300 and 600 meters such projectiles have developed sufficient velocity to penetrate four to six inches of hardened alloy steel. The portion of armored material upon penetration by a kinetic energy projectile is converted into an energetic molten metal, which exits the obverse of the point of initial penetration as a high velocity plasma like spray. The armor piercing projectiles is especially effective against tanks, armored vehicles or other reinforced, or fortified structures. Projectiles containing miniature clusters of explosives, fragments and/or incindraries are effective against anti-personel devices in the open field at a range of 500 meters. Therefore, the only differences between the military version of the transector device and the form of the transector device displayed in civilian operation are restricted to the types of projectile dispersed from the said device and the operative parameters contained within the said devices programmable functions.

FIG. 80 is a pictorial representation briefly illustrating the delivery of a kinetic energy projectile dispersed from the user based transector device. The kinetic energy projectile, number 744, is dispatched from the transector device, number 745, by programming initiated by the user. The said projectile 744 is dispatched initially from the aforementioned transector device by the thrust supplied by the release of compressed air or the detonation of a liquid or solid propellant charge. Once the kinetic energy projectile has traveled a specified distance from its initial launch point, usually four to ten meters, the secondary propulsion system is actuated, as indicated by numeral 746. Maximum velocity is usually achieved within about one hundredth of a second after the initial launch of the kinetic energy projectile. As mentioned previously, the secondary propulsive means is actuated a distance from the user based transector device because of the enormous recoil and intense heat generated by the secondary propulsion system. Special formulations of liquid hydrogen, oxygen, hydrazine, explosive plastic gels are suitable propulsive means. The impact of kinetic energy projectile 744 onto a specified portion of a hardened structure is indicated by numeral 747. Reinforced concrete will be reduced to powder occasionally fragmetize and produces sparks due to friction throughout a linear section wherein impact occurs. Metallic structures upon impact with said kinetic energy projectiles are reduced to a pressurized stream or spray of molten white hot metal. The effects on reinforced structures or armor plating of kinetic energy type projectile is well documented by classified and unclassified reports received from the DOD, American military and various member nations of NATO (specifically the French and British governments). A partially sectioned perspective of two types of kinetic energy projectiles are depicted in the forgoing.

FIGS. 80a, 80b disclose sectioned views of unit 744 a precision guided munition equivalent to a SMART system. Numerals 744a, 744b and 744c designate the armor piercing tip, a cartridge containing a suitable hypervelocity propellant and a secondary automated ignition system. The armor piercing projectile are composed of materials containing but not limited to silicon carbide, silicon nitride expended uranium or other suitable materials. The solid propellant means consists but is not limited to a shock resistant explosive glycerated gel, a class of exergonic chemical powders, chemical reactants/oxidants, or any suitable propulsive mediums. The liquified reactant and oxidant means are indicated by numerals 744d, 744e. Numerals 744f, 744g, 744h and 744i designate separate housing chambers for the reactant and oxidant means, the outer casing structure and a reaction vessel for the combustion of the reactant in the presences of the said oxidant. Numeral 744c defines a secondary electronic ignition system providing the initial means; whereby a spark ruptures a portion of 744d and 744e allows contents of each to enter reaction vessel 744i and subsequently igniting the reactant oxidant mixture therein. Once an armored or fortified structures are penetrated by one or more kinetic energy projectiles, then designated targets may be reached with additional projectiles carrying volatiles or other suitable materials. Said projectiles carry one or more miniature explosives or elements which undergo fragmentation upon impact, such means were constructed, implemented and delivered by a modified transector unit. The said explosive or fragmentation projectiles conformed to the design and operation of similar such means already in use by the military and therefore have not been discussed to any large extent. The subsequent implementation of the transector device's projectile system with an autonomous miniature precision guided means necessitated the incorporation of a subminiature internal guidance system, steering means and a VLSI, CPU; briefly indicated by elements 744j, 744k and 744l, 744m respectively, allowing the aforementioned projectile means to function autonomously once it is in the launch mode. Unit 744 is a precision guided munition corresponding to a SMART system.

MATHEMATICAL EQUATIONS AND FORMULAS RELATED TO THE OPERATION OF THE INVENTION

The complexing of volatiles and penetrator substances to form a carrier mediated volatile mixture. Complexing occurs in the mixing chamber as stated earlier in the specifications. Let the volatile substance consists of a mixture of stable chemical species A, B, C and D and the penetrator substance be composed of chemical species L, M and N which are initially in a state of chemical equilibrium at temperature T and pressure P, such that all species are related by two independent reactions as described in brief herein below:

$$^{v}A_1A+v_BB\rightleftharpoons v_CC+v_DD$$

$$^{v}A_2A+v_LL\rightleftharpoons v_MM+v_NN$$

wherein species A takes parts both of the said reaction. The stoichiometric coefficients differs from the number of moles present in the mixing chamber, the coefficients $V_A$, does not necessarily equal the coefficient VAZ and that species A contibution in each of the above reaction differs. Here A, B and L decrease in the number of moles; whereas there is a increase in the number of moles of species for C, D, M and N. The degrees of reaction for both reactions is described by $P_1$, $P_2$, respectively and once intermixed the changes in the number of moles are defined by infinitesimal shifts from equilibrium composition as follows:

$$dn_A = -\nu_{A1}dp_1 - \nu_{A2}dp_2$$

$$dn_B = -\nu_B dp_1$$

$$dn_B = -\nu_L dp_2$$

$$dn_C = +\nu_C dp_1$$

$$dn_D = +\nu_D dp_1$$

$$dn_M = +\nu_M dp_2$$

$$dn_N = +\nu_N dp_2$$

The changes in the Gibbs function for the mixture in the mixing at a constant temperature and pressure is:

$$dG_{T,P} = \overline{G}_A dn_A + \overline{G}_B dn_B + \overline{G}_C dn_C + \overline{G}_D dn_D + \overline{G}_L dn_L A + \overline{G}_M dn_M + \overline{G}_N dn_N$$

and upon substitution yeilds terms $$dG_{T,P} = (\nu_C\overline{G}_C + \nu_D\overline{G}_D - \nu_{A1}\overline{G}_A - \nu_B\overline{G}_B)dp_1 + (-\nu_M\overline{G}_M - \nu_N\overline{G}_N - \nu_{A2}\overline{G}_A - \nu_L\overline{G}_L)\, dp_2$$

It is considerably more convenient to express each of the partial molal Gibbs functions in terms of the relation $$\overline{G}_i = g_i^\circ + RT(y_iP/p^o)\ln$$

which yields $$dG_{T,P} =$$

$$\left[\Delta G_1^o + RT\ln\frac{y_C^{\nu C}y_D^{\nu D}}{y_A^{\nu A1}y_B^{\nu B}}\left(\frac{P}{p^o}\right)^{\nu C + \nu D - \nu A1 - \nu B}\right]dp_1 +$$

$$\left[\Delta G_2^o + RT\ln\frac{y_M^{\nu M}y_N^{\nu N}}{y_A^{\nu A2}y_L^{\nu L}}\left(\frac{P}{p^o}\right)^{\nu M + \nu N - \nu A2 - \nu L}\right]dp_2$$

the standard state change in the Gibbs function for each reaction is defined by $$\Delta G_1^\circ = \nu_C g_C^\circ + \nu_D g_D^\circ - \nu_{A1}g_A^\circ - \nu_B g_B^\circ$$

$$\Delta G_2^\circ = \nu_M g_M^\circ + \nu_N g_M^\circ - \nu_{A2}g_A^\circ - \nu_L g_L^\circ$$

The equilibrium constants for the two reactions can be defined by the expressions $$\ln K_1 = -\frac{\Delta G_1^o}{RT}$$

and $$\ln K_2 = -\frac{\Delta G_2^o}{RT}$$

with equilibrium achieved at some point in time described by the equations $$K_1 = \frac{y_C^{\nu C}y_D^{\nu D}}{y_A^{\nu a1}y_B^{\nu B}}\left(\frac{P}{P^o}\right)^{V_C + V_D - \nu_{A2} - \nu_B}$$

and $$K_2 = \frac{y_M^{\nu M}y_N^{\nu N}}{y_A^{\nu A2}y_L^{\nu L}}\left(\frac{P}{P^o}\right)^{\nu_M + \nu_N - \nu_{A2} - \nu_L}$$

wherein the equilibrium constants $k_1$ and $k_2$ are functions of temperature and the equilibrium equations must be solved simultaneously for the equilibrium composition of the said mixtures. Upon exiting the transector devices the carrier mediated volitile will eventually be administered to a designated target wherein disassociation will occur. Consider the disassociation of the diatomic species AB into a monoatomic species A,B as an oversimplification of two or more chemical species, a volatile and penetrator is complexed or temporarily combined to form a carrier mediated volatile. This is described now by the expression defined by equation $AB \rightleftarrows A + B$ where it is assumed the mixture behaves statistically as an ideal gas mixture composed of three components AB, A and B with the most probable distribution being described as follows:

Each species has its own set of energy levels $$\epsilon AB_1, \epsilon AB_2, \ldots, \epsilon AB_j$$

$$\epsilon A_1, \epsilon A_2, \ldots, \epsilon A_j$$

$$\epsilon B_1, \epsilon B_2, \ldots, \epsilon B_j$$

the values of each are fixed for a given system with volume V and having the corresponding degeneracy $$g_{AB1}, g_{AB2}, \ldots, g_{ABj}, g_{A1}, g_{A2}, \ldots, G_{Aj}, g_{B1}, g_{B2}, \ldots, g_{Bj}$$

A mixture composed of a definitive finite number of particles of each species $N_{AB}$, $N_A$, $N_B$ which are not necessarily in a single state of chemical equilibrium, but in a state of dynamic flux contained in some cohesive volume at temperature, T. The said particles are destributed across various energy levels with the distributor being specified by the number of particles of each species in each of the following energy levels $$N_{AB1}, N_{AB2}, \ldots, N_{ABj}$$

$$N_{A1}, N_{A2}, \ldots, N_{Aj}$$

$$N_{B1}, N_{B2}, \ldots, N_{Bj}$$

with restriction $$N_{AB} = \sum_{ABj} N_{ABj}$$

$$N_A = \sum_{Aj} N_{Aj}$$

$$N_B = \sum_{Bj} N_{Bj}$$

The thermodynamic probability u for the mixture for any given distribution of particles among the said energy level is defined by the expression $$w = (w_{AB})(w_A)(w_B) =$$

-continued $$\left(\prod_{AB_j} \frac{g_{AB_j}^{N_{AB_j}}}{N_{AB_j}}\right)\left(\prod_{B_j} \frac{g_{A_j}^{N_{A_j}}}{N_{A_j}}\right)\left(\prod_{B_j} \frac{g_{B_j}^{N_{B_j}}}{N_{B_j}}\right)$$

Since each state for a component A can either be associated with any state B or AB the statistical value u for the mixture is simply the product of those of the individual constituents, as in the preceding expression with the energy distribution expressed as $$U = \sum_{AB_j} N_{AB_j}\epsilon_{AB_j} + \sum_{A_j} N_{A_j}\epsilon_{A_j} + \sum_{B_j} N_{B_j}\epsilon_{B_j}\epsilon_{B_j}$$

with the most probable distribution for the system with a finite number of particles or species of each time and fixed energy of the system is more conveniently expressed in its logarithmic form $$\ln w = \sum_{AB_j} N_{AB_j}\ln\frac{g_{AB_j}}{N_{AB_j}} + \sum_{A_j} N_{A_j}\ln\frac{g_{A_j}}{N_{A_j}} + \sum_{B_j} N_{B_j} + \ln\frac{g_{B_j}}{N_{B_j}} + N_{AB} + N_A + N_B$$

with the most probable distribution having the maximum value u. Differentially the preceding equation and seting the result equal to zero one obtains $$d\ln w = -\sum_{AB_j}\ln\frac{N_{AB_j}}{g_{AB_j}}dN_{AB_j} - \sum_{A_j}\ln\frac{N_{A_j}}{g_{A_j}}dN_{A_j} - \sum_{B_j}\ln\frac{N_{B_j}}{g_{B_j}}dN_{B_j} = 0$$

which is subject to the constraints $$dN_{AB} = \sum_{AB_j} dN_{AB_j} = 0,\ dN_A = \sum_{A_j} dN_{A_j} = 0,\ dN_B = \sum_{B_j} dN_{B_j} = 0$$

$$dU = \sum_{AB_j}\epsilon_{AB_j}dN_{AB_j} + \sum_{A_j}\epsilon_{A_j}dN_{A_j} + \sum_{B_j}\epsilon_{B_j}dN_{B_j} = 0$$

However, if one utilizes the method of undetermined multipliers to find the most probable distribution the above aforementioned constraints can be multiplied by αAB, αA, αB and β respectively and upon summation and collecting terms the most probable distribution becomes $$\ln\frac{N_{AB_j}}{g_{AB_j}} + \alpha_{AB} + \beta\epsilon_{AB_j} = 0 \text{ for all } AB_j$$

$$\ln\frac{N_{A_j}}{g_{A_j}} + \alpha_A + \beta\epsilon_{A_j} = 0 \text{ for all } A_j$$

$$\ln\frac{N_{B_j}}{g_{B_j}} + \alpha_B + \beta\epsilon_{B_j} = 0 \text{ for all } B_j$$

If the expression $\beta = 1/kT$ is substituted into expression $$\ln\frac{N_{AB_j}}{g_{AB_j}} + \alpha_{AB} + \beta\epsilon_{AB_j} = 0 \text{ for all } AB_j$$

it can now be written in the form $$N_{AB_j} = g_{AB_j}e^{-\alpha_{AB}e^{-\epsilon_{AB_j}/kT}}.$$

Summing overall ABj the expression below is obtained $$N_{AB} = \sum_{AB_j} N_{AB_j} = e^{-\alpha_{AB}}\sum_{AB_j} e^{-\epsilon_{AB_j}/kT} = e^{-\alpha_{AB}}Z$$

wherein the partition function $Z_{AB}$ for the said substance AB is defined in the usual manner and the most probable distribution for $$\ln\frac{N_{AB_j}}{\epsilon_{AB_j}} + \alpha_{AB} + \beta\epsilon_{AB_j} = 0 \text{ for all } AB_j \text{ can be expressed as}$$

$$N_{AB_j} = \frac{N_{AB}}{Z_{AB}}g_{AB_j}e^{-\epsilon_{AB_j}/kT}$$

and by a equivalent procedure $$N_{A_j} = \frac{N_A}{Z_A}g_{A_j}e^{-\epsilon_{A_j}/kT}$$

$$N_{B_j} = \frac{N_B}{Z_B}g_{B_j}e^{-\epsilon_{B_j}/kT}$$

which expresses the most probable distribution of particles of various species among their respective energy levels for given $N_{AB}$, $N_A$, $N_B$ and U. By substituting the above aforementioned expressions into the equation $$\ln w = \sum_{AB_j} N_{AB_j}\ln\frac{g_{AB_j}}{N_{AB_j}} + \sum_{A_j} N_{A_j}\ln\frac{g_{A_j}}{N_{A_j}} + \sum_{B_j} N_{B_j}\ln\frac{g_{B_j}}{N_{B_j}} + N_{AB} + N_A + N_B$$

the thermodynamic probability for the so called most probable distribution is obtained by the following expression $$\ln wmp = N_{AB}\left[\ln\left(\frac{Z_{AB}}{N_{AB}}\right) + 1\right] + N_A\left[\ln\left(\frac{Z_A}{N_A}\right) + 1\right] + N_B\left[\ln\left(\frac{Z_B}{N_B}\right) + 1\right] + \frac{U}{kT}$$

The mixing process, distribution and the like for mixtures of carrier mediated volatiles is general and intentionally over simplified in a effort to give the user a good but incomplete operational definition of some of the processes.

Three separate and distinct classes or types of cryogenic carrier mediated volatiles were delivered by the transector device. The first class, type I, consisted of but was not limited to pressurized, liquified alcohols, ethers, or other suitable substances with low boiling points and rendered relatively inflammable by certain additives well known by those skilled in the art. Type I cryogenics readily absorb thermal energy from a specified region of a targeted individual, which subsequently undergoes immediate evaporation or vaporization; wherein said absorbed heat is dissipated or evolved in the vaporization process. A second class of carrier mediated volatiles of cryogenics, type II, consists of but are not limited to liquified natural gases, freon ($CBrF_3$, $CCl2F_2$), condensed carbon dioxide or other suitable substances. Type II cryogenic substances readily absorb energy and dissipates said energy by undergoing phase change expansion to increase the entropy and decrease the enthalpy of an effected region, lowering the temperature of the said region. Carbon dioxide undergoes sublimation expanding five to seven orders of magnitude upon its subsequent release; whereas liquified natural and/or synthetic gases undergo expansion from a liquified state to a gaseous state. Type III carrier mediated volatiles consist of but are not limited synthetic byproducts of liquid nitrogen and related superconducting, supercold, or refrigerated substances which are liquified in special deware containers, or require complex maintance procedures. The operation of Type III cryogens are typical and well understood by those skilled in the art. The drawbacks of said type III cryogens are obvious, a high maintence factor, the requirement of special refrigeration support apparatuses with a limited servicable life and the limited shelf life (10 minutes to six hours) of said cryogens. Entailed herein below are a series of equation depicting in brief the thermodynamical aspects of three classes of carrier mediated cryogenic volatiles. Typically the enthalpy, H, or heat content of any given substance is disclosed by the internal energy E and the sum of the product of pressure P and volume V such that, $$H=E+PV$$

$$\Delta H=\Delta E+P\Delta V=q$$

and the change in enthalpy, H, is equivalent to the heat absorbed by a given system q in which the work performed is mechanical pressure volume, as described by the term ($P\Delta V$) wherein, the change in internal energy is defined by $\Delta E$, and the expression of ($q-P\Delta V$), which is the heat absorbed by a given substance minus the work done. The heat absorbed by a given substance wherein pressure volume work is done under conditions whereby no chemical reaction or state transitions transpire and temperature T, rises such that, the ratio of heat absorbed over the differential temperature increases, the heat capacity C, and at a constant pressure Cp, which is most often computed in calories/degree mole such that $$\left(\frac{\partial H}{\partial T}\right)_p = C_p$$

A substance undergoing a phase transition or transformation from one physical state to another, such as evaporation or vaporization of a liquid, fusion or sublimation of a solid into a gas, or some polymorphic transition; the heat absorbed by the said substance during the transformation is defined as latent heat of transformation. The aforementioned transformation process whether it be evaporation, fusion, sublimation vaporization or the like, is equal to the enthalpy difference of the said process between the said states. The values L or of H with subscripts t, f, m, s and v are employed to indicate said states at equilibrium, at standard conditions of temperature and pressure (760 mm, 298.15° K.) and the units of said substances are calculated as a molar quantity (calories or kilocalories per mole or gram formula weight). A substance undergoing a single phase transition with the latent heat at temperature Tt the enthalpy change between temperature $T_1$ and $T_2$ with $T_1<T_t<T_2$ is expressed by the equation $$H_T - H_T = \int_{T_1}^{T_t} C_p\,dT + \Delta h_f + \int_{T_t}^{T_2} C_p^{\pi}\,dT$$

wherein C'p, C''p are the heat capacities of said substance in two separate and distinct physical states.

The process of evaporation is basically a process wherein a phase change is induced by subjecting a substance to an increment in temperature which remains constant at the temperature of vaporization Tv, until said substance a liquid is converted into a vapor. Initially the said liquid substance is confined within a container which adjusts its volume V and said liquid exerts a pressure P. Once released said fluid substance, a liquid, expands at a constant rate of expansion at p, unless acted upon by another force. The said liquid remains in a fluid state until sufficient heat is supplied, wherein Tv(P) is attained and the fluid is converted into a gas, g. The temperature of vaporization defined by Tv(P) is related to the pressure by the Clausius-Clapeyron equation herein below.

$$dT_v/dP=(T_v/nL_v)(V_g-V_1)$$

wherein Lv is the latent heat of evaporation per mole of material at pressure p, $V_1$ is the volume of the material as a liquid prior to evaporation the volume of gas, Vg is significantly greater than $V_1$, $T_v$ and changes far more rapidly with P, than does $T_m$. The reciprocal of the aforementioned Clauius-Claperyron equation described herein below.

$$dP_v/dT=[nL_v/T(V_g-V_1)]$$

defines a condition equilibrium is attained between a given substance either a liquid or fluid which does not completely fill a container; wherein some of the substance evaporates into the free space above said substance such that, equilibrium is established between evaporation and condensation therein. The vapor pressure Pv is a function of temperature T. The pressure of some foreign gas in the free space above the surface of said liquid or fluid has an indirect effect on the quantity of vapor present wherein the total pressure P exerted on said liquid is the sum of partial pressures Pf of said foreign gas and Pv of said vapor. The addition of more foreign gas to increase the total pressure P by dP, at a constant T will increase the Gibbs function of said liquid by $dG_1=V_1dP$, however the same quantity of material present in gaseous form is not affected by said foreign gas and $dG_g=V_gdP_v$. The relationship between vapor pressure Pv (P,T) and presence of said foreign gas on the total pressure is given by the expression $$dP_v/dP=V_1/V_g,$$

and may be integrated from the initial state wherein no foreign gas is present and $P=P_u$ and $P_v$ solving the previous equation to the final state, whereas $P=P_f+P_w.V_g$ is significantly greater than $V_1$, $P_v$ and changes negligibly when said foreign gas is added. The subsequent addition of a foreign gas forces a small but significant amount of vapor out of said liquid rather than forcing same said vapor back into the said liquid.

A special case of sublimation wherein a solid S sublimes at a low relative pressure to that of its confinment in a container at a sublimation temperature Ts, which is large compared to some arbitrary $\theta$ with linear expansion properties. The equation relating the sublimation temperature Ts, and sublimation pressure Ps for some specified quantity N molecules of mass at Volume V is approximately $$G_s = V_0P_s + \frac{3}{2}Nk\theta + 3NkT_s\ln(\theta/T_s) - NkT_s$$

$$= G_s \simeq NkT_s\ln(P_sV_0T_s^{7/2}/N_0k\theta^{5/2}) - NkT_s$$

where No is defined by $$N_o = V_o(4\pi lek\theta/h^2)(2\pi mk\theta/h^2)^{3/2}$$

where No defines a constant as are volumes k and h respectively and $$\theta_{rot} << T_s << \theta_{vib})$$

and $$V_o << V_s = NkT_sP_s \text{ and } \theta << T_s$$

which reduces to $$P_s \simeq N_0k\sqrt{T\theta}\,/V_o$$

The latent heat of sublimation is described by the equation herein below $$L_s = T_s(S_g - S_s) \simeq \tfrac{1}{2}NkT_s$$

wherein Ls is the latent heat of sublimation, Ts is the sublimation temperature, the gas consists of ½N molecules of mass, k is a constant and the difference (Sg−Ss) relates to the entropy change between states.

In principle the interaction of systems in regards to energy can be expressed by the following well known general energy principle equation $$\frac{D}{Dt}\int_{\gamma_m(t)} \rho(e + \tfrac{1}{2}v^2)dV = -\int_{\alpha_m(t)} q \cdot ndA + \int_{\alpha_m(t)} t_{(m)} \cdot vdA + \int_{\gamma_m(t)} \rho g \cdot vdA + \int_{\gamma_m(t)} \Phi dV$$

wherein the following terms are defined as

| | | | |
|---|---|---|---|
| $\frac{D}{Dt}\int_{\gamma_m(t)} \rho(e + \tfrac{1}{2}v^2)dV$ time rate of change of internal and kinetic energy of the body | = | $-\int_{\alpha_m(t)} q \cdot ndA$ | rate of heat transfer to the body |
| | + | $\int_{\alpha_m(t)} t_{(m)} \cdot vdA$ | rate of surface work done on the body |
| | + | $\int_{\gamma_m(t)} \rho g \cdot vdV$ | rate of work owing to body forces |
| | + | $\int_{\gamma_m(t)} \Phi dV$ | rate of energy absorbed or emitted owing to electromagnetic radiation |

Incorporated within the above equation are the principles of local equilibrium and the first law of thermodynamics and the internal energy per unit mass i.e., is assumed to be a function of space and time specified in terms of a localized thermodynamic state and the total energy referred to as total energy in a differential form, which is indicated by the expression $$\rho\frac{D}{Dt}\left(e + \frac{1}{2}v^2\right) = -\nabla \cdot q + \nabla \cdot (T \cdot v) + \rho\epsilon \cdot v + \phi$$

The application of the Reynolds transport theorem working with terms left to right yields $$\frac{D}{Dt}\int_{\gamma_m(t)} \rho\left(e + \frac{1}{2}v^2\right)dV = \int_{\gamma_m(t)} \rho\frac{D}{Dt}\left(e + \frac{1}{2}v^2\right)dV$$

incorporating the divergence theorem on the first term on the right hand side of the said energy principle giving the following expression $$-\int_{\alpha_m(t)} q \cdot ndA = -\int_{\gamma_m(t)} \nabla \cdot qdV$$

applying a stress vector as t(n)=T.n along with divergence theorem to obtain the following expression $$\int_{\alpha_m(t)} t_{(n)} \cdot vdA = \int_{\gamma_m(t)} \nabla \cdot (T \cdot v)dV$$

and upon substitution $$\int_{\gamma_m(t)} \left[ \rho \frac{D}{Dt} \left( e + \frac{1}{2} v^2 \right) + \nabla \cdot q - \nabla \cdot (T \cdot v) - \rho g \cdot v - \phi \right] dV = 0$$

The limits of integration are arbitrary, the integrand is assumed to be continuous and the integrand is necessarily identically equal to zero. Then governing differential equations for fluid motion and the transport of energy are defined by the following expressions contained herein below, which when compiled with thermodynamical data and constitutive equations for q, previously defined, are sufficient to specify temperature velocity fields by which the desired interphase heat transfer is computed and determined.

$$\rho \frac{D}{Dt} (e + \tfrac{1}{2}v^2) = -\nabla \cdot q + \nabla \cdot (T \cdot v) + \rho g \cdot v + \Phi, \text{ energy}$$

$$\rho \frac{Dv}{Dt} = \rho g + \nabla \cdot T, \text{ momentum}$$

$$\frac{\partial \rho}{\partial t} + \nabla \cdot (\rho v) = 0, \text{ mass}$$

The foregoing disclosure is a representative form of the invention and process and therefore is to be interpreted in an illustrative rather than in a limiting sense. The invention and devised processes are to be accorded the full scope of the claims appended hereto.

What is claimed is:

1. A portable, non-lethal, anti-personnel device including;

a case carrying, at one end, device control and display means and, at the other end, a telescoping, multilayer barrel having at least first, second and third concentric layers;

said first layer being the outermost layer and being electrically conducting and non-porous to volatile materials;

said second layer being of the next lesser diameter and being permeable to volatile materials;

said third layer being of the least diameter of the three layers and being hollow to form a bore for projectiles;

said case carrying there within personnel-disabling means electrically coupled to and controlled and monitored by said device control-and-display means;

said personnel-disabling means including a chemical source of volatile chemical materials, said chemical source being fluidly coupled to said second layer of said telescoping barrel;

said personnel-disabling means including, in addition, a source of high-frequency electrical energy and a source of radio-frequency energy electrically coupled to said first layer of said telescoping barrel;

said personnel-disabling means including, in addition, a source of projectiles said source communicating with said bore in said third layer for the passage of projectiles out of said device from said personnel-disabling means;

central logic means carried by said case and electrically coupled between said control-and-display means and said personnel-disabling means and responsive to adjustment of the controls in said control and display means to select and activate a selected one of said personnel-disabling means; and, power means electrically coupled to said control-and-display means, to said personnel-disabling means and to said central logic means for powering said device.

2. A device according to claim 1 which includes, in addition, further personnel-disabling means carried by said case, said further personnel-disabling means including a coherent-light generator and a lens optically coupled to said coherent-light generator, said lens being carried in an outer wall of said case and being positioned to focus coherent light energy in the direction in which said telescoping barrel extends, to permit the emission in a desired direction of light from said coherent-light generator;

said further personnel-disabling means including, in addition, ultrasonic-wave generating means carried by said case, said ultrasonic-wave generating means including a piezoelectric transducer carried by said case on an outer wall thereof, said transducer being positioned to emit energy in the direction of extension of said telescoping barrel.

3. A device according to claim 2 which includes, in addition, personnel target tracking means coupled to said coherent-light generator and responsive to return light from target personnel to track target personnel.

4. A device according to claim 3 which includes, in addition, memory means for storing, electrically, identifying characteristics of said target personnel.

5. A device according to claim 1 which includes personnel-condition sensing means carried internally to said case and coupled electrically to said first layer, to said control-and-display means, to said logic means and to said power means, and responsive to contact of said first layer of said barrel with the skin of target personnel to detect the physical condition of such target personnel.

6. A device according to claim 5 in which said personnel-condition sensing means includes electrical feedback means electrically coupled to said logic means.

7. Apparatus according to claim 1 in which said source of projectiles includes shaping means coupled, electrically, to said power means, to said control and display means and to said logic means for optimizing the shape of projectiles from the said source.

8. A device according to claim 1 in which said second layer is made of sintered metal.

9. Apparatus according to claim 1 in which said source of projectiles includes projectile selection and launching means electrically coupled to and controlled by said control-and-display means and is further electrically coupled to said power means and said logic means.

10. A device according to claim 1 in which said chemical source provides carrier-mediated volatiles.

* * * * *